US007380925B2

(12) United States Patent
Katayama et al.

(10) Patent No.: US 7,380,925 B2
(45) **Date of Patent: *Jun. 3, 2008**

(54) INK CARTRIDGE

(75) Inventors: Naoki Katayama, Kariya (JP); Toyonori Sasaki, Anjo (JP); Tomohiro Kanbe, Bisai (JP); Katsunori Nishida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 325 days.

This patent is subject to a terminal disclaimer.

(21) Appl. No.: 11/024,624

(22) Filed: Dec. 30, 2004

(65) Prior Publication Data

US 2005/0162490 A1 Jul. 28, 2005

Related U.S. Application Data

(63) Continuation-in-part of application No. 10/255,604, filed on Sep. 27, 2002, now Pat. No. 7,137,689, and a continuation-in-part of application No. 10/938,840, filed on Sep. 13, 2004.

(51) Int. Cl.
*B41J 2/175* (2006.01)
*B41J 2/195* (2006.01)
*B41J 2/14* (2006.01)

(52) U.S. Cl. ..... 347/86; 347/7; 347/49

(58) Field of Classification Search ..... 347/7, 347/49, 85, 86, 87

See application file for complete search history.

(56) References Cited

U.S. PATENT DOCUMENTS 4,074,284 A 2/1978 Dexter et al.
4,183,031 A 1/1980 Kyser et al.
4,342,042 A 7/1982 Cruz-Uribe et al.
4,509,062 A 4/1985 Low et al.
4,604,633 A 8/1986 Kimura et al.
4,673,955 A 6/1987 Ameyama et al.
4,777,497 A 10/1988 Nozu et al.
5,283,593 A 2/1994 Wehl
5,473,350 A 12/1995 Mader et al.

(Continued)

FOREIGN PATENT DOCUMENTS

CN 1189415 A 8/1998

(Continued)

OTHER PUBLICATIONS

U.S. Appl. No. 11/101,447, filed Apr. 8, 2005, Murakami et al.

(Continued)

*Primary Examiner*—Anh T. N. Vo
(74) *Attorney, Agent, or Firm*—Oliff & Berridge, PLC

(57) ABSTRACT

An ink cartridge includes a first side wall, a second side wall opposite from the first side wall, a front wall, a back wall opposite from the front wall, a bottom wall, a top wall opposite from the bottom wall, and an ink chamber formed in a space enclosed by the first side wall, the second side wall, the front wall, the back wall, the bottom wall and the top wall. The bottom wall includes an ink supply opening through which ink may be provided to a print head, and a protruding region of the ink cartridge protrudes outwardly from the first side wall.

41 Claims, 47 Drawing Sheets

U.S. PATENT DOCUMENTS

| | | | | |
|---|---|---|---|---|
| 5,534,899 | A * | 7/1996 | Uchikata et al. | 347/49 |
| 5,623,290 | A | 4/1997 | Iida et al. | |
| 5,719,609 | A | 2/1998 | Hauck et al. | |
| 5,729,256 | A | 3/1998 | Yamanaka et al. | |
| 5,736,992 | A | 4/1998 | Pawlowski, Jr. et al. | |
| 5,777,647 | A | 7/1998 | Pawlowski, Jr. et al. | |
| 5,841,453 | A * | 11/1998 | Sasaki | 347/86 |
| 5,896,151 | A | 4/1999 | Miyazawa et al. | |
| 6,116,723 | A | 9/2000 | Childers | |
| 6,142,617 | A | 11/2000 | Barinaga et al. | |
| 6,155,678 | A * | 12/2000 | Komplin et al. | 347/86 |
| 6,168,262 | B1 | 1/2001 | Clark et al. | |
| 6,170,937 | B1 | 1/2001 | Childers et al. | |
| 6,338,552 | B1 | 1/2002 | Sato et al. | |
| 6,422,674 | B1 | 7/2002 | Hinami et al. | |
| 6,481,837 | B1 | 11/2002 | Askren et al. | |
| 6,521,311 | B2 | 2/2003 | Ito et al. | |
| 6,554,402 | B2 | 4/2003 | Trafton et al. | |
| 6,609,461 | B2 | 8/2003 | Horii et al. | |
| 6,616,255 | B2 | 9/2003 | Murakami et al. | |
| 6,830,322 | B2 | 12/2004 | Shihon et al. | |
| 6,893,118 | B2 | 5/2005 | Murakami et al. | |
| 6,899,418 | B2 | 5/2005 | Sasaki et al. | |
| 7,178,911 | B2 | 2/2007 | Katayama et al. | |
| 2002/0047882 | A1 | 4/2002 | Karlinski et al. | |
| 2006/0007283 | A1* | 1/2006 | Sacco et al. | 347/86 |

FOREIGN PATENT DOCUMENTS

| | | |
|---|---|---|
| DE | 80 23 471 | 11/1980 |
| EP | 0 689 936 | 1/1996 |
| EP | 0 742 102 | 11/1996 |
| EP | 0 834 402 | 4/1998 |
| EP | 1 142 713 A2 | 10/2001 |
| JP | A 58 53473 | 3/1983 |
| JP | A-59-143646 | 8/1984 |
| JP | A-59-192573 | 10/1984 |
| JP | 59 204564 | 11/1984 |
| JP | A-59-204566 | 11/1984 |
| JP | A-59-209878 | 11/1984 |
| JP | A-61-054942 | 3/1986 |
| JP | A-61-158460 | 7/1986 |
| JP | A-61-277459 | 12/1986 |
| JP | A-61-277460 | 12/1986 |
| JP | 63-207652 | 8/1988 |
| JP | A-10-20149 | 1/1989 |
| JP | 02-102062 | 4/1990 |
| JP | A-3-184873 | 8/1991 |
| JP | A-3-213349 | 9/1991 |
| JP | B2-3-60670 | 9/1991 |
| JP | A-3-505999 | 12/1991 |
| JP | A-03-506000 | 12/1991 |
| JP | 04 344250 | 11/1992 |
| JP | A-05-261935 | 10/1993 |
| JP | 06-024001 | 2/1994 |
| JP | 06 099588 | 4/1994 |
| JP | 06-115089 | 4/1994 |
| JP | A-07-214791 | 8/1995 |
| JP | 07 314716 | 12/1995 |
| JP | A-08-230204 | 9/1996 |
| JP | A-9-1819 | 1/1997 |
| JP | A-09-20014 | 1/1997 |
| JP | 10 202896 | 4/1998 |
| JP | B2 2768817 | 4/1998 |
| JP | 01-232157 | 9/1998 |
| JP | 11-058783 | 3/1999 |
| JP | 2002 086753 | 3/2002 |
| JP | 2005-297320 | 10/2005 |
| WO | WO 90/08564 | 8/1990 |

OTHER PUBLICATIONS

U.S. Appl. No. 10/255,617, filed Sep. 27, 2002 to Sasaki et al.
U.S. Appl. No. 10/255,606, filed Sep. 27, 2002 to Sasaki et al.
U.S. Appl. No. 10/255,646, filed Sep. 27, 2002 to Sasaki et al.
U.S. Appl. No. 10/255,618, filed Sep. 27, 2002 to Sasaki et al.
U.S. Appl. No. 10/758,098, filed Jan. 16, 2004, Sasaki et al.

* cited by examiner

FIG. 52A
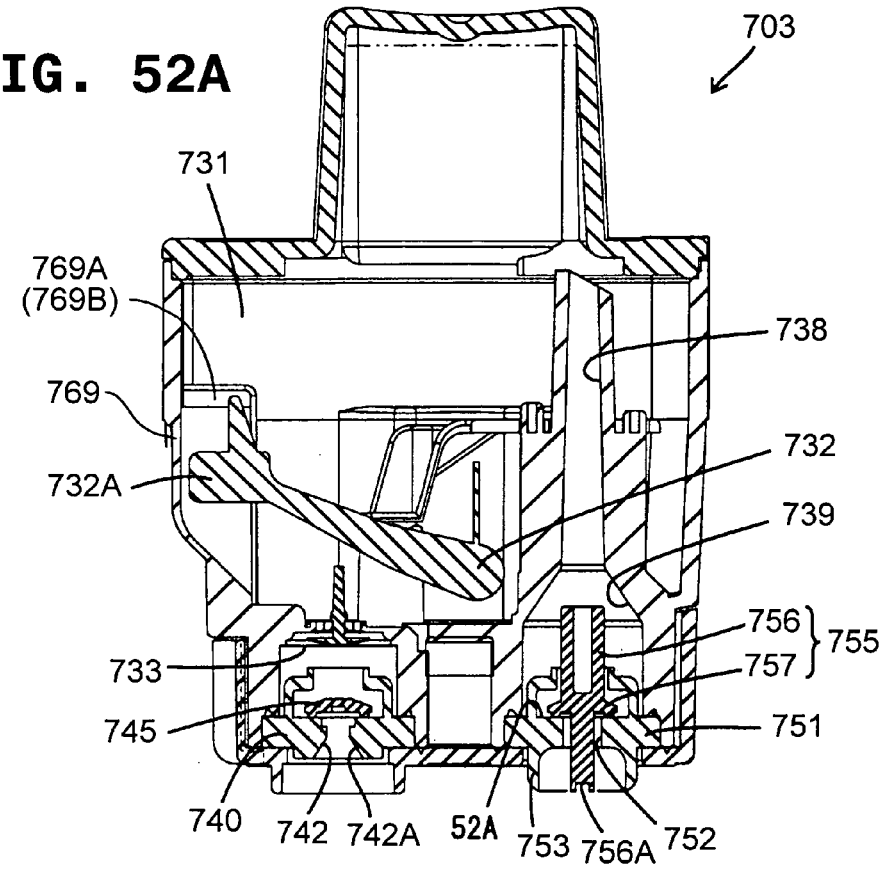
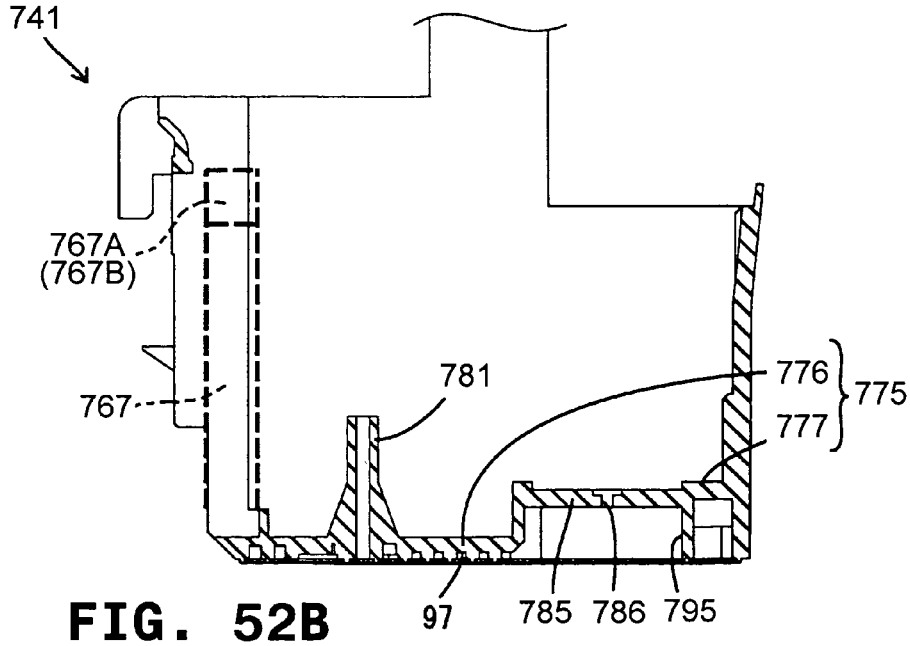
FIG. 52B

INK CARTRIDGE

CROSS-REFERENCE TO RELATED APPLICATIONS

This application is a continuation-in-part of U.S. patent application Ser. No. 10/255,604, filed Sep. 27, 2002, now U.S. Pat. No. 7,137,689, and U.S. patent application Ser. No. 10/938,840, filed Sep. 13, 2004, the disclosures of which are incorporated herein by reference in their entireties.

This application claims priority from JP 2002-090322, filed Mar. 28, 2002; JP 2002-218192, filed Jul. 26, 2002; JP 2002-225295, filed Aug. 1, 2002; JP 2002-214079, filed Jul. 23, 2002; JP 2002-018535, JP 2002-018536, JP 2002-018537, JP 2002-018538, JP 2002-018539, JP 2002-018540, JP 2002-018541, JP 2002-018542, JP 2002-018543, JP 2002-018544, each filed Jul. 10, 2002; JP 2002-019748, JP 2002-019749, JP 2002-019750, JP 2002-019751, JP 2002-019752, JP 2002-019753, JP 2002-019754, JP 2002-019755, JP 2002-019756, JP 2002-019757, JP 2002-019758, JP 2002-019759, JP 2002-019760, JP 019761, JP 2002-019762, JP 2002-019763, each filed Jul. 23, 2002; JP 2003-340284, filed Sep. 30, 2003; JP 2004-074508, filed Mar. 16, 2004; and JP 2004-076627, JP 2004-076628, each filed Mar. 17, 2004; the disclosures of which are incorporated herein by reference in their entireties.

BACKGROUND

Ink cartridges for supplying ink to recording devices are broadly used. One type has a case that holds a porous member impregnated with ink. Another type includes a flexible bag filled with ink. A variety of configurations have been provided in the ink cartridges to enable detection of the amount of ink remaining in the ink cartridge.

JP-B-3-60670 discloses an ink cartridge with a plate-shaped member that abuts the outer surface of a flexible bag that is filled with ink. Movement of the member is detected to detect the amount of residual ink in the bag.

JP-A-3-505999 discloses an ink cartridge including a case with one open surface. The open end of the case is covered with a flexible film. Ink is contained in the space between the case and the flexible film. An electric contact is disposed at the bottom of an opening in the case. The film moves toward the electric contact as ink is used up during printing operations. When the film contacts the electric contact, the electric contact is activated to indicate that ink has run out.

An ink-jet printer is known, in which ink is discharged from nozzles to recording paper to perform printing. Such an inkjet printer is generally provided with a detachable ink cartridge. When an inkjet head is driven to perform the discharge operation in a state in which the ink cartridge is empty, air sometimes invades the inkjet head. An inkjet head into which the air has been introduced may be damaged so as to be inoperable. Therefore, it is necessary to detect the amount of the ink stored in an ink cartridge. A method for detecting the amount of the ink is known in which an amount of the ink is detected by estimating and accumulating amounts of the ink used each time printing is performed. However, errors tend to arise in such calculations. Therefore, it is prudent to stop the use of the ink cartridge before actually necessary. As a result, ink is wasted.

An alternative technique has been proposed (see, e.g., JP-A-9-001819, FIG. 7). That is, a float, which has a specific gravity smaller than that of ink, is arranged on the ink contained in the ink cartridge. The height of the float floating on the ink is detected from the outside to detect the amount of the ink contained in the ink cartridge.

However, according to the technique disclosed in JP-A-9-001819, the float sometimes sticks to the wall surface. That is, the float does not descend due to disturbances such as surface tension of ink adhered to an inner wall surface of the ink cartridge. Therefore, it is impossible to indicate the correct amount of the ink contained in the ink cartridge.

SUMMARY

Various exemplary embodiments of ink cartridges according to the present invention address shortcomings of the ink cartridges and ink detection techniques described above.

Various exemplary embodiments of ink cartridges according to the present invention include a first side wall, a second side wall opposite from the first side wall, a front wall, a back wall opposite from the front wall, a bottom wall, a top wall opposite from the bottom wall, and an ink chamber formed in a space enclosed by the first side wall, the second side wall, the front wall, the back wall, the bottom wall and the top wall. In various exemplary embodiments, the bottom wall includes an ink supply opening through which ink may be supplied to a print head, a protruding region of the ink cartridge protrudes outwardly from the first side wall, and at least one portion of the protruding region is capable of preventing light from passing through the at least one portion in a direction from a front wall side of the protruding region to a back wall side of the protruding region.

Various exemplary embodiments of ink cartridges according to the present invention include a first side wall, a second side wall opposite from the first side wall, a front wall, a back wall opposite from the front wall, a bottom wall, a top wall opposite from the bottom wall, and an ink chamber formed in a space enclosed by the first side wall, the second side wall, the front wall, the back wall, the bottom wall and the top wall. In various exemplary embodiments, the bottom wall includes an ink supply opening through which ink may be provided to a print head, a protruding region of the ink cartridge protrudes outwardly from the first side wall, the protruding region includes a portion formed of a material through which an ink detecting light may pass, and a light-blocking member is positioned so as to prevent light from passing through the protruding region via the portion in a direction from a front wall side of the protruding region to a back wall side of the protruding region.

Various exemplary embodiments of ink cartridges according to the present invention include a first side wall, a second side wall opposite from the first side wall, a front wall, a back wall opposite from the front wall, a bottom wall, a top wall opposite from the bottom wall, and an ink chamber formed in a space enclosed by the first side wall, the second side wall, the front wall, the back wall, the bottom wall and the top wall. In various exemplary embodiments, the bottom wall includes an ink supply opening through which ink may be provided to a print head, a protruding region of the ink cartridge protrudes outwardly from the first side wall, and the protruding region is configured so as to be positioned between two guiding protrusions of an image forming device when the cartridge is installed in the image forming device.

Various exemplary embodiments of ink cartridges according to the present invention include a side wall, a bottom wall that includes an opening through which ink may be supplied to an outside of the ink cartridge, and a light-blocking member. In various exemplary embodiments, the side wall and the bottom wall are configured to form a space in which an ink chamber may be provided, and the opening intersects a plane defined by the light-blocking member.

Various exemplary embodiments of ink cartridges according to the present invention include a side wall, a bottom wall that includes an opening through which ink may be supplied to an outside of the ink cartridge, and a light-blocking member. In various exemplary embodiments, the side wall defines a first plane, the bottom wall defines a second plane and the light-blocking member lies substantially in a plane perpendicular to first and second planes.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein:

FIG. 38 shows the ink cartridge depicted in FIG. 37, wherein

FIGS. 45A and 45B are sectional views illustrating the ink supply valve in FIG. 40, wherein FIG. 45A shows a valve-closed state and FIG. 45B shows a valve-open state;

FIG. 52 is a cross-sectional view of an exemplary ink cartridge separated from a cartridge mounting portion of an exemplary multifunction device;

56FIG. 55 is a cross-sectional view of an exemplary ink cartridge showing a distance relation between a light-blocking portion and a ink supply opening.

DETAILED DESCRIPTION OF EMBODIMENTS

An exemplary ink cartridge 200 and an exemplary multifunction device 1 that uses the ink cartridge 200 will be described with reference to FIGS. 1 to 36. It should be appreciated that, while reference is made throughout this application to multifunction devices, the cartridges, machine features and methods described herein are equally applicable to uni-functional image forming devices, such as printers, copiers and facsimile machines.

Figure 1:
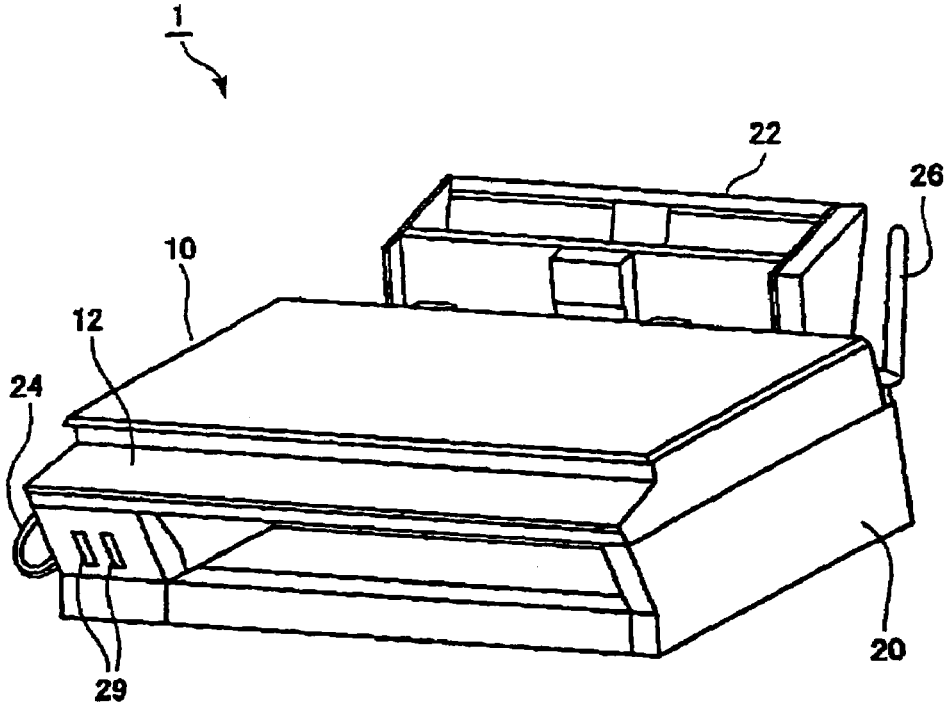
FIG. 1 is a perspective view showing overall configuration of an exemplary multifunction device mounted with an exemplary ink cartridge.

FIG. 1 shows an exemplary multifunction device 1. The multifunction device 1 includes a scanner function, a copy function, and a facsimile function. The multifunction device 1 has a slim and compact configuration including a retrieval unit 10 and an ink jet recording unit 20. The ink jet recording unit 20 is disposed on the retrieval unit 10. A control panel 12 is provided on the retrieval unit 10. The ink jet recording unit 20 is provided with a sheet-supply tray 22. The multifunction device 1 is provided with a telephone 24 and an antenna 26. The telephone 24 is capable of wireless transmission with a cordless handset (not shown) using the antennae 26. The telephone 24 is capable of connecting with a public telephone circuit and serving as a transfer point for the cordless handset (not shown) while the cordless handset is used for a telephone call.

Figure 7:
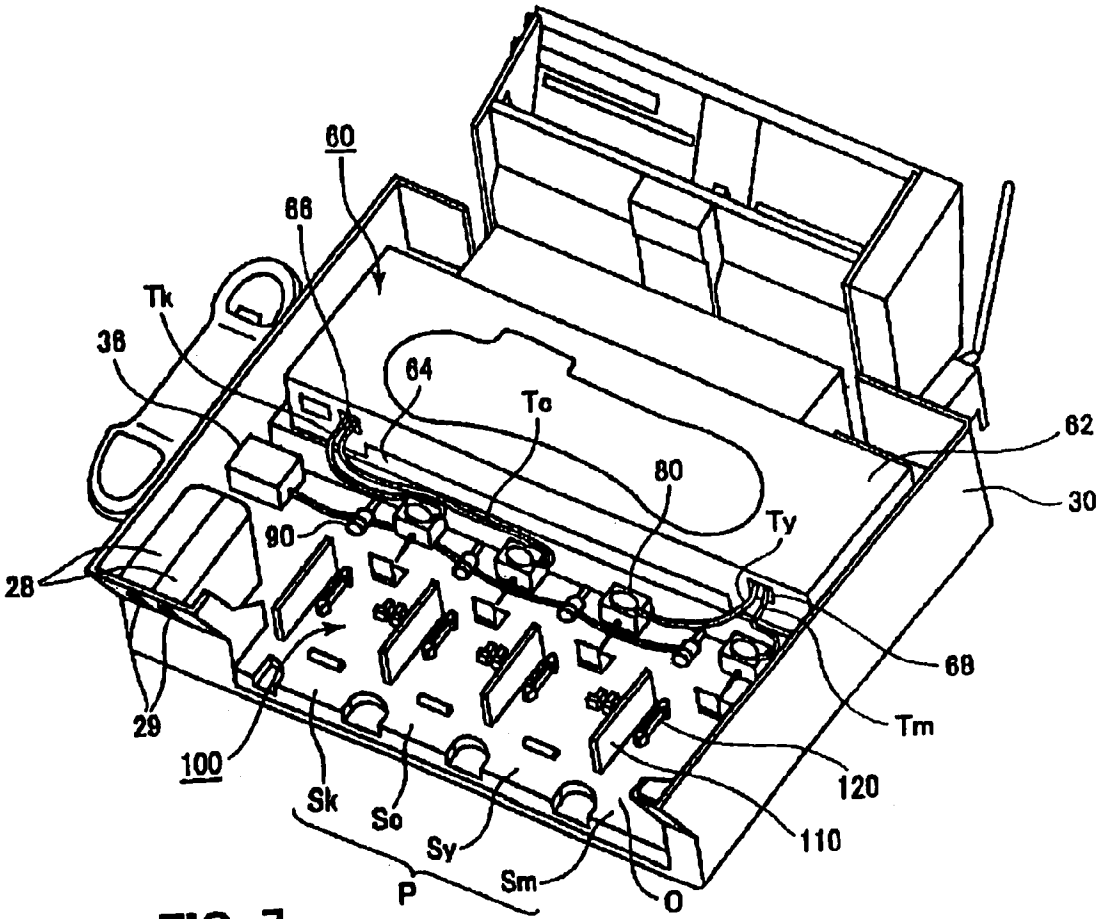
FIG. 7 is a perspective view of an exemplary multifunction device without a flat bed type retrieval unit or a cover body.

It should be noted that a power source, a main substrate, an NCU substrate, and two media board devices 28 shown in FIG. 7 are provided in the ink jet recording unit 20 in addition to recording mechanisms for performing recording operations. The main substrate is for controlling operations of the multifunction device 1. The NCU substrate is for controlling connection with the public telephone circuit for the facsimile function and the telephone function. Two media slots 29 are provided at the front surface of the ink jet recording unit 20. By inserting an external memory medium into either of the media slots 29, the external medium can be freely detachably mounted in the corresponding one of the media board devices 28. The media board devices 28 retrieve data, such as data taken by a digital camera, from the external memory medium, whereupon the data is used for printing and the like.

Figure 2:
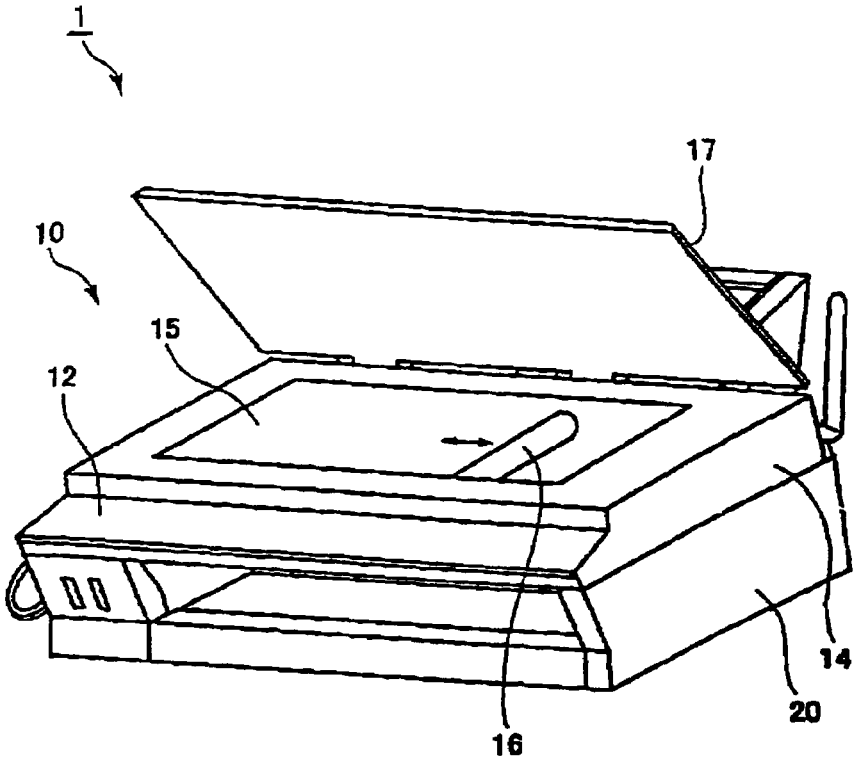
FIG. 2 is a perspective view of the multifunction device in FIG. 1 with an upper cover of a flat bed type retrieval device open.

As shown in FIG. 2, the retrieval unit 10 is a flat head type retrieval unit and includes a retrieval unit case 14. The retrieval unit case 14 includes a document glass 15 on which a document to be scanned is placed. A contact image sensor 16 is disposed below the document glass 15. A configuration is provided for generating scanning movements of the contact image sensor 16. An upper cover 17 for covering the upper surface of the document glass 15 is provided openable and closable with respect to the retrieval unit case 14.

The control panel 12 is provided on the upper surface to the front of the retrieval unit case 14. An operator inputs commands for operations, such as a copy operation, a facsimile operation, or a scanner operation, of the multifunction device 1 through the control panel 12.

It should be noted that an attachment means (not shown) is provided for enabling the flat head type retrieval unit 10 to be disconnected from the ink jet recording unit 20.

Figure 3:
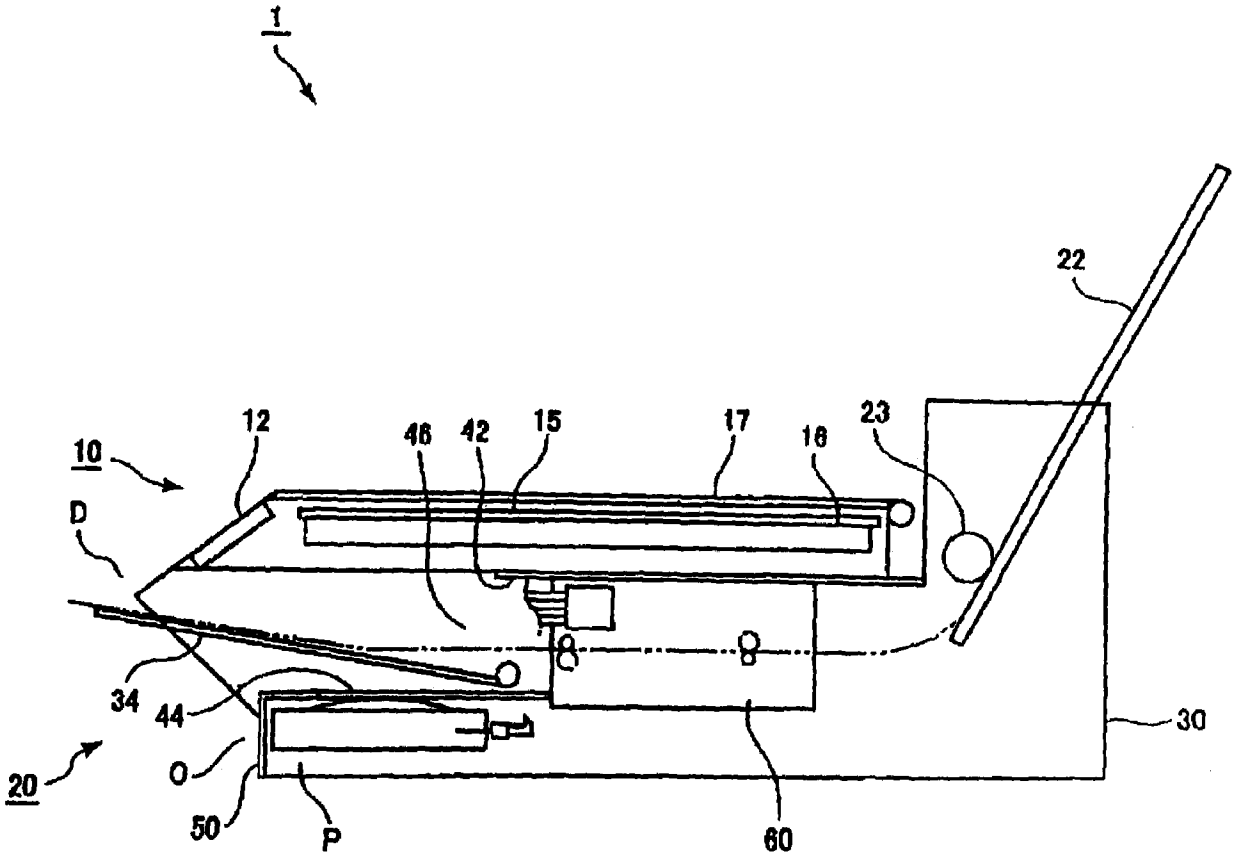
FIG. 3 is a cross-sectional schematic view of the multifunction device in FIG. 1.

As shown in FIG. 3, the ink jet recording unit 20, which is below the retrieval unit 10, includes a housing 30. The sheet-supply tray 22 protrudes from inside the housing 30 to above the rear portion of the housing 30. A sheet-supply roller 23 is provided in the sheet-supply tray 22 so that one sheet at a time can be supplied. A printer engine 60 is provided as a recording portion at a position where sheets are received from the sheet-supply tray 22. A sheet-discharge portion D is provided to the front of the printer engine 60. Sheets recorded on by the printer engine 60 are discharged from the sheet-discharge portion D. It should be noted that a sheet-discharge tray 34 is freely detachably mounted on the sheet-discharge portion D. The sheet-discharge tray 34 serves as a portion of a sheet transport pathway. An ink cartridge holding portion P into which the ink cartridges 200 (FIG. 12) are mounted is disposed between the sheet-discharge portion D and the base of the housing 30. In this way, the ink cartridge holding portion P is disposed at a position lower than the printer engine 60.

Figure 4:
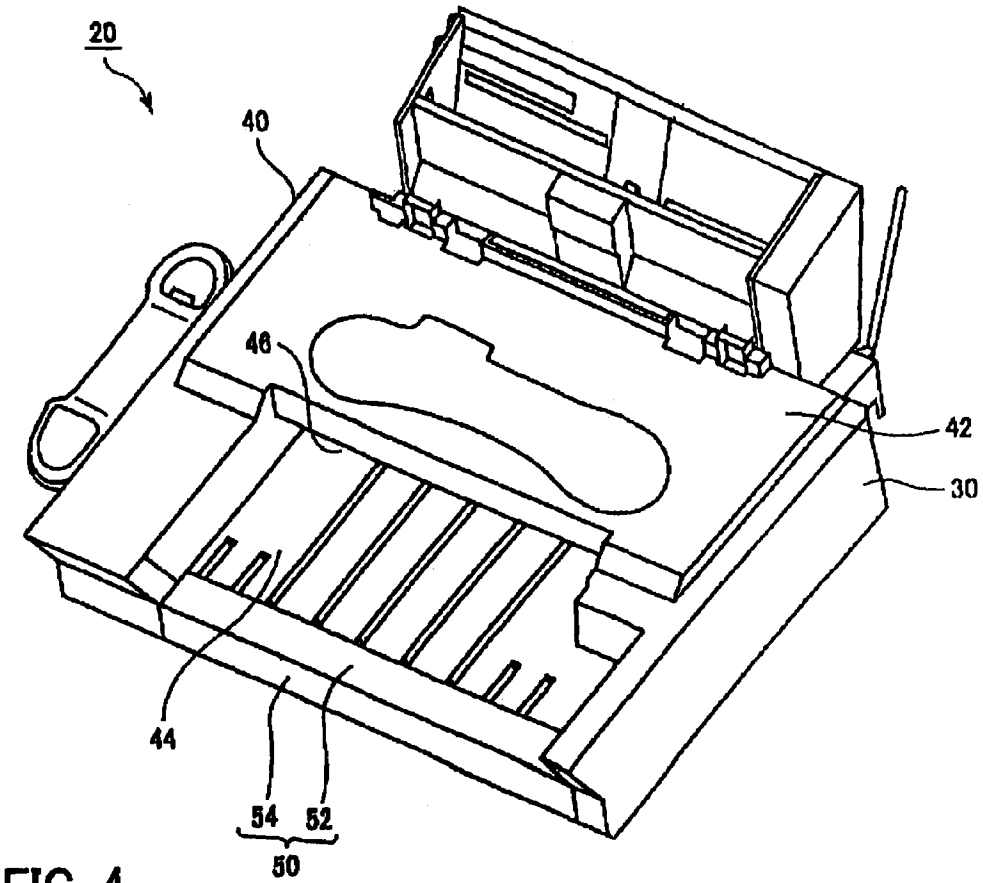
FIG. 4 is a perspective view of the multifunction device in FIG. 1 without a flat bed type retrieval device.

As shown in FIG. 4, the housing 30 is covered from above by a cover 40. The cover 40 has an engine cover portion 42 and a cartridge holding cover portion 44. The engine cover portion 42 covers the printer engine 60 from above. The cartridge holding cover portion 44 is provided below the sheet-discharge portion D and covers the ink cartridge holding portion P from above. The front surface of the engine cover portion 42 is opened to form a sheet-discharge port 46. The cartridge holding cover portion 44 is positioned below the pathway along which sheets recorded by the printer engine 60 are transported, that is, below the sheet-discharge tray 34.

As shown in FIG. 3, the cartridge holding cover portion 44 functions as a ceiling surface of the ink cartridge holding portion P. As will be described later, the ink cartridge holding portion P is formed between the cartridge holding cover portion 44 and a cartridge holding portion base wall 32 so that the ink cartridges 200 can be inserted to the rear side of the ink cartridge holding portion P from a front surface opening portion O. A front surface cover 50 is provided to selectively cover (FIG. 4) and open (FIG. 6) the front surface opening portion O. The front surface cover 50 includes an upper surface wall 52 and a front surface wall 54. When the front surface cover 50 is closed as shown in FIG. 4, the upper surface wall 52 is aligned on the same imaginary plane as the cartridge holding cover portion 44 and the front surface wall 54 extends vertically downward from the upper surface wall 52.

Figure 5:
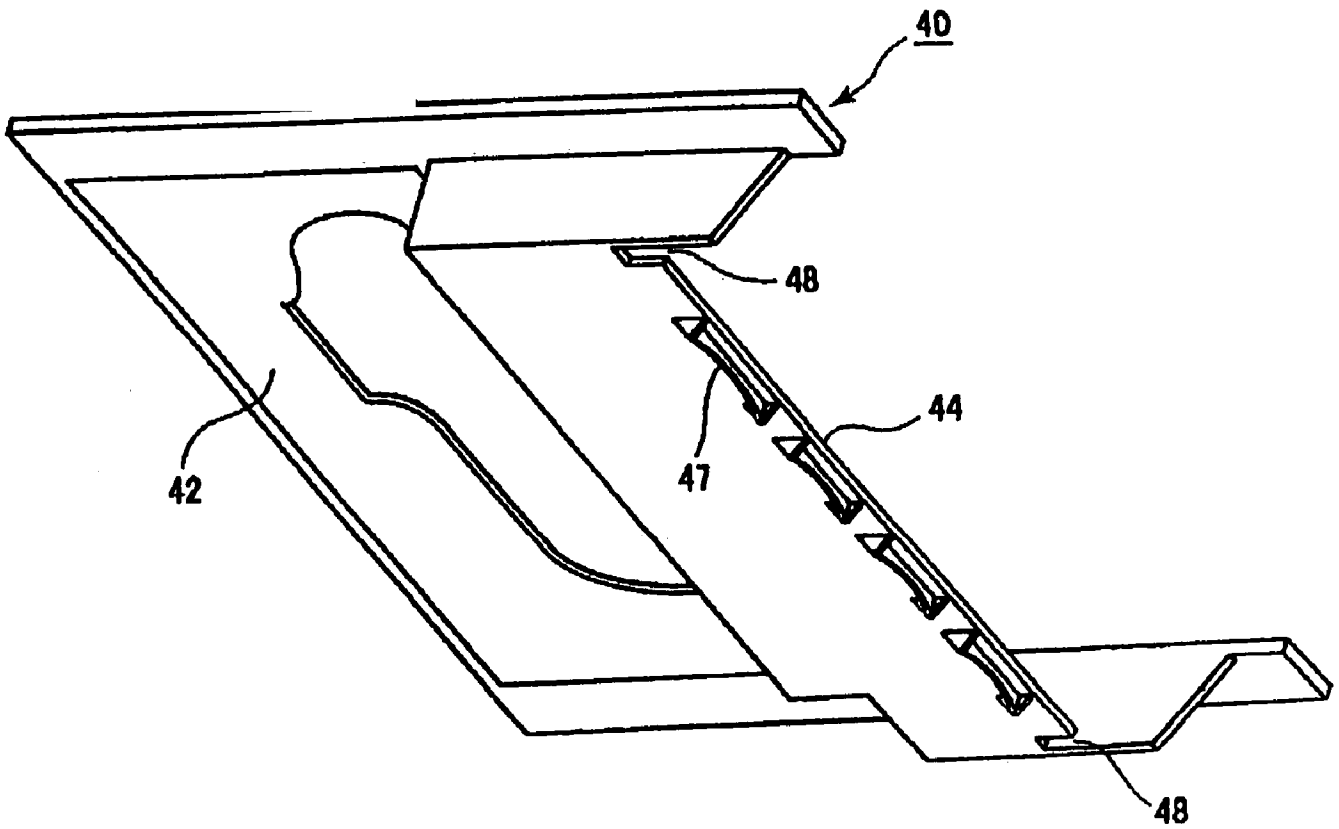
FIG. 5 is a perspective view of a lower surface of a cover body of an exemplary multifunction device.

As shown in FIG. 5, four curve-shaped protruding ribs 47 are formed on the lower surface of the cartridge holding cover portion 44. The curved shape of the curve-shaped protruding ribs 47 is formed to follow the shape of the upper surface of the four ink cartridges 200 mounted in the ink cartridge holding portion P. Also, a pair of notches 48 are formed in left and right ends of the cartridge holding cover portion 44.

Figure 6:
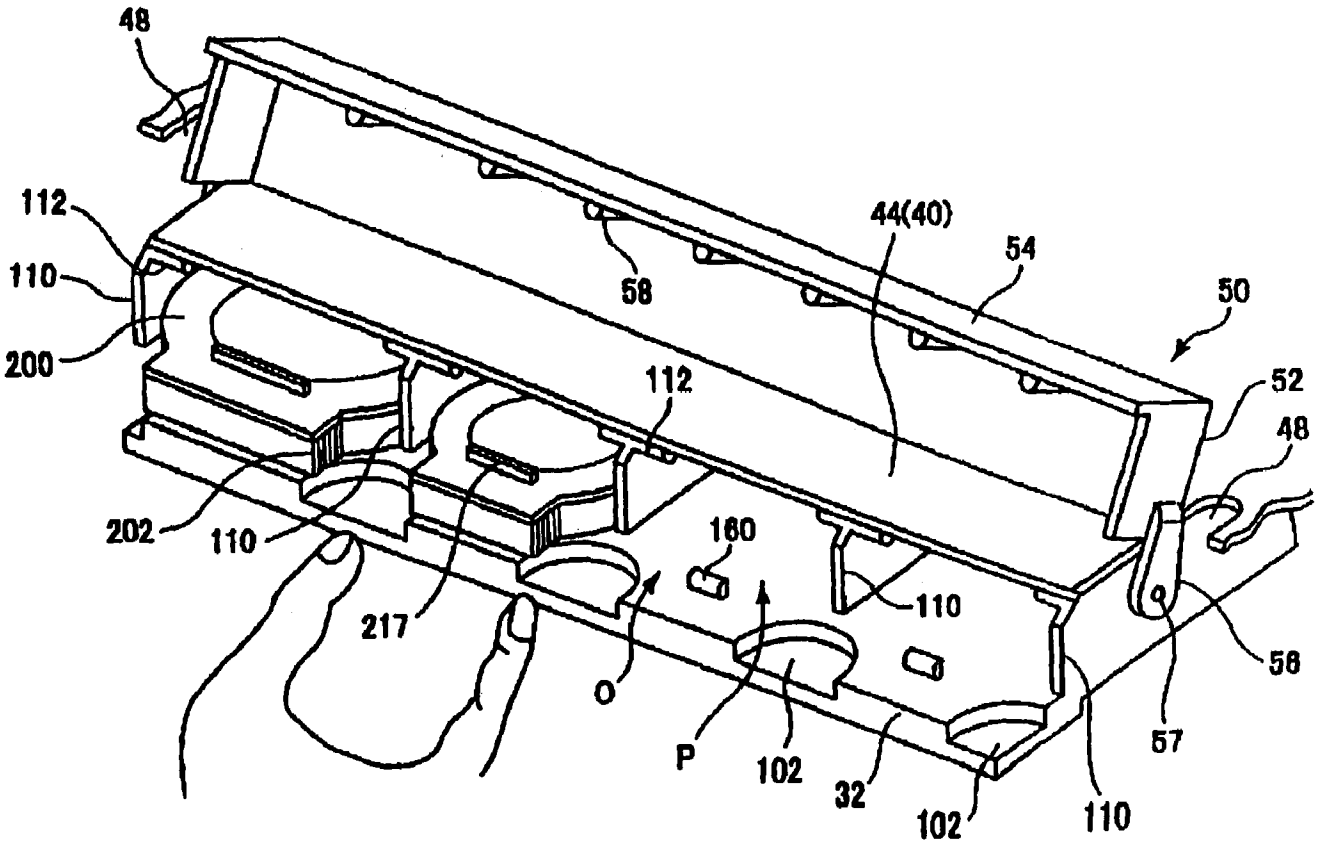
FIG. 6 is a perspective view of a multifunction device with a cover body open.

As shown in FIG. 6, a pair of arms 56 provided to the front surface cover 50 are received by the notches 48 when the front surface cover 50 is opened up. As will be described later, five partition walls 110 are aligned on the base wall 32 in the ink cartridge holding portion P. A pivot shaft 57 protrudes from the two end position partition walls 110. The pair of arms 56 of the front surface cover 50 are pivotably attached to the pivot shaft 57 so that the user can freely open and close the front surface cover 50.

Seven vertical ribs 58 are formed to the rear side of the front surface cover 50 so as to extend vertically when the cover 50 is closed. The vertical ribs 58 extend from the front surface wall 54 of the front surface cover 50 to a portion of the upper surface wall 52. Four of the seven vertical ribs 58 are formed at positions that correspond to the widthwise center of the mounted ink cartridges 200. Accordingly, when the front surface cover 50 is closed from the open condition shown in FIG. 6, the corresponding vertical ribs 58 automatically press any partially inserted ink cartridges 200 deep into the ink cartridge holding portion recording sheet recording sheet P, so that the ink cartridges 200 are accurately inserted even when one of the ink cartridges 200 is incompletely inserted into the ink cartridge holding portion P. Although not shown in the drawings, a plurality of lateral ribs is also formed at the rear surface of the front surface cover 50. The lateral ribs extend in the horizontal direction in intersection with the seven vertical ribs 58 and are for reinforcing the seven vertical ribs 58.

The cartridge holding portion base wall 32 extends further forward than the cartridge holding cover portion 44 in order to guide the ink cartridges 200 into the front surface opening portion O. The portion of the cartridge holding portion base wall 32 that extends further forward than the cartridge holding cover portion 44 is formed with indentations 102 at positions that correspond to the partition walls 110. The indentations 102 have either a quarter or half circle shape when viewed in plan. The indentations 102 have a narrower width than grasping portions 202 of the ink cartridges 200 housed in the ink cartridge holding portion P so that the user can more easily grasp the ink cartridges 200 housed in the ink cartridge holding portion P using his or her fingers.

FIG. 7 shows the multifunction device 1 with the cover 40 and the front surface cover 50 removed from the ink jet recording unit 20. As can be seen in FIG. 7, the housing 30 has an open upper side and the front surface opening portion O of the ink cartridge holding portion P is the front side of the housing 30. The two media board devices 28 are disposed at positions that correspond to the media slots 29. Also, a positive pressure pump 36 to be described later is disposed behind the media board devices 28.

A black (K) ink cartridge-mounting portion Sk, a cyan (C) ink cartridge-mounting portion Sc, a yellow (Y) ink cartridge-mounting portion Sy, and a magenta (M) ink cartridge-mounting portion Sm are aligned in the left-right direction in the ink cartridge holding portion P. The black (K) ink cartridge-mounting portion Sk is for mounting a black (K) ink cartridge 200*k*, the cyan (C) ink cartridge-mounting portion Sc is for mounting a cyan (C) ink cartridge 200*c*, the yellow (Y) ink cartridge-mounting portion Sy is for mounting a yellow (Y) ink cartridge 200*y*, and the magenta (M) ink cartridge-mounting portion Sm is for mounting a magenta (M) ink cartridge 200*m*.

The black (K) ink cartridge 200*k*, the cyan (C) ink cartridge 200*c*, the yellow (Y) ink cartridge 200*y*, and the magenta (M) ink cartridge 200*m* will be referred to collectively as the ink cartridges 200 hereinafter. Further, the black (K) ink cartridge-mounting portion Sk, the cyan (C) ink cartridge-mounting portion Sc, the yellow (Y) ink cartridge-mounting portion Sy, and the magenta (M) ink cartridge-mounting portion Sm will be referred to collectively as the ink cartridge-mounting portions S hereinafter.

The ink cartridge holding portion P is configured from the ink cartridge-mounting portions S, which are aligned in the left-right direction on the same imaginary plane (on the base wall 32) below the ceiling plate, which configures the cartridge holding cover portion 44 of the cover 40, and below the sheet-discharge tray 34, which serves as a portion of a sheet transport pathway. Accordingly, the ink cartridge holding portion P overall has a flat and substantially parallelepiped shape. Accordingly, the overall configuration of the multifunction device 1 can be formed thin and compact.

Ink supply mechanisms 80, a positive pressure application mechanism 90, and cartridge-mounting mechanisms 100 are provided in the ink cartridge-mounting portions S. Each cartridge-mounting mechanism 100 is for mounting the corresponding ink cartridges 200 as will be described later. The positive pressure application mechanism 90 is for applying a positive pressure from the positive pressure pump 36 to ink in the mounted ink cartridges 200. The ink supply mechanisms 80 are for supplying ink in the mounted ink cartridges 200 to the printer engine 60. Ink-supply tubes T for supplying ink into the printer engine 60 extend from the ink supply mechanisms 80. That is, a black (K) ink-supply tube Tk extends from the black (K) ink cartridge-mounting portion Sk, a cyan (C) ink-supply tube Tc extends from the cyan (C) ink cartridge-mounting portion Sc, a yellow (Y) ink-supply tube Ty extends from the yellow (Y) ink cartridge-mounting portion Sy, and a magenta (M) ink-supply tube Tm extends from the magenta (M) ink cartridge-mounting portion Sm. The black (K) ink-supply tube Tk, the cyan (C) ink-supply tube Tc, the yellow (Y) ink-supply tube Ty, and the magenta (M) ink-supply tube Tm will be referred to collectively as the ink-supply tubes T hereinafter.

Although not shown in the drawings, a waste ink absorbing material is disposed on the housing 30 behind the ink cartridge holding portion P and below the printer engine 60. The printer engine 60 includes an engine housing 62. Although not shown in the drawings, a sheet transport slot is formed in the rear surface of the engine housing 62. The sheet transport slot is for receiving sheets supplied from the sheet-supply tray 22. An engine-side sheet-discharge slot 64 is formed in the front surface of the engine housing 62. The engine-side sheet-discharge slot 64 is for discharging sheets that were recorded on by the printer engine 60 toward the sheet-discharge portion D. The sheet-transport pathway is further defined in the engine housing 62 from the sheet transport slot to the engine-side sheet-discharge slot 64.

Printed sheets are discharged onto the sheet-discharge portion D because the engine-side sheet-discharge slot 64 confronts the sheet-discharge port 46 (FIG. 4) while the cover 40 covers the housing 30. A KC tube opening 66 and a YM tube opening 68 are formed in the front surface of the engine housing 62. The KC tube opening 66 is for introducing the black (K) ink-supply tube Tk and the cyan (C) ink-supply tube Tc into the printer engine 60. The YM tube opening 68 is for introducing the yellow (Y) ink-supply tube Ty and the magenta (M) ink-supply tube Tm into the printer engine 60. Although not shown in the drawings, a cable opening for introducing cables connected to the main circuit board into the printer engine 60 is also formed in the front surface of the engine housing 62.

Figure 8:
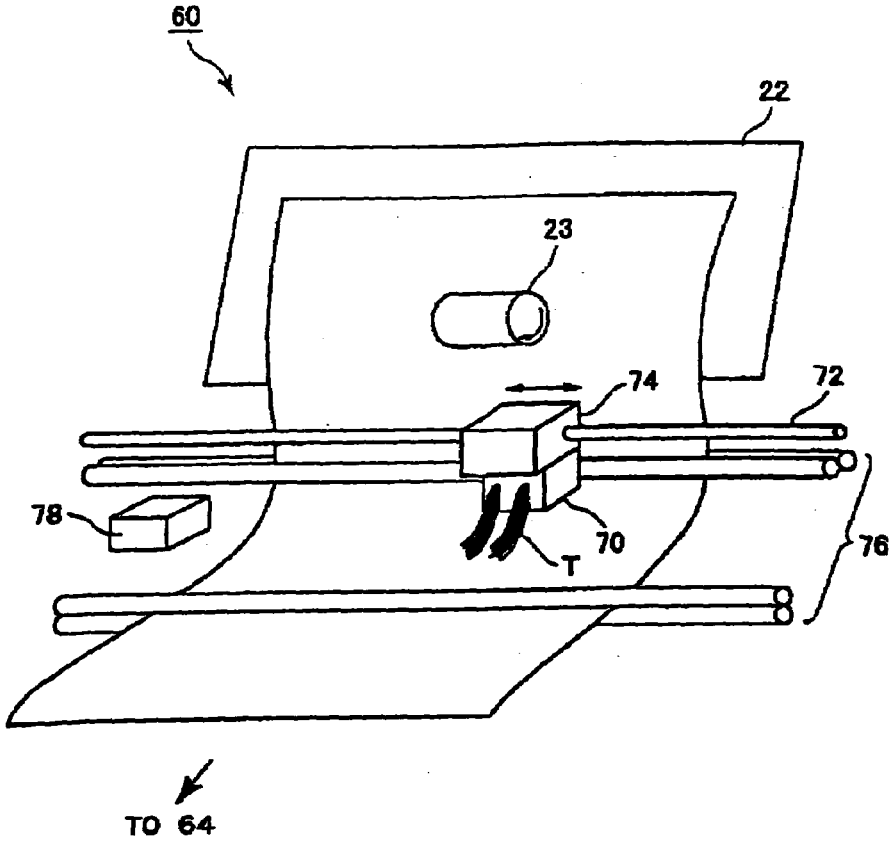
FIG. 8 is a schematic perspective view showing a configuration of a printer engine of an exemplary multifunction device.

As shown in FIG. 8, a sheet-transport mechanism 76 is provided to the inside to the engine housing 62. The sheet-transport mechanism 76 is made from plural pairs of rollers that transport sheets from the sheet-supply roller 23 along the sheet transport pathway to the engine-side sheet-discharge slot 64. A carriage scan shaft 72 extends above and in a direction that intersects with the sheet transport direction. A carriage 74 is provided on the carriage scan shaft 72 so as to be capable of reciprocal movement following the carriage scan shaft 72. A piezoelectric ink jet head 70 is mounted to the under surface of the carriage 74. Although not shown in the drawings, a group of nozzles is formed for each of the above-described plurality of ink colors. Each nozzle faces downward so it ejects ink downward onto the recording sheet. The four ink-supply tubes T (Tk, Tc, Ty, Tm) and cables are connected to the corresponding nozzle groups to supply the four colors of ink (black, cyan, yellow, and magenta) and drive signals to the piezoelectric ink jet head 70. The carriage 74 scans following the carriage scan shaft 72 and the piezoelectric ink jet head 70 and records in bands with a width that corresponds to the width of the nozzle groups. Each time one scan is completed, the sheet-transport mechanism 76 feeds the sheet by a distance that corresponds to the width of the recording band. A purge unit 78 is provided at a position that is above the carriage scan shaft 72 and that is shifted from the sheet transport pathway. Although not shown in the drawings, the purge unit 78 includes a well-known cap and pump. In certain situations, such as when the nozzles of the piezoelectric ink jet head 70 are clogged, the piezoelectric ink jet head 70 is transported to a position in confrontation with the purge unit 78 and a purge operation is performed wherein the cap covers the nozzles and the pump sucks ink from the nozzles through the cap.

Only the piezoelectric ink jet head 70 is mounted on the carriage 74. Ink from the ink cartridges 200 housed in the ink cartridge holding portion P is supplied to the piezoelectric ink jet head 70 through the tubes T. Also, a pressure head difference is developed between the piezoelectric ink jet head 70 and the ink cartridges 200 because the piezoelectric ink jet head 70 is disposed vertically above the ink cartridge holding portion P. Therefore, a negative pressure, that is, a back pressure operates on the ink in the nozzles of the piezoelectric ink jet head 70 that prevents ink (not shown) from dripping out from the nozzle in the piezoelectric ink jet head 70.

Figure 9:
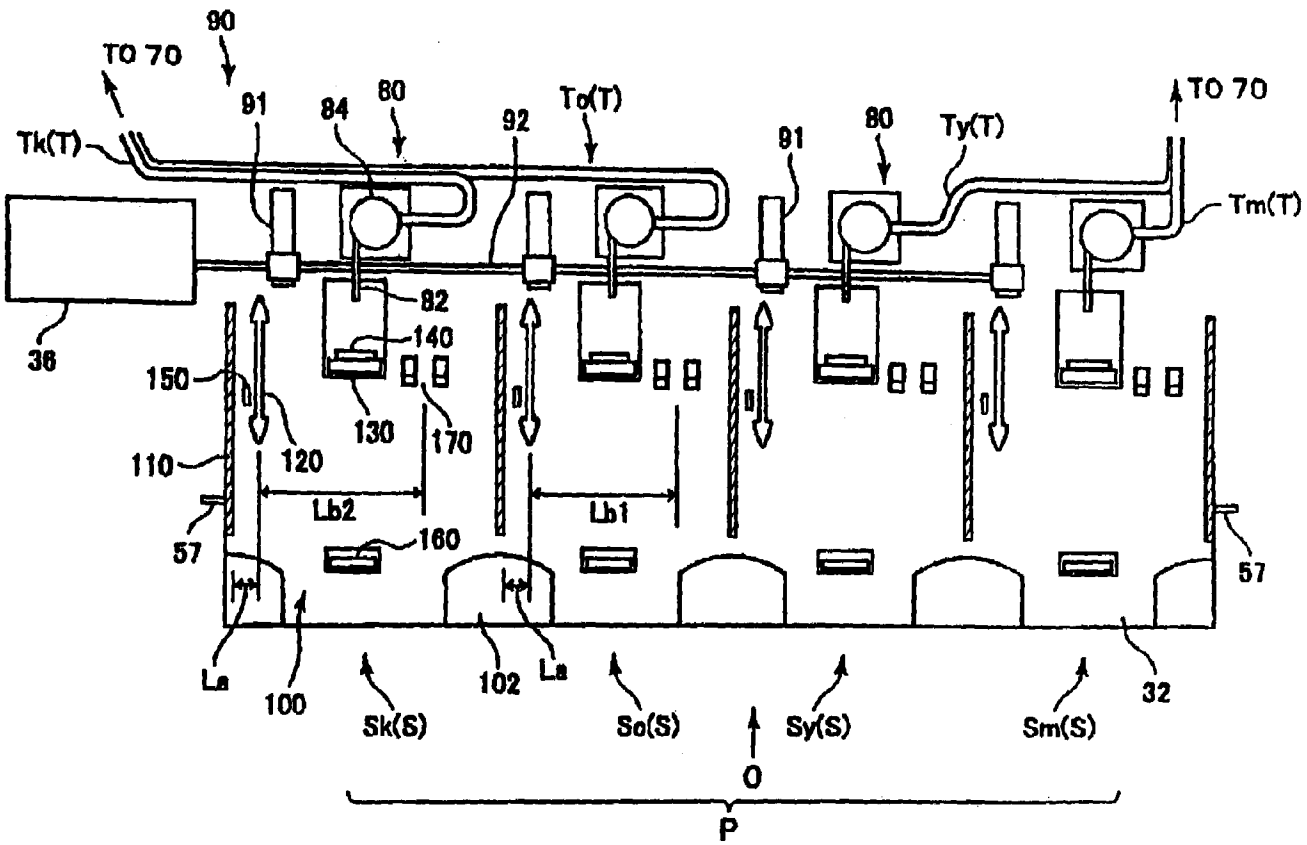
FIG. 9 is a plan view showing a configuration of an ink cartridge accommodation portion of an exemplary multifunction device.

As shown in FIG. 9, the ink supply mechanisms 80, the positive pressure application mechanism 90, and the cartridge-mounting mechanisms 100 have substantially the same configuration for each of the four ink cartridge-mounting portions S.

Figure 10:
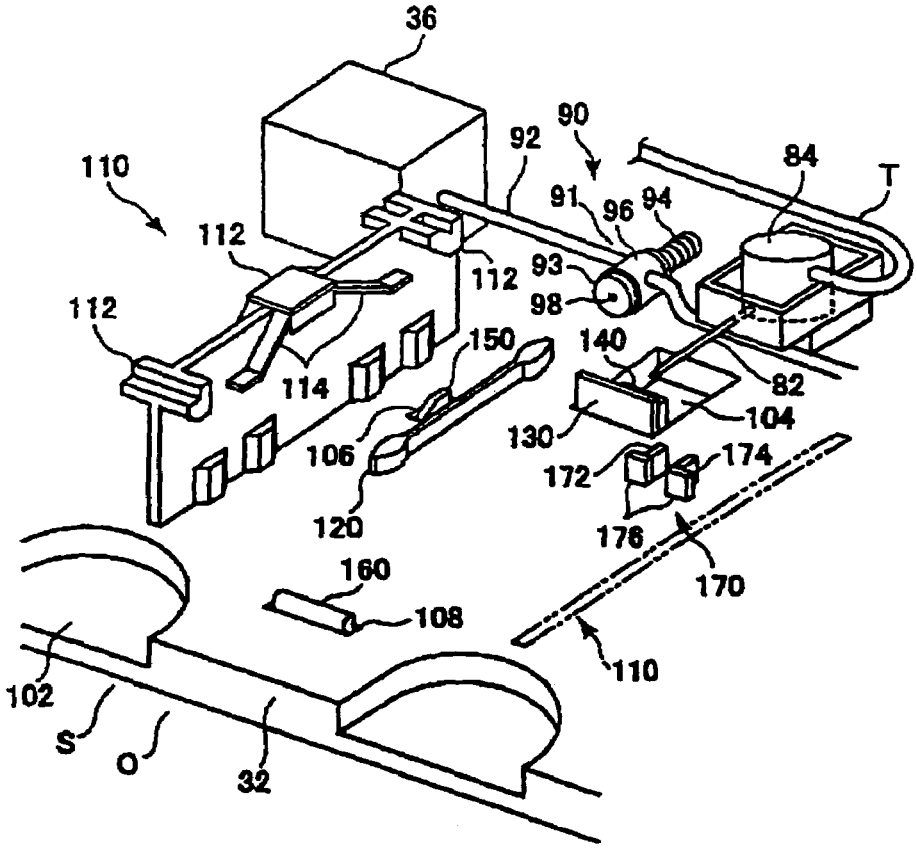
FIG. 10 is a perspective view showing a configuration of an ink cartridge-mounting portion in an ink cartridge accommodation portion of an exemplary multifunction device.

As shown in FIGS. 9 and 10, each of the ink supply mechanisms 80 is configured from a buffer tank 84 connected to an ink introducing hollow needle 82 and the ink-supply tube T. The ink introducing hollow needle 82 extends toward the front surface opening portion O. The hollow needle 82 is hollow and formed on the sides of its tip end with a pair of holes connected to the inside in the manner of a well-known hollow needle. When an ink cartridge 200 is mounted in the corresponding ink cartridge-mounting portion S, the ink introducing hollow needle 82 is inserted into the ink cartridge 200 so that ink is supplied to the buffer tank 84. The buffer tank 84 temporarily holds ink supplied by the ink introducing hollow needle 82 and filters foreign objects out from the ink. Ink that has been filtered in this manner is then supplied to the piezoelectric ink jet head 70 through the corresponding ink-supply tube T.

The positive pressure application mechanism 90 is for applying a positive air pressure to the ink in the ink cartridges 200. The positive pressure application mechanism 90 is configured from positive pressure application members 91 that are connected to the positive pressure pump 36. It should be noted that the total of four positive pressure application members 91 provided to the four ink cartridge-mounting portions S are directly connected to the positive pressure pump 36 through positive pressure application tubes 92. There is a relief valve (not shown) between the positive pressure pump 36 and the positive pressure application tubes 92. Drive of the positive pressure pump 36 forces air flow with substantially equal pressure from the four positive pressure application members 91 toward the ink cartridges 200 through the positive pressure application tubes 92.

As shown in FIG. 10, each of the positive pressure application members 91 is made from a ring-shaped resilient seal member 93 and a support member 96. The support member 96 supports the ring-shaped resilient seal member 93 while a spring 94 urges the ring-shaped resilient seal member 93 toward the front surface opening portion O. The ring-shaped resilient seal member 93 includes a centrally located positive pressure hole 98 in fluid connection with the positive pressure application tubes 92 from the positive pressure pump 36. The positive pressure hole 98 faces the front surface opening portion O.

The cartridge-mounting mechanisms 100 include the partition walls 110, the indentations 102 on the cartridge holding portion base wall 32, guide protrusion walls 120, needle protection plates 130, lock members 180 (FIG. 11) of the needle protection plates 130, lock releasing operation ribs 150, pull-out-lock protrusions 160, and residual ink detecting photo sensors 170.

The partition walls 110 are formed at either side of each ink cartridge-mounting portion S so as to protrude upward from the cartridge holding portion base wall 32 and so as to extend from the front surface opening portion O into the ink cartridge holding portion P. The partition walls 110 define the width of the ink cartridge-mounting portions S. It should be noted that the partition walls 110 positioned in between adjacent ink cartridge-mounting portions S also serve to partition the adjacent ink cartridge-mounting portions S.

The width of each of the ink cartridge-mounting portions S is the size suitable for the width of the corresponding ink cartridge 200 to enable the corresponding ink cartridge 200 to be mounted therein. As will be described later, the widths of the cyan (C) ink cartridge 200*c*, the yellow (Y) ink cartridge 200*y*, and the magenta (M) ink cartridge 200*m* are equivalent. The width of the black (K) ink cartridge 200*k*, the black ink of which is more frequency used during printing, is larger than the widths of the cyan (C) ink cartridge 200*c*, the yellow (Y) ink cartridge 200*y*, and the magenta (M) ink cartridge 200*m* in order to provide the black (K) ink cartridge 200*k* with a larger internal capacity. For this reason, the widths of cyan (C) ink cartridge-mounting portion Sc, the yellow (Y) ink cartridge-mounting portion Sy, and the magenta (M) ink cartridge-mounting portion Sm are equivalent and the width of the black (K) ink cartridge-mounting portion Sk is larger than the width of the other ink cartridge-mounting portions.

The cartridge holding portion base wall 32 of the ink cartridge-mounting portions S extends away from the hollow needle 82 farther forward than the front surface opening portion O. Because the ceiling surface, that is, the cartridge holding cover portion 44, has a length to the position of the front surface opening portion O, the portion of the cartridge holding portion base wall 32 that extends farther forward than the cartridge holding portion base wall 32 is opened from above while the front surface cover 50 is in an open condition and serves to guide the ink cartridges 200 toward the front surface opening portion O while the ink cartridges 200 are being mounted.

All of the cartridge-mounting mechanisms 100 have substantially the same configuration, so configuration of a representative cartridge-mounting mechanism 100 will be described with reference to FIG. 10 in order to facilitate explanation. The needle protection plate 130, the residual ink detecting photo sensor 170, the lock releasing operation rib 150, and the pull-out-lock protrusion 160 are positioned in this order from the side of the ink introducing hollow needle 82 to the front of the ink introducing hollow needle 82 with respect to the lengthwise extending axis of the ink introducing hollow needle 82. The guide protrusion wall 120, the lock releasing operation rib 150, and the residual ink detecting photo sensor 170 sandwich the lengthwise extending axis of the ink introducing hollow needle 82, wherein the guide protrusion wall 120 and the lock releasing operation rib 150 are on one widthwise side and the residual ink detecting photo sensor 170 is on the other widthwise side. The guide protrusion wall 120 extends in the front-rear direction. The lock releasing operation rib 150 is positioned between the front end and the rear end of the guide protrusion wall 120 in the front-rear direction. The needle protection plate 130 is between the front end and the rear end of the guide protrusion wall 120 in the front-rear direction and is positioned further to the rear than the lock releasing operation rib 150. The residual ink detecting photo sensor 170 is also between the front end and the deep end of the guide protrusion walls 120 in the front-rear direction and is positioned deeper in than the lock releasing operation rib 150.

Referring to FIG. 9, the guide protrusion wall 120 and nearest partition wall 110 are separated by same distance La in the left-right direction in all of the cartridge-mounting portions Sc, Sy, Sm, and Sk. Further, the guide protrusion wall 120 and the residual ink detecting photo sensor 170 are separated by the same distance Lb1 in the cyan (C) ink cartridge-mounting portion Sc, the yellow (Y) ink cartridge-mounting portion Sy, and the magenta (M) ink cartridge in the left-right direction. However, the guide protrusion wall 120 and the residual ink detecting photo sensor 170 are separated by a larger distance Lb2 in the black (K) ink cartridge-mounting portion Sk than the guide-sensor intervening distance Lb1 for the other ink cartridge-mounting portions.

Returning to FIG. 6, the partition walls 110 extend upward from the cartridge holding portion base wall 32 to the under surface of the cover 40. As shown more clearly in FIG. 10, three enlarged portions 112 are formed at the upper portion of each partition wall 110. As can be seen in FIG. 112, the enlarged portions 112 protrude away from the cartridge holding cover portion 44 toward the cartridge holding portion base wall 32. The enlarged portions 112 regulate vertical tilt and position of the ink cartridge after the ink cartridge 200 is inserted. The enlarged portion 112 at the front surface opening portion O side end of each partition wall 110 is formed at the lower side with a taper shape for facilitating insertion of the ink cartridge. The enlarged portion 112 formed at the front-rear center of each partition wall 110 includes a spring 114 for urging the ink cartridge 200 downward and regulating vertical movement of the inserted ink cartridge 200.

Again using the representative example of FIG. 10, the guide protrusion wall 120 protrudes upward from the cartridge holding portion base wall 32 at a position adjacent to the lock releasing operation rib 150. The distance La between the guide protrusion walls 120 and the adjacent partition walls 110 is sufficiently smaller than the thickness of the average user's finger to prevent the user from contacting the lock releasing operation rib 150 and releasing the locked condition of the needle protection plates 130. Also, the guide protrusion wall 120 serves to guide the ink cartridge 200 inserted from the front surface opening portion O side to the ink cartridge-mounting portions S in the front-rear direction while positioning the ink cartridge 200 in the left-right direction. The guide protrusion wall 120 is formed with its front- and rear-side ends thicker than its center so that the guide protrusion wall 120 contacts the ink cartridge 200 substantially at two points that correspond to the thick portions. Positioning in the left-right direction can be precisely performed. It should be noted that guiding and positioning of the ink cartridge 200 can also be performed by the partition walls 110 or could be performed by cooperative operation of the partition walls 110 and the guide protrusion wall 120.

The residual ink detecting photo sensor 170 is made from an infrared light emitting portion 172 and an infrared light receiving portion 174 and is for detecting the amount of residual ink in the ink cartridge 200. The residual ink detecting photo sensor 170 is connected to a circuit board disposed beneath the cartridge holding portion base wall 32. The residual ink detecting photo sensor 170 protrudes above the cartridge holding portion base wall 32 from the circuit board. Sensor guards 176, which are for protecting the infrared light emitting portion 172 and the infrared light receiving portion 174 from the ink cartridge 200 when the ink cartridge 200 is inserted, protrude upward from the cartridge holding portion base wall 32 from the sides of the infrared light emitting portion 172 and the infrared light receiving portion 174 that are nearer to the front surface opening portion O. The sensor guards 176 are formed with rounded surfaces at the portion of their confronting faces that are nearest the front surface opening portion O.

Figure 11:
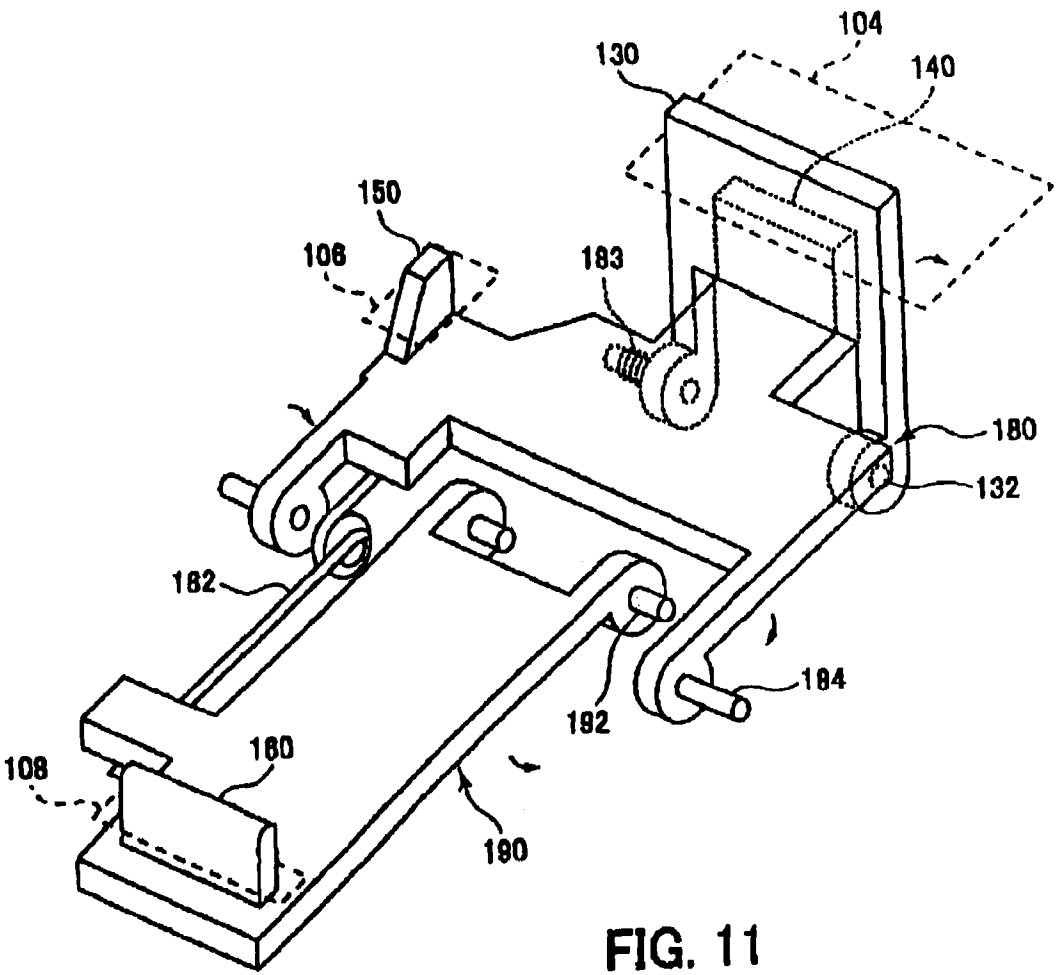
FIG. 11 is a perspective view showing a configuration of a mechanism provided below a floor surface of an ink cartridge-mounting portion of an exemplary multifunction device for protecting needles, maintaining a condition in which needles are protected, and preventing ink cartridges from falling out of the ink cartridge-mounting portion.

The needle protection plate 130 is positioned at the front surface opening portion O side of the ink introducing hollow needle 82 with a space between itself and the ink introducing hollow needle 82. The needle protection plate 130 is for covering the tip of the ink introducing hollow needle 82 from the side confronting the front surface opening portion O. FIG. 11 shows configuration relating to the needle protection plate 130, the lock releasing operation rib 150, and the pull-out-lock protrusion 160 of the representative cartridge-mounting mechanism 100 of FIG. 10. The needle protection plate 130 is supported below the cartridge holding portion base wall 32 so as to be pivotable around a needle protection pivot shaft 132 that intersects the front-rear direction. The needle protection plate 130 is movable between a cover position and a release position. In the cover position, the needle protection plate 130 protrudes from an opening 104 formed in the cartridge holding portion base wall 32 to above the cartridge holding portion base wall 32. In the release position, the needle protection plate 130 is retracted within the opening 104. The needle protection plate 130 is constantly urged by a spring 183 toward the cover position. The lock member 180 is supported pivotable around a shaft 184 below the cartridge holding portion base wall 32. A pressing plate 140 rises up from one end of the lock member 180. Operation of the spring 182 moves the lock member 180 in a direction to move the pressing plate 140 into confrontation with the ink introducing hollow needle 82 side surface of the needle protection plate 130. The lock member 180 integrally includes the lock releasing operation rib 150 in between the shaft 184 and the pressing plate 140. The urging force of the spring 182 protrudes the lock releasing operation rib 150 from an opening 106 formed in the cartridge holding portion base wall 32 between the guide protrusion walls 120 and the partition walls 110.

In this condition, when the ink cartridge 200 is inserted from the front surface opening portion O, as will be described later the lower side of the ink cartridge 200 first presses the lock releasing operation rib 150 so that the lock member 180 pivots and the pressing plate 140 retracts downward from the back surface of the needle protection plate 130. When the ink cartridge 200 is moved further in the front-rear direction of the mounting portion S, the front surface of the ink cartridge 200 presses the needle protection plate 130. However, because the pressing plate 140 was retracted below the back surface of the needle protection plate 130, the needle protection plate 130 is not block from pivoting and so drops into the opening 104 so that the ink cartridge 200 can connect with the ink introducing hollow needle 82.

In the reverse operation, that is, to remove the ink cartridge 200 from the ink cartridge-mounting portion S, the spring 183 moves the needle protection plates 130 upright at the position covering the ink introducing hollow needle 82. Then, the lower surface of the ink cartridge 200 separates away from the lock releasing operation ribs 150 and the spring 182 returns the pressing plate 140 to the back surface of the needle protection plate 130.

Unless the lock releasing operation rib 150 is being pressed down, the back surface of the needle protection plate 130 will abut the pressing plate 140 so the ink introducing hollow needle 82 will not be exposed to the front surface opening portion O, even if an external force is applied from the front surface opening portion O side of the needle protection plate 130.

A leak preventing lock member 190 is provided for applying resistance against the urging force by the spring 94 of the positive pressure application members 91, which urges the mounted ink cartridge 200 in a direction to pull out of the ink cartridge-mounting portion S. The leak preventing lock member 190 includes the pull-out-lock protrusion 160, which is capable of protruding above the cartridge holding portion base wall 32 from an opening 108 formed in the cartridge holding portion base wall 32. The leak preventing lock member 190 is supported pivotable around a shaft 192 below the cartridge holding portion base wall 32. The leak preventing lock member 190 is urged upward by the spring 182. Normally, the protrusion 160 protrudes upward above the cartridge holding portion base wall 32 from the opening 108 and fits in a leak preventing lock indentation 246 (FIG. 18) to be described later of the ink cartridges 200 that is in its mounted position. However, as will be described later, when the ink cartridge 200 abuts the protrusion 160 by force generated when the ink cartridge 200 is attached or detached, the leak preventing lock member 190 pivots around the shaft 192 so that the protrusion 160 retracts downward and the ink cartridge 200 can be attached or detached.

Figure 12:
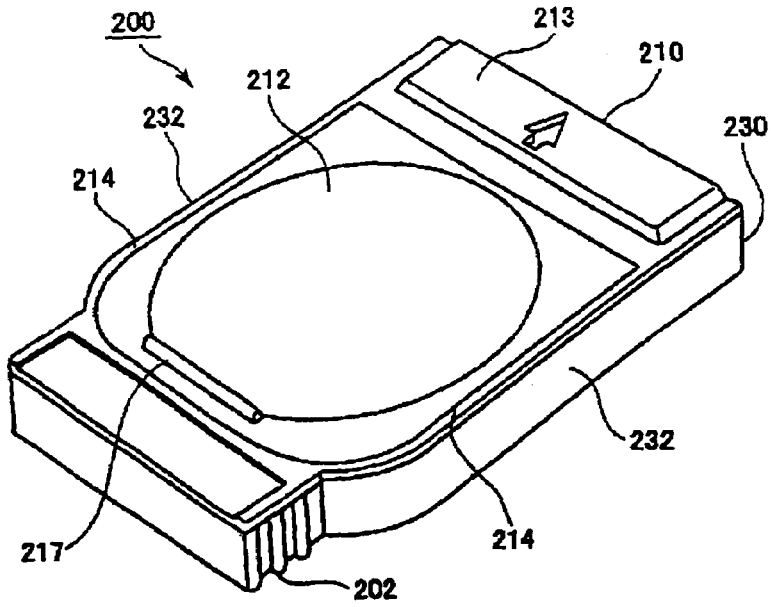
FIG. 12 is a perspective view of an exemplary ink cartridge from a rear end.

The exemplary cyan, yellow, magenta, and black ink cartridges 200 all have the shape shown in FIG. 12. That is, all are made from a main case 230 and a lid 210 made from a substantially transparent resin. Overall the ink cartridge 200 has a flat and substantially parallelepiped shape. It should be noted that the cyan, yellow, and magenta ink cartridges 200 (color ink cartridges) have substantially the same size. The black ink cartridge 200 has substantially the same length as the color ink cartridges 200. However, the width of the black ink cartridge is wider than that of the color ink cartridges.

An exemplary ink cartridge 200 is described, with reference to FIGS. 12 to 36. The main case 230 includes flat side walls 232 on both sides in the left-right direction. The distance between the side walls 232, that is, the width of the main case 230, corresponds to the distance between the partition walls 110 provided to both sides of the ink cartridge-mounting portion S.

The lid 210 has a substantially flat shape with a spherical outward curved portion 212, which is curved outward in a spherical shape, provided at its substantial center portion. A flat-shaped protrusion portion 213 is formed from a raised up front end of the lid 210 except at left and right ends. A flat portion 214 is formed at the left and right sides of the protrusion portion 213 and around the spherical outward curved portion 212 of the lid 210. The portion of the flat portion 214 positioned to the left and right of the protrusion portion 213 and of the spherical outward curved portion 212 extends in the lengthwise (front-rear) direction of the ink cartridges 200. When the ink cartridge 200 is inserted into the ink cartridge-mounting portion S, the front-rear extending portion of the flat portion 214 slides against the spring 114 in confrontation with the underside of the enlarged portions 112. The curved portion 212 and the protrusion portion 213 protrude in the direction of and are closer to the lower surface of the cartridge holding cover portion 44, that is, the ceiling surface, than are the lower surfaces of the enlarged portions 112, which are positioned on either side of the curved portion 212 and the protrusion portion 213. The curved portion 212 and the protrusion portion 213 extend higher toward the cartridge holding cover portion 44 than the flat portion 214. When the ink cartridge 200 is mounted in the recording device, the curved portion 212 and the protrusion portion 213 regulate height wise position of the ink cartridge 200 when the ink cartridge 200 is inserted through the front surface opening portion O.

The ink cartridge 200 is formed sufficiently longer than the length in the front-rear direction of the cartridge holding cover portion 44 so that the rear end portion protrudes from the cartridge holding cover portion 44 when the ink cartridge 200 is in a mounted condition in the mounting portion S. The rear end portion of the ink cartridge 200 is a grasping portion 202 that is slightly narrower width that the other areas. As shown in FIG. 6, a desired single ink cartridge 200 can be easily grasped and taken out when plural ink cartridges 200 are housed in the ink cartridge holding portion P. Contrarily, an ink cartridge 200 can be grasped and easily mounted even when an ink cartridge 200 is housed adjacent thereto in ink cartridge holding portion P. A rib 217 is formed near the rear end of the lid 210 so as to extend linearly in the left-right direction. Accordingly, by snagging his or her finger on the rib 217 and pulling the ink cartridge 200 forward, the user can pull the ink cartridge 200 out of the ink cartridge holding portion P using a single finger.

Figure 13:
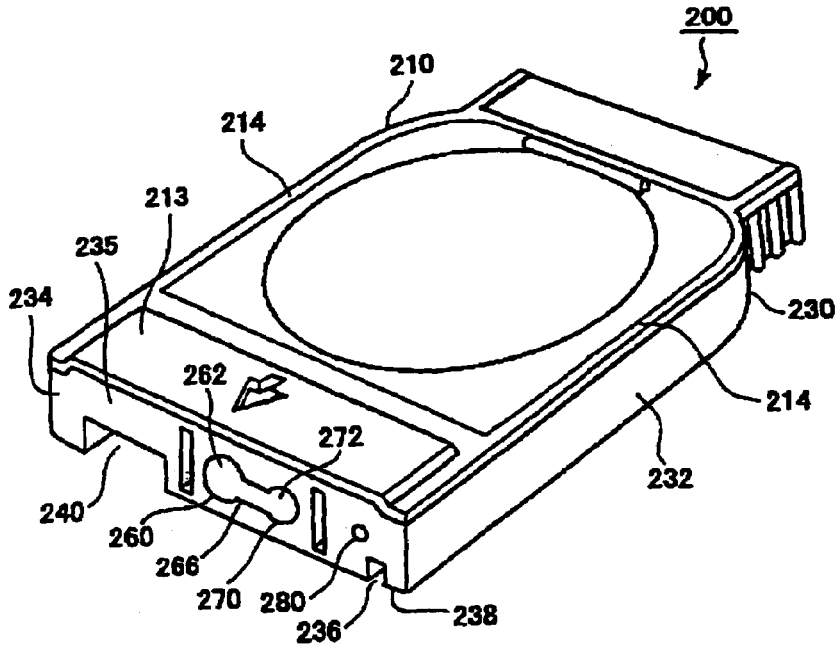
FIG. 13 is a perspective view of an exemplary ink cartridge from a front end.

As shown in FIG. 13, a protrusion portion 235 is formed on a front surface wall 234 of the main case 230. The protrusion portion 235 protrudes upward at the left-right central region of the front surface wall 234. An ink supply hole 260 is formed in the substantial center of the front surface wall 234. The ink supply hole 260 is a hole for supplying ink from an ink accommodation portion 300 (FIG. 14) provided in the main case 230 to outside. An ink supply rubber plug 262 (FIG. 36) is press-fit mounted in the ink supply hole 260. An ink injection hole 270 is opened next to the ink supply hole 260. An ink injection rubber plug 272 (FIG. 36) is press-fit mounted in the ink injection hole 270. Further, an atmosphere connection hole 280 is also opened in the front surface wall 234. The atmosphere connection hole 280 is a small-diameter, long and thin hole that is in fluid communication with the positive pressure hole 98 of the positive pressure application members 91 when the ink cartridge 200 is mounted in the ink cartridge-mounting portion S. Further, a guide groove 236 and a sensor accommodation groove 240 are formed in the front surface wall 234 and across the lower wall of the main case 230 so as to be open in the front surface and the lower surface. The guide groove 236 is an indented portion for engaging with the guide protrusion wall 120 when the ink cartridge 200 is mounted in the ink cartridge-mounting portion S. A lock release portion 238 is defined by the lower rear surface of the ink cartridge 200 that is between the guide groove 236 and the nearby side wall 232. The guide groove 236 and the lock release portion 238 are provided near the portions of the ink cartridge 200 that correspond to the enlarged portions 112 of the recording device. The lock release portion 238 functions to press the lock releasing operation rib 150 when the ink cartridge 200 is mounted in the ink cartridge-mounting portion S. The sensor accommodation groove 240 is an indented portion in a contour of the outer shape of the ink cartridge 200 and accommodates the residual ink detecting photo sensor 170 when the ink cartridge 200 is mounted in the ink cartridge-mounting portion S.

Figure 14:
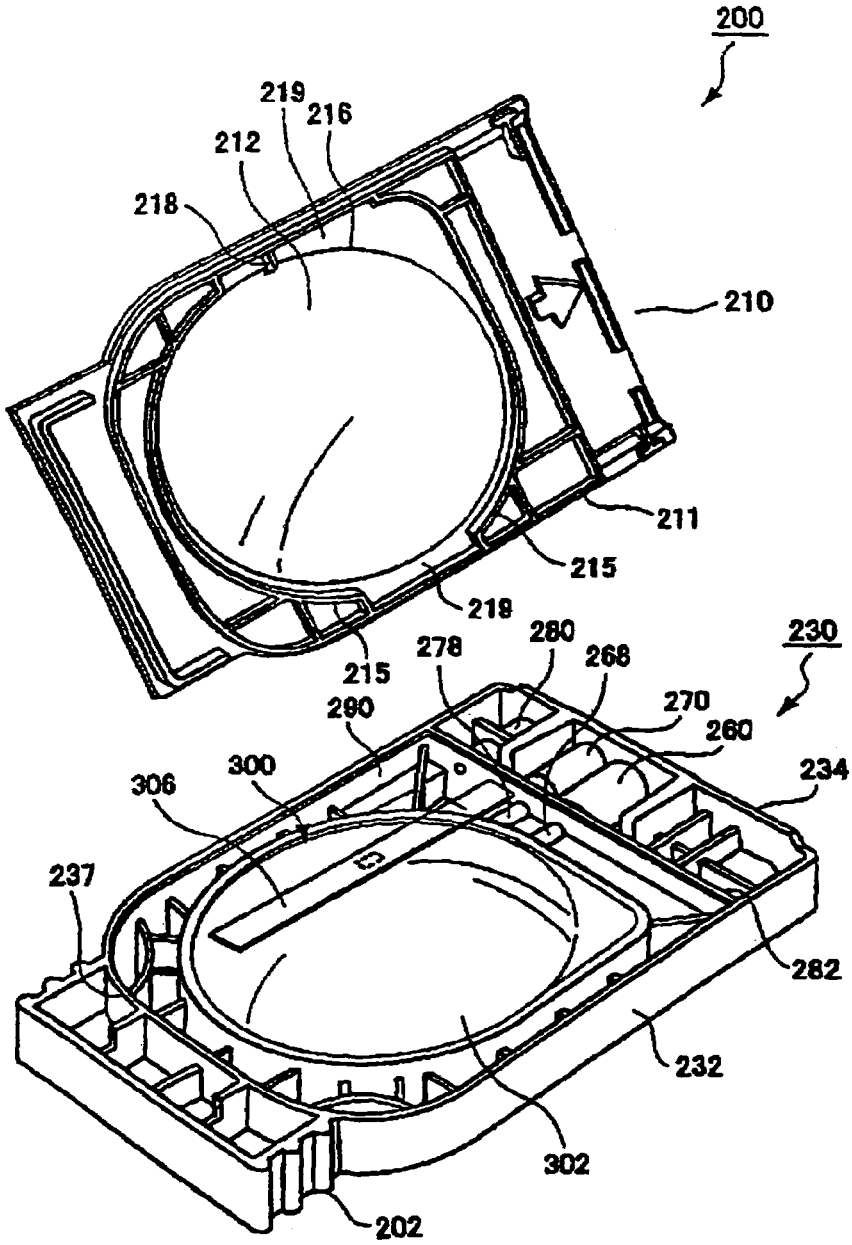
FIG. 14 is a perspective view of an exemplary ink cartridge with its lid separated from its main case.

As shown in FIG. 14, the main case 230 includes an ink accommodation portion 300 at its inside and is open at its upper side. Described in more detail, the main case 230 includes the front surface wall 234, the side walls 232, and a rear surface wall 237. The side walls 232 are on left and right sides of the main case 230. The side walls 232 are connected to the front surface wall 234 and the rear surface wall 237. The grasping portions 202 are formed to the rear of the rear surface wall 237. The ink accommodation portion 300 is surrounded by the front surface wall 234, the side walls 232, and the rear surface wall 237. The ink accommodation portion 300 is configured with a flexible film 302 at an ink-holding portion 310 (FIG. 15) to be described later. The ink-holding portion 310 is formed at the inside of the main case 230. The flexible film 302 is welded onto an opening peripheral edge 312 of the ink-holding portion 310. Ink is held in between the flexible film 302 and the ink-holding portion 310. While the ink cartridge 200 is filled with ink, the flexible film 302 expands upward into a curved surface. The ink supply hole 260 and the ink injection hole 270 are in fluid communication with the inside of the ink accommodation portion 300. Described in more detail, the ink supply hole 260 is in fluid communication with the ink accommodation portion 300 through a small-diameter ink supply connection pathway 268. The ink injection hole 270 is in fluid communication with the ink accommodation portion 300 by the through a small-diameter ink injection connection pathway 278 from the ink injection hole 270.

A substantially rectangular plate shaped tension plate 306 is provided on the flexible film 302 so that its lengthwise direction extends in parallel with the lengthwise (front-rear) direction of the ink cartridge 200. The tension plate 306 is adhered at its lengthwise center portion to the substantial center portion of the flexible film 302 by two-sided adhesive tape.

It should be noted that the lengthwise direction cross sectional shape (FIG. 21) of the case body is the same whether for black or color ink cartridges. Because the tension plate 306 is adhered in the lengthwise direction, an equal tension can be applied by preparing and adhering tension plates 306 with the same length for all color ink cartridges. The length of the tension plate 306 is formed slightly shorter than the dimension of the ink accommodation portion 300 in the lengthwise direction. The material of the tension plate is a film made from resin such as PET film. It should be noted that detailed operation of the tension plate 306 will be described later.

An atmosphere chamber 290 in fluid communication with the atmosphere connection hole 280 is formed in the periphery of the ink accommodation portion 300. Described in more detail, a partition wall 282 is formed at the rear side of the front surface wall 234. The partition wall 282 connects the side walls 232. Also, an outside protrusion wall 211 is formed from the lid 210. The outside protrusion wall 211 is for coupling with the partition wall 282, the side walls 232, and the rear surface wall 237 of the main case 230. When the lid 210 is attached to the main case 230 and the outside protrusion wall 211 is coupled with the partition wall 282, the side walls 232, and the rear surface wall 237, then the atmosphere chamber 290 will be encompassed by the partition wall 282, the side walls 232, and the rear surface wall 237 and moreover defines a region (covered by the lid 210) that surrounds the ink accommodation portion 300. The atmosphere chamber 290 is in a substantially sealed condition in communication with the outside only through the atmosphere connection hole 280. Here, the atmosphere connection hole 280 is a through hole that extends between the front surface wall 234 and the partition wall 282 and that is opened to the front surface wall 234 and the partition wall 282. Also, the ink supply connection pathway 268 and the ink injection connection pathway 278 penetrate through the partition wall 282 and are in fluid communication with the ink accommodation portion 300. When the lid 210 is attached on the main case 230 and covers the opening of the main case 230, the atmosphere chamber 290 is in fluid communication with atmosphere through only the atmosphere connection hole 280. By applying atmospheric or positive pressure to the atmosphere chamber 290, pressure can be applied to the flexible film 302 of the ink accommodation portion 300 from the external side of the ink accommodation portion 300 so that ink in the ink accommodation portion 300 can be supplied to outside of the ink cartridge 200 through the ink supply hole 260.

It should be noted that a plurality of ribs 292 (FIG. 15) are formed in the inside of the atmosphere chamber 290 so that the strength of the main case 230 is increased.

FIG. 14 shows the inner surface of the lid 210 that is attached to the ink cartridge 200. As is clear from the drawing, the lid 210 is substantially flat. The spherical outward curved portion 212 that is formed in the central portion of the lid 210 has a shape that encompasses the bulge of the flexible film 302. An annular portion of the flat portion 214 has a predetermined width that encompasses the spherical outward curved portion 212 and defines an ink accommodation periphery portion 216 to be described later. A groove-shaped notch 218 is formed so as to cut through the ink accommodation periphery portion 216. When the lid 210 is coupled to the main case 230, a space develops between the ink accommodation periphery portion 216 and the flexible film 302 that is adhered to the opening peripheral edge 312. When the ink cartridge is vacuum packaged in a manner to be described later, the lid 210 and the main case 230 flexibly deform toward each other. Even if the lid side of the ink accommodation periphery portion 216 comes into intimate contact with the flexible film 302, the groove-shaped notch 218 and protrusion wall notches 219 to be described later serve to bring the space between the spherical outward curved portion 212 and the flexible film 302 into fluid communication with the atmosphere chamber 290. Also, a protruding wall 215 is formed at the inner side of the outside protrusion wall 211, which is the outer side of the ink accommodation periphery portion 216. The protruding wall 215 extends and protrudes from the lid 210 so as to encompass the ink accommodation periphery portion 216. The protruding wall 215 is located so as to, when the lid 210 is mounted on the main case 230, encompass the outer periphery of the opening peripheral edge 312 to be described later with reference to FIG. 27. The protruding wall 215 is discontinuous at portions that follow the side walls 232 and that approach and connect to the outside protrusion wall 211. These discontinuous portions of the protruding wall 215 define the protrusion wall notches 219. One protrusion wall notch 219 is located adjacent the groove-shaped notch 218 and the other protrusion wall notch 219 is located opposite from the groove-shaped notch 218 in the left-right direction. The protrusion wall notches 219 also function to bring the space between the spherical outward curved portion 212 and the flexible film 302 into fluid communication with the atmosphere chamber 290 and to prevent positive pressure from the atmosphere connection hole 280 from being blocked by the protruding wall 215.

Figure 15:
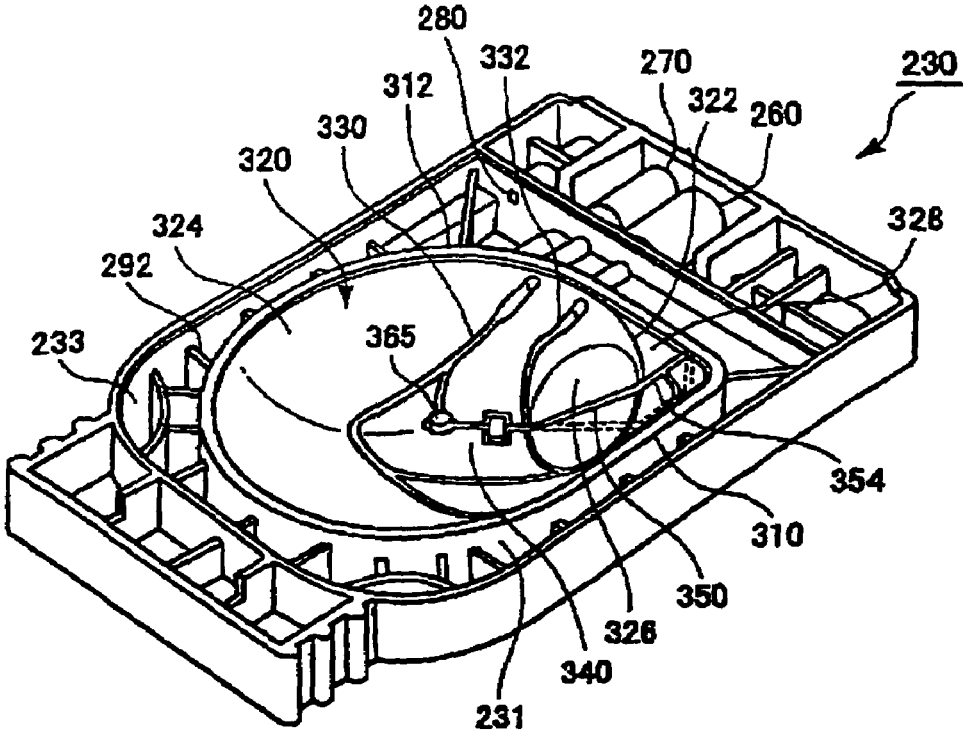
FIG. 15 is a perspective view showing a main case of an exemplary ink cartridge before a flexible film is attached thereto.

As shown in FIG. 15, the ink-holding portion 310 is encompassed by the opening peripheral edge 312 and includes an tub portion 320. The tub portion 320 is open at the upper surface. The opening peripheral edge 312 has a circular or ellipsoidal shape that bulges outward at one portion 328. The tub portion 320 includes a curved surface portion 324 that curves downward in a substantial curved shape from a circular (or ellipsoidal) shaped encompassing edge 322. The encompassing edge 322 is positioned at the same height as the opening peripheral edge 312. The substantial center of the curved surface portion 324 is the lowest position. The curved surface portion 324 includes a slanted surface portion 326 that is flat (not curved). The horizontally-extending flat shoulder portion 328, which bulges to the outside of the opening peripheral edge 312, is formed between the opening peripheral edge 312 and the circular (or ellipsoidal) encompassing edge 322. Because the flexible film 302 is attached to the opening peripheral edge 312 so as to cover the tub portion 320, ink is stored between the flexible film 302, the curved surface portion 324 including the slanted surface portion 326, and the flat shoulder portion 328.

The height of the flat shoulder portion 328 substantially matches the height of the opening peripheral edge 312 so that the flexible film 302 bulges only a small amount above the flat shoulder portion 328. With this configuration, while the lid 210 is mounted on the main case 230 the user can visually confirm the color of the ink from above the lid 210 by viewing the color of the ink accumulated between the flat shoulder portion 328 and the flexible film 302. Said differently, when the tub portion 320 is full of ink, the color of the ink in the tub portion 320 appears substantially black because the layer of ink is thick. However, the actual color of the ink can be viewed at the thin ink layer between the flat shoulder portion 328 and the flexible film 302.

The flexible film 302 is preformed into a curved shape that intimately contacts the inner surface of the ink-holding portion 310 when almost no ink is in the ink-holding portion 310. The method for manufacturing the flexible film 302 in this shape will be described later. Because the flexible film 302 is shaped in this manner, the flexible film can softly and gradually deform following the amount of ink from when ink completely fills between the flexible film 302 and the ink-holding portion 310 to when almost no ink is in the ink-holding portion 310. Almost no pressure operates on the ink from the flexible film itself, for example, by resilient contraction.

An air removing/ink supply groove 332 is formed in the base surface of the tub portion 320. The air removing/ink supply groove 332 is in fluid communication with an ink injection groove 330, which is in fluid communication with the ink injection hole 270 (the ink injection connection pathway 278), and the ink supply hole 260 (the ink supply connection pathway 268). A sensing mechanism 340 is further provided to the base surface of the tub portion 320. The sensing mechanism 340 is for detecting the residual amount of ink remaining on the tub portion 320.

Figure 16:
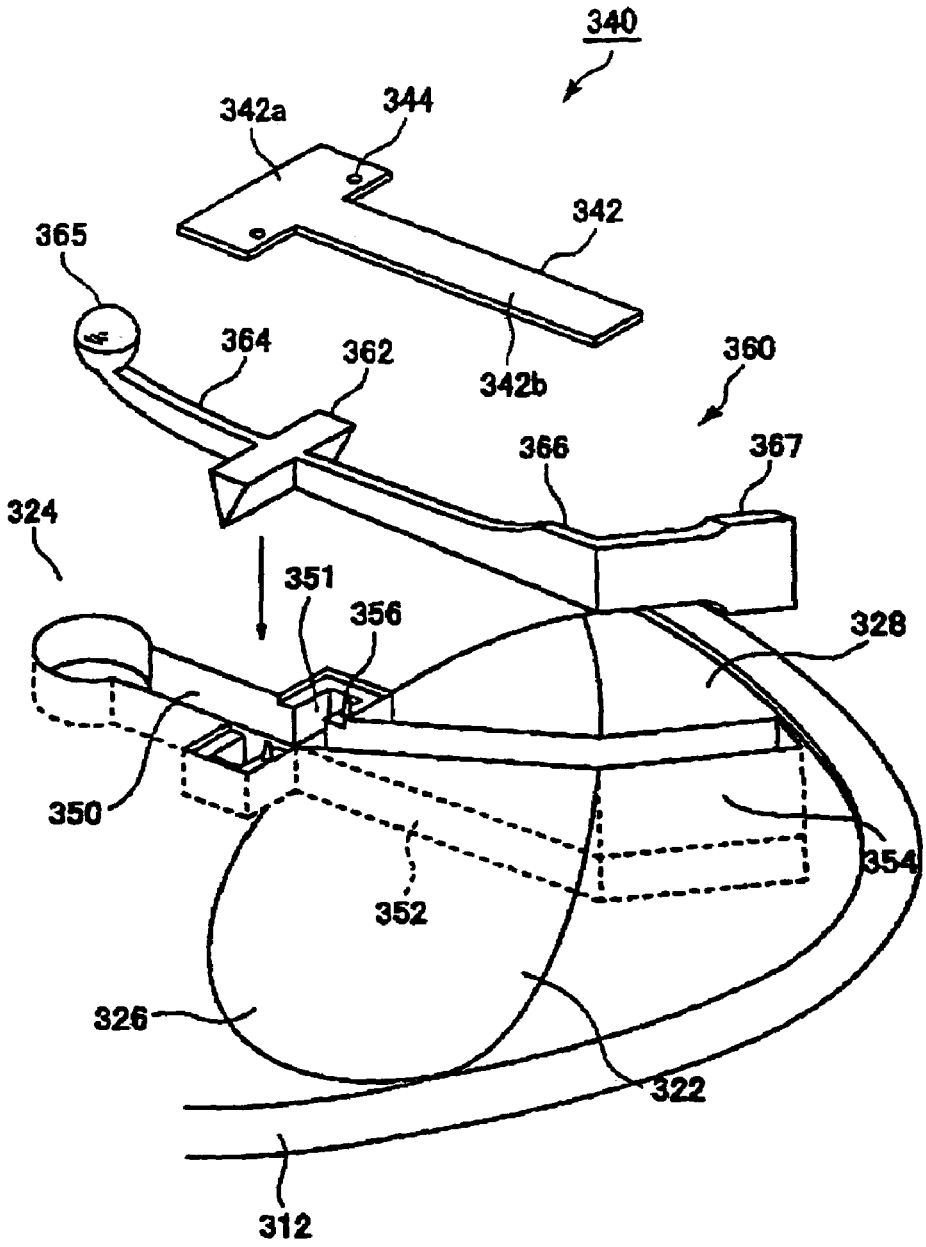
FIG. 16 is an exploded perspective view of a sensing mechanism provided in an indentation portion of a main case of an exemplary ink cartridge.
Figure 17:
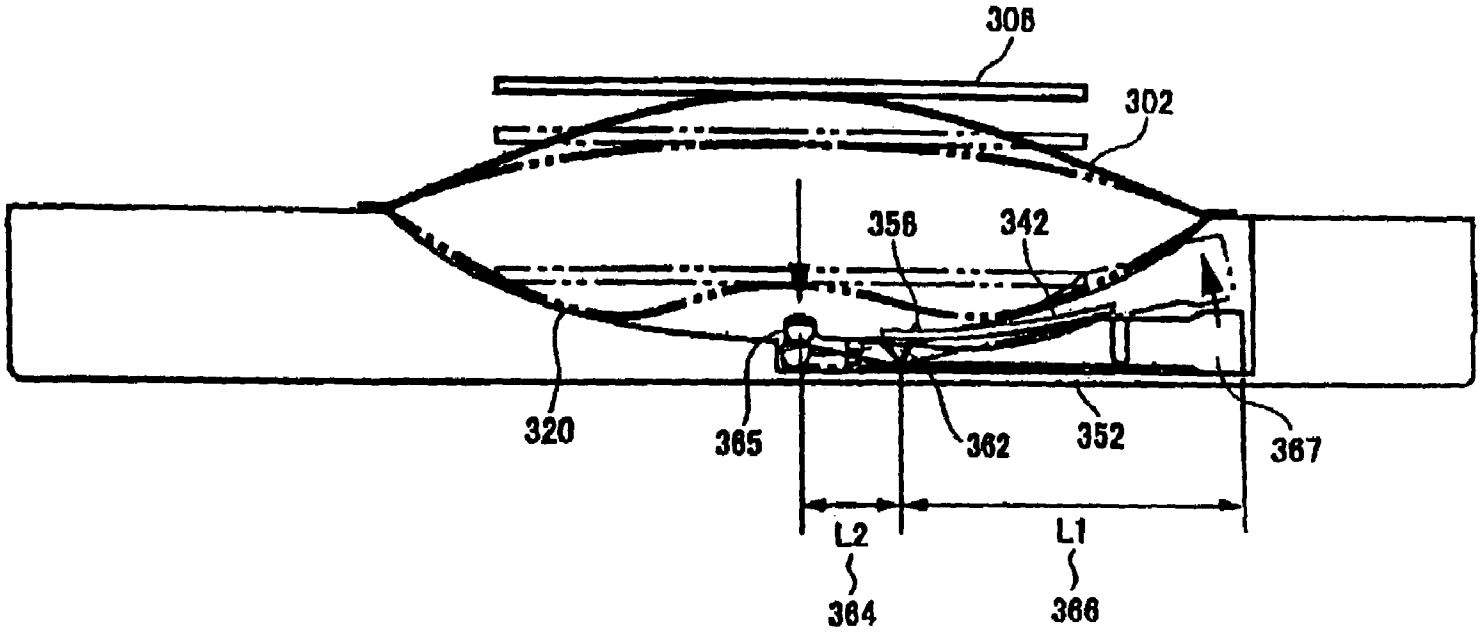
FIG. 17 is an operational diagram showing operation of the sensing mechanism in FIG. 16.

As shown in FIG. 16, the sensing mechanism 340 is made from a sensor lever accommodation groove 350, a sensor lever 360, and a suppressing film 342. The sensor lever 360 is disposed within the sensor lever accommodation groove 350. The suppressing film 342 has a T shape. The sensor lever accommodation groove 350 is opened in the base surface of the tub portion 320. The sensor lever accommodation groove 350 has a base surface 352 that follows the lower surface (FIG. 18) of the main case 230. The sensor lever accommodation groove 350 is formed so as to extend in a direction that is shifted 45 degrees with respect to the lengthwise (front-rear) direction of the case body from the central position of the curved surface portion 324 of the tub portion 320, to bend 45 degrees where it reaches the circular (or ellipsoidal) encompassing edge 322 of the tub portion 320, and then to extend parallel with the lengthwise direction of the case body. The portion of the sensor lever accommodation groove 350 that extends in parallel with the lengthwise direction of the case body is called the groove portion 354 and is open upward at the flat shoulder portion 328. In this way, the sensor lever accommodation groove 350 is open so as to extend in a direction shifted 45 degrees from the lengthwise direction of the case body at positions from the center portion of the curved surface portion 324 of the tub portion 320 to the slanted surface portion 326 and is open so as to extend parallel with the lengthwise direction of the case body at the upper surface of the flat shoulder portion 328. The depth of the sensor lever accommodation groove 350 is substantially fixed at the curved surface portion 324, rapidly increases at the slanted surface portion 326, and again is substantially fixed at the flat shoulder portion 328. The groove portion 354 of the sensor lever accommodation groove 350 extends outside of the tub portion 320, follows the wall that protrudes to the inside of the sensor accommodation groove 240 and reaches the inside of the sensor accommodation groove 240, thereby forming a protrusion portion 372 shown in FIG. 18. Also, the sensor lever accommodation groove 350 has a groove 351 that intersects the lengthwise direction.

The sensor lever 360 has a specific gravity that is higher than the specific gravity of ink and is formed from a black colored resin that can block infrared light. The sensor lever 360 is disposed within the sensor lever accommodation groove 350. The sensor lever 360 is an elongated plate-shaped member having a pivot fulcrum portion 362, an operation arm portion 364, and a sensing arm portion 366. The pivot fulcrum portion 362 has the shape of a triangular prism. The operation arm portion 364 and the sensing arm portion 366 extend from on opposite sides of the pivot fulcrum portion 362. A semispherical pivot 365 (an ink residual amount detection point) is provided at the end portion of the operation arm portion 364. The sensor lever 360 is disposed within the sensor lever accommodation groove 350 so that the semispherical pivot 365 is disposed in the center position of the curved surface portion 324 of the tub portion 320. As a result, the semispherical pivot 365 is disposed at the lowest position of the curved surface portion 324. The sensing arm portion 366 is bent at a 45 degree angle near its end, thereby forming a bent end portion 367, which is positioned in the groove portion 354 of the sensor lever accommodation groove 350 (the portion opened at the flat shoulder portion 328) and functions as a sensing point. The pivot fulcrum portion 362 is disposed inside the intersecting groove 351 of the sensor lever accommodation groove 350. The apex of the triangular cross section of the pivot fulcrum portion 362 sinks in the ink so as to contact the bottom of the intersecting groove 351. As a result, the sensor lever 360 can pivot with the pivot fulcrum portion 362 as a fulcrum. Here, the weight of the sensing arm portion 366 is greater than the weight of the operation arm portion 364. In this example, the weight of the sensing arm portion 366 is five times or greater than the weight of the operation arm portion 364. For this reason, when sufficient ink remains, the sensing point 367 of the sensor lever 360 is positioned on the base surface 352 of the sensor lever accommodation groove 350 as indicated by solid line in FIG. 17. The semispherical pivot 365 (ink residual amount detection point) ink floats up from the base surface 352 and protrudes over the bottom of the tub portion 320. On the other hand, when ink is used up so that the flexible film 302 moves down toward the tub portion 320, the flexible film 302 presses down the semispherical pivot 365 (ink residual amount detection point) as shown by two-dot chain line in FIG. 17 so that the bent end portion 367 (sensing point) rises up. Because the sensor lever 360 is accommodated in this way in the sensor lever accommodation groove 350, which extends out from the tub portion 320 from under the tub portion 320, the sensor lever 360 does not block the flexible film 302 as the flexible film 302 deforms toward the tub portion 320. Therefore, detection of residual ink can be more reliably performed.

Also, the length L1 of the sensing arm portion 366 of the sensor lever 360 is longer than the length L2 of the operation arm portion 364. In this example, the length L1 of the sensing arm portion 366 is about four times the length L2 of the operation arm portion 364. Accordingly, even if the flexible film 302 lowers the semispherical pivot 365 (ink residual amount detection point) only a slight bit, the bent end portion 367 will rise up a great deal so that detection using a residual amount detection sensor 70 to be described later can be reliably performed.

The PET film tension plate 306 insures that the sensor lever 360 will reliably operate when almost no ink remains unused so that ink can be used up to the maximum. That is, if the tension plate 306 were not provided, then wrinkles could develop in one portion of the flexible film 302 as the flexible film 302 lowers down in association with reduction in ink and the flexible film 302 comes into intimate contact with the tub portion 320. In this case, the sensor lever 360 would be activated while ink remains between the wrinkled portion and the tub portion 320 so that ink is not used up.

However, only the center portion of the exemplary tension plate 306, that is, the portion that confronts the semispherical pivot 365 of the sensor lever 360, is connected to the center portion of the flexible film 302. The tension plate 306 rides on top of the bulging flexible film 302 as indicated by solid line in FIG. 17 when there is a great deal of ink in the tub portion 320. The tension plate 306 moves downward in association with reduction in ink. However, when a small amount of ink remains, both ends of the tension plate 306 abut against the inner peripheral surface of the tub portion 320 at a position lower than the opening peripheral edge 312 and higher than the lowest position of the tub portion 320 so that the tension plate 306 is restricted from moving further downward. As a result, although the peripheral portion of the flexible film 302 is in intimate contact following the inner peripheral surface of the tub portion 320, the center portion of the flexible film 302 is raised up because of the tension plate 306. At this time, the center portion of the raised-up flexible film 302 confronts the semispherical pivot 365 of the sensor lever 360 with a spaced opened up therebetween.

When the amount of ink is further reduced, the center portion of the flexible film 302 moves further down against the resilience of the tension plate 306. However, once the amount of ink in the tub portion is reduced to less than a predetermined amount range so that hardly any ink remains, the flexible film 302 overcomes the urging force of the tension plate 306 so that the center portion of the flexible film 302 presses against the semispherical pivot 365 of the sensor lever 360. At this time, the surface area of the peripheral portion of the flexible film 302 that is in intimate contact following the inner peripheral surface of the tub portion 320 gradually increases until the center of the flexible film 302 presses the sensor lever 360. That is, the tension plate 306 prevents wrinkles from being generated in the flexible film 302 along the way. Also, the flexible film 302 moves down while ink is collected in the center portion of the tub portion 320. Therefore, the sensor lever 360 will reliably operate in the condition wherein almost no ink remains unused.

The tension plate 306 need not be formed in the substantial rectangular shape described above, but could be triangular shaped, star shaped, circular shaped, or any optional shape as long as its shape enables opening a space between the flexible film 302 and the semispherical pivot 365 of the sensor lever 360 when downward movement is restricted as described above. Further, the outer peripheral portion of these different shaped members need not abut the inner peripheral surface of the tub portion 320, but could be placed on the opening peripheral edge 312.

It is desirable that the tension plate 306 have resilience and weight that does not apply influence to the pressure in the ink accommodation portion 300. However, pressure in the ink accommodation portion 300 can be adjusted by appropriately setting the resilience and weight. When there is a great deal of ink, the weight of the tension plate 306 applies positive pressure to the inside of the ink accommodation portion 300 because the tension plate 306 contacts only the center of the flexible film 302. When only a little ink remains, then the tension plate 306 functions as a beam to lift up the central portion of the flexible film 302. As a result, a negative pressure is applied to the ink accommodation portion 300. By adjusting the spring force (which relates to negative pressure when little ink remains), weight (which relates to positive pressure when a great deal of ink remains), and length (which relates to timing of the switch from application of positive pressure to the application of negative pressure) of the tension plate 306, a pressure that is appropriate with the consumption condition of ink can be applied to the ink accommodation portion 300.

The exemplary tension plate 306 is connected to the flexible film 302 so as to move following the flexible film 302 until only a slight amount of ink remains. On the other hand, the tension plate 306 is restricted from moving downward by the tub portion 320 when only a little ink remains and has resilience that urges the flexible film 302 in a direction away from the pivot (ink residual amount detection point) 365. The tension plate 306 allows portions of the flexible film 302 other than portions in confrontation with the pivot (ink residual amount detection point) 365 to follow the tub portion 320 at least after a slight amount of ink remains. However, the tension plate 306 urges portions of the flexible film 302 that confront the pivot (ink residual amount detection point) 365 in the direction away from the pivot (ink residual amount detection point) 365. Moreover, in association with reduction in ink after a slight amount of ink remains, the tension plate 306 approaches toward the pivot (ink residual amount detection point) 365 against the urging of the tension plate 306. In this way, ink can be reliably used up.

As shown in FIG. 16, the T-shaped suppressing film 342 is made from PET and is provided to press the sensor lever 360 downward into the sensor lever accommodation groove from above the sensor lever 360. Explained in more detail, the suppressing film 342 has an integral fixed portion 342*a* and resilient plate portion 342*b*. The resilient plate portion 342*b* presses the sensing arm portion 366. Of the sensor lever accommodation groove 350, the groove 351 which accommodates the pivot fulcrum portion 362 is formed with a level difference. A pair of holes 344 are formed in the fixed portion 342*a*. By fitting a pair of protrusions 356 into the pair of holes 344 and crushing the pair of protrusions 356, the fixed portion 342*a* can be fixed to the tub portion 320. By this, the pivot fulcrum portion 362 is supported in the intersecting groove 351 with a space opened between itself and the T-shaped suppressing film 342. The sensor lever 360 can be freely pivoted with the pivot fulcrum portion 362 as a fulcrum. The resilient plate portion 342*b* is disposed inserted inside the sensor lever accommodation groove 350 so as to extend toward to the sensing arm portion 366 from the fixed portion 342*a*. By this, the sensing arm portion 366 moves down by the resilient plate portion 342*b*. That is, because the semispherical pivot 365 is urged to protrude above the bottom surface of the tub portion 320, the semispherical pivot 365 can be reliably protruded above the base surface of the tub portion 320 even if the ink cartridge is turned upside down during transport of the ink cartridge. It should be noted that the resilience of the resilient plate portion 342*b* is large enough to block further rising movement of the sensing arm portion 366 in association with reduction in ink.

It should be noted that the portion of the sensor lever accommodation groove 350 that accommodates the sensing arm portion 366 is formed in the slanted surface portion 326. Because the slant of the slanted surface portion 326 is greater than the slant of the spherical surface portion, the sensing arm portion 366 can move upward by a sufficient amount without contacting and being obstructed by the flexible film 302.

Figure 18:
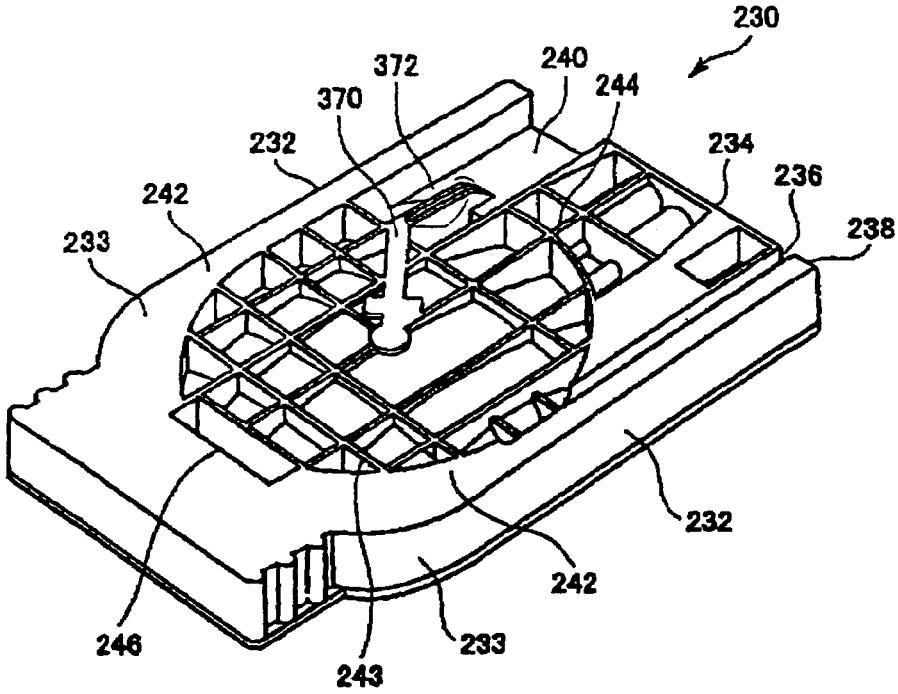
FIG. 18 is an underside view of a main case of an exemplary ink cartridge.
Figure 30:
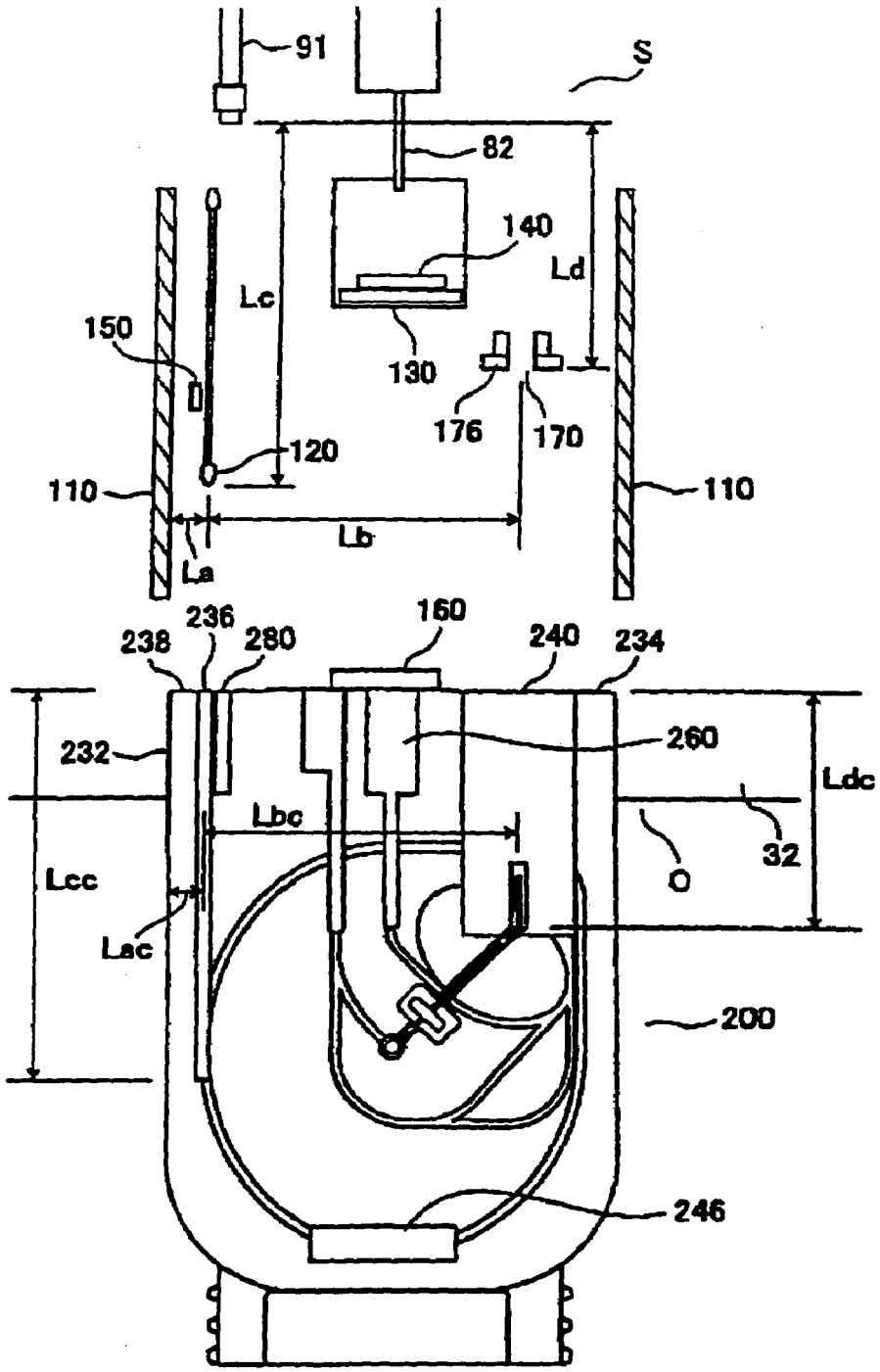
FIG. 30 is a plan view showing a configuration wherein a pull-out lock protrusion portion of an ink cartridge-mounting portion of an exemplary multifunction device is retracted by a front surface wall of an exemplary ink cartridge when the ink cartridge is inserted into a mounting portion opening of the ink cartridge-mounting portion.
Figure 35:
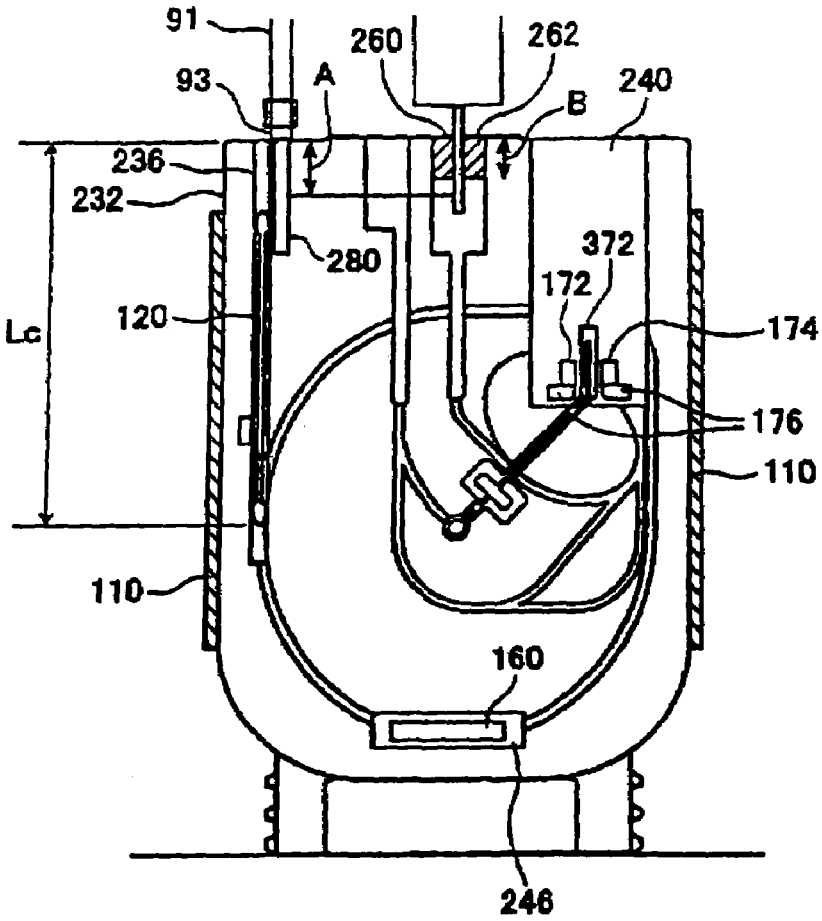
FIG. 35 is a plan view of the configuration shown in FIG. 34.
Figure 36:
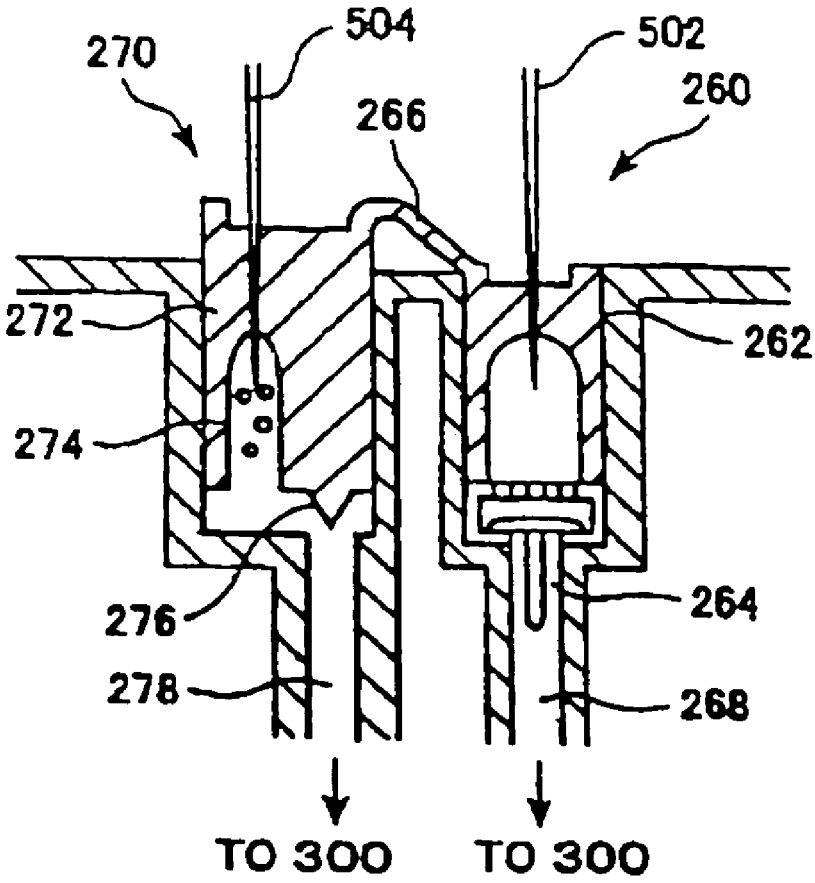
FIG. 36 is a cross-sectional view showing injection of ink into an exemplary ink cartridge.

As shown in FIG. 18, the lower surface of the main case 230 includes a flat smooth surface 242 capable of sliding with respect to the ink cartridge-mounting portions S. The flat smooth surface 242 is connected by the side walls 232 on both sides. The lower surface of the main case 230 is formed with the guide groove 236 and the sensor accommodation groove 240. As shown in FIG. 30, the distance Lac between the guide groove 236 and the side wall 232 that is nearest in the widthwise direction corresponds to the guide-partition wall intervening distance La in the ink cartridge-mounting portions S. As shown in FIG. 35, the guide groove 236 is formed merely with a length Lcc capable of accommodating the guide protrusion walls 120 in the lengthwise direction from the front surface wall 234. More particularly, the guide groove 236 is formed with a length that is at least as long or longer than a length Lc between the positive pressure application members 91 in the ink cartridge-mounting portions S and the side end of the front surface opening portion O of the guide protrusion walls 120. For this reason, the guide groove 236 can accommodate the guide protrusion wall 120 when the ink cartridge 200 is mounted in the ink cartridge-mounting portion S. As shown in FIG. 30, the distance Lbc between the guide groove 236 and the guide protrusion walls 120 corresponds to a guide-sensor interdistance in the ink cartridge-mounting portion S. As shown in FIG. 30, the sensor accommodation groove 240 is formed to merely a length Ldc that corresponds to the distance Ld between the positive pressure application members 91 in the lengthwise direction from the wall and the residual ink detecting photo sensor 170 so that the residual ink detecting photo sensor 170 can be accommodated when the ink cartridge 200 is mounted in the ink cartridge-mounting portion S.

A plurality of ribs 243 are formed in the lower surface of the main case 230. The ribs 243 are for supporting the strength of the tub portion 320 from the under surface of the tub portion 320. It should be noted that a bottom central axis rib 244 is formed in the central position in the widthwise direction of the main case 230 so as to extend in the lengthwise direction of the main case 230. The bottom central axis rib 244 continues to retract the pull-out-lock protrusion 160 (FIG. retrieval unit 10) to below the bottom surface when the ink cartridge 200 slides above the bottom surface of the ink cartridge-mounting portion S. The ink cartridge 200 will not pull out from the ink cartridge-mounting portion S because the pull-out-lock protrusion 160 engages with the leak preventing lock indentation 246 when the ink cartridge 200 is mounted in the ink cartridge-mounting portion S.

A sensor lever accommodation portion 370 forms the inner portion of the sensor lever accommodation groove 350. The sensor lever accommodation portion 370 is formed in the lower surface of the main case 230 so as to protrude out from the tub portion 320. The portion (sensor lever accommodation protrusion portion 372) of the sensor lever accommodation portion 370 that corresponds to the base surface 352 of the sensor lever accommodation groove 350 protrudes in the lengthwise direction at the widthwise center of the sensor accommodation groove 240. The rounded surfaces formed in the confronting faces of the sensor guards 176 facilitate insertion of the protrusion portion 372 in between the sensor guards 176 and the infrared light emitting portion 172 and the infrared light receiving portion 174 of the residual ink detecting photo sensor 170. As shown in FIG. 35, when the ink cartridge 200 is mounted in the ink cartridge-mounting portions S and the residual ink detecting photo sensor 170 is housed in the sensor accommodation groove 240, the sensing accommodation protrusion portion is positioned between the infrared light emitting portion 172 and the infrared light receiving portion 174 of the residual ink detecting photo sensor 170. The sensing arm end portion 367 (sensing point) of the sensor lever 360 positioned in the groove portion 354 in the protrusion portion 372 will as a result be positioned between the infrared light emitting portion 172 and the infrared light receiving portion 174. It should be noted that at least the protrusion portion 372 of the main case is made from a material that is transparent to infrared light.

Figure 19:
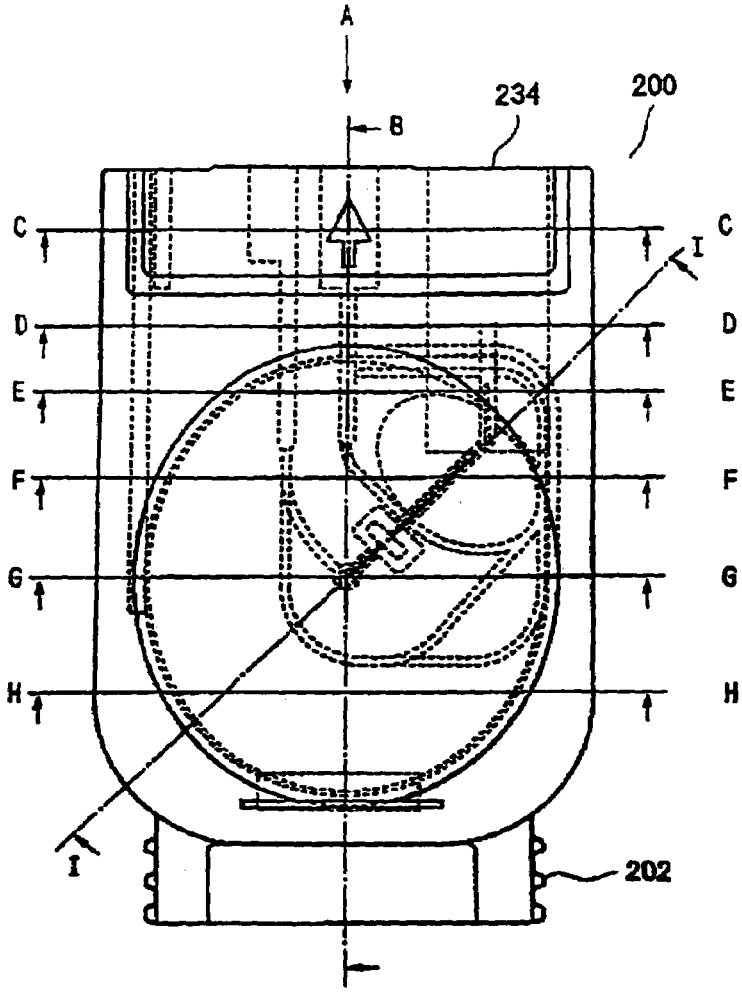
FIG. 19 is a plan view of an exemplary ink cartridge.
Figure 20:
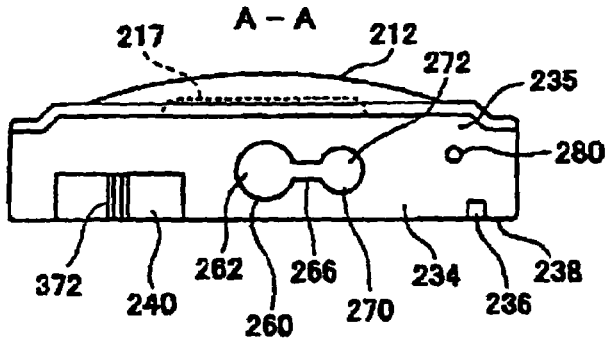
FIG. 20 is a view of the ink cartridge in FIG. 19 taken from arrow A.
Figure 21:
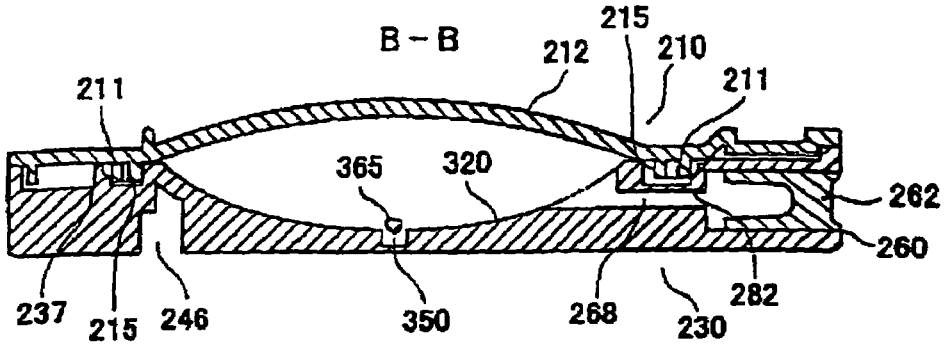
FIG. 21 is a cross-sectional view of the ink cartridge in FIG. 19 taken along line B-B.
Figure 22:
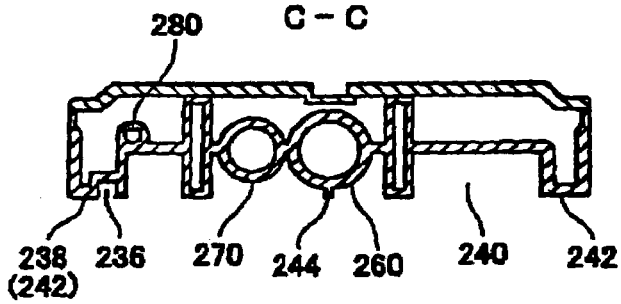
FIG. 22 is a cross-sectional view of the ink cartridge in FIG. 19 taken along line C-C.
Figure 23:
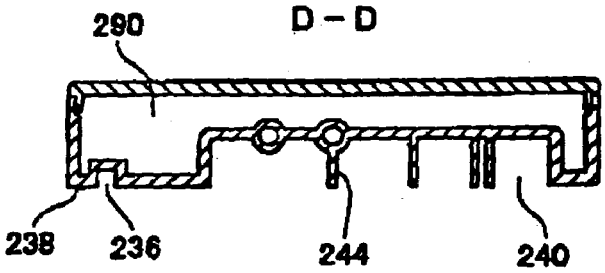
FIG. 23 is a cross-sectional view of the ink cartridge in FIG. 19 taken along line D-D.
Figure 24:
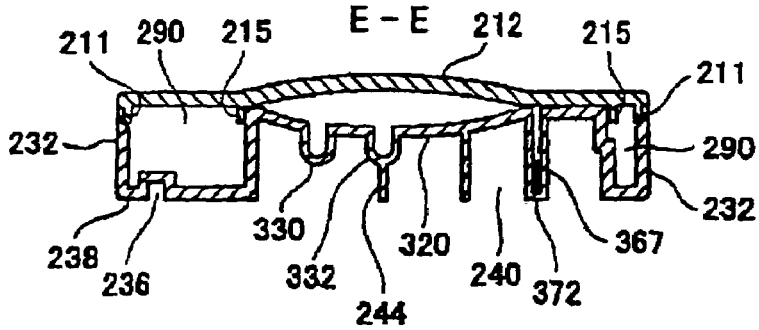
FIG. 24 is a cross-sectional view of the ink cartridge in FIG. 19 taken along line E-E.
Figure 25:
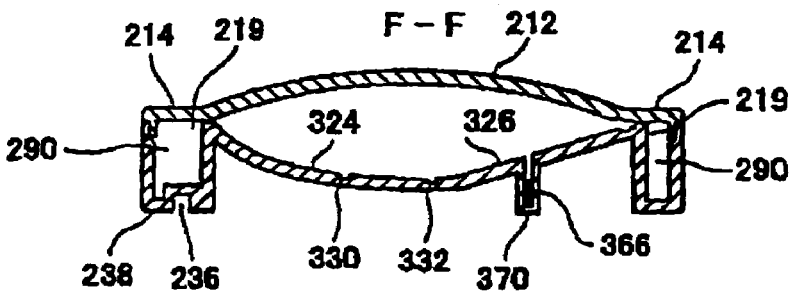
FIG. 25 is a cross-sectional view of the ink cartridge in FIG. 19 taken along line F-F.
Figure 26:
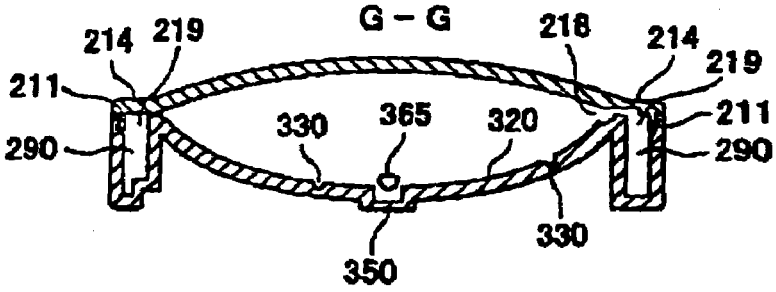
FIG. 26 is a cross-sectional view of the ink cartridge in FIG. 19 taken along line G-G.

FIG. 19 is a schematic plan view of an exemplary ink cartridge 200 having the configuration described above. FIG. 19 shows the situation wherein the lid 210 is mounted on the main case 230. Internal configuration is indicated by broken line. FIG. 20 is a view taken from the direction indicated by arrow A of FIG. 19, that is, is a frontal view showing the front surface of the ink cartridge 200. FIGS. 21 to 28 are cross-sectional views taken along lines B-B, C-C, D-D, E-E, F-F, G-G, H-H, and I-I, respectively. It should be noted that the flexible film 302 and the ribs (243, 292) are not indicated in the drawings for purposes of clarity. However, the bottom central axis rib 244 is indicated in some of the drawings.

Figure 27:
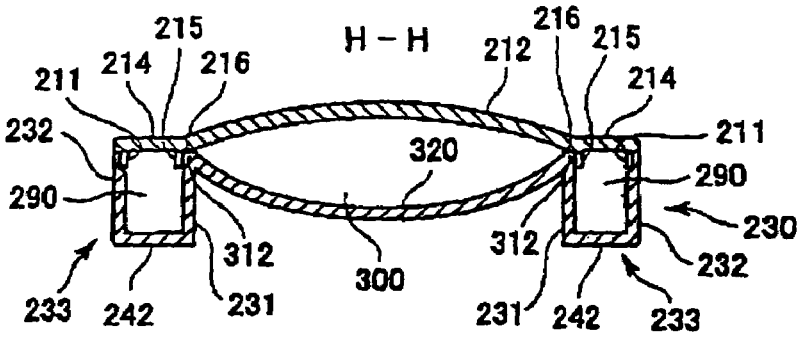
FIG. 27 is a cross-sectional view of the ink cartridge in FIG. 19 taken along line H-H.
Figure 28:
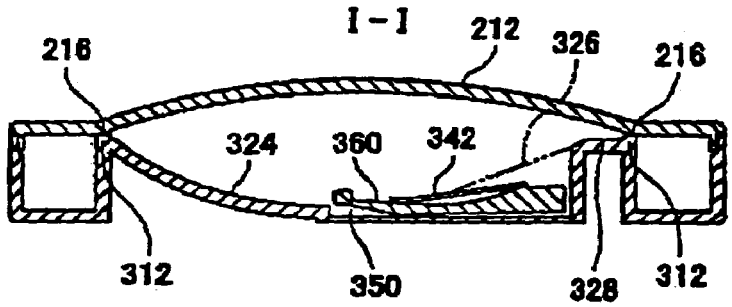
FIG. 28 is a cross-sectional view of the ink cartridge in FIG. 19 taken along line I-I.

As shown in FIGS. 15 and 27, a peripheral wall 231 is formed in the main case 230. The peripheral wall 231 extends from the opening peripheral edge 312, which defines the opening of the tub portion 320, integrally and continuously to the bottom surface side (in the depth direction of the tub portion 320) of the main case 230. A peripheral wall portion 233 is formed connected to the peripheral wall 231, the side walls 232, and the flat smooth surface 242. The peripheral wall portion 233 supports the tub portion 320 from the periphery of the tub portion 320. The peripheral wall 231 and the side walls 232 are separated by an interposed space and are connected together by a plurality of wall-like ribs 292. The flat portion 214 of the lid is coupled to the upper end of the peripheral wall portion 233 and serves as the outer peripheral portion in confrontation with the peripheral wall portion 233. Accordingly, the lower surface of the ink accommodation portion 300 is stabilized by the flat smooth surface 242 even when substantially spherically shaped. Attachment to and removal from the multifunction device 1 is simple. Because the flexible film 302 is adhered to the opening peripheral edge 312 and the lid 210 is connected to the upper end of the peripheral wall portion 233, ink can be reliably sealed in without the adhered portion of the flexible film 302 interfering with the lid 210. Because the peripheral wall portion 233 has a two-layered configuration made from the peripheral wall 231 and the side walls 232, and uses a configuration wherein the peripheral wall portion 233 and the peripheral wall 231 are connected by a plurality of ribs 292, the peripheral wall portion 233 can be prevented from deforming even though the ink cartridge 200 is subjected to vacuum pack processes to be described later. Further, as is clear from FIG. 18, the plurality of ribs 243 are formed so as to connect the lower surface of the tub portion 320 and the peripheral wall portion 233. For this reason, the ribs 243 prevent the tub portion 320 and peripheral wall portion 233 from deforming even if the ink cartridge 200 is subjected to the vacuum pack processes to be described later.

Figure 29:
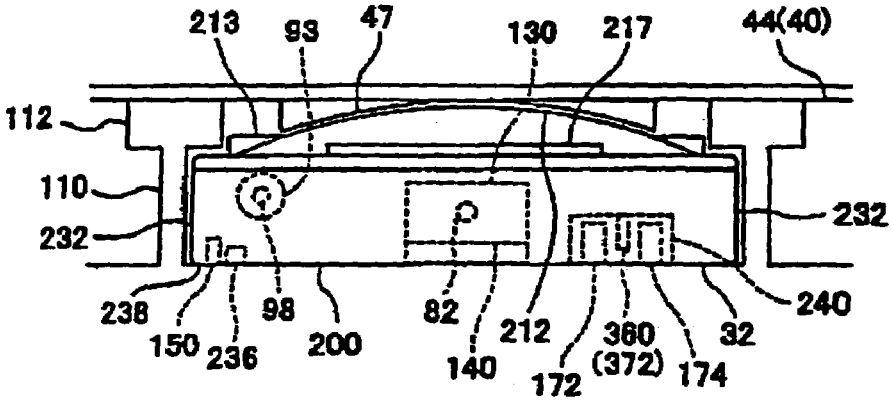
FIG. 29 is a view showing a relationship between bulging portions formed on partition walls of an ink cartridge-mounting portion of an exemplary multifunction device, a height of an exemplary ink cartridge, and a curved convex wall formed on a ceiling surface of the ink cartridge-mounting portion when the ink cartridge is inserted into a mounting portion opening.

The ink cartridge 200 having the above-described configuration has a flat lower surface. As shown in FIG. 29, the upper surface has a curved shape that is higher than the height at both ends (side walls 232) in the widthwise direction. The height at both ends in the widthwise direction (the height from the flat smooth surface 242 to the flat portion 214) is substantially the same as the distance between the base wall 32 and the enlarged portion 112 that is formed on the upper portion of the front surface opening portion O side end of the partition walls 110. Accordingly, the ink cartridge 200 can be inserted into the ink cartridge-mounting portions S. Also, the ink cartridge 200 can be prevented from being inserted upside down because the height of the spherical outward curved portion 212 and the protrusion portion 213 is higher than the height at both sides in the widthwise direction and because the curve-shaped protruding walls 47 of the ceiling surface of the mounting portions S is formed following the spherical outward curved portion 212 of the ink cartridge 200.

Because the lower surface of the main case 230 is smooth and formed with the peripheral wall portion 233, which extends in the lengthwise direction, the ink cartridge 200 can be mounted by merely inserting the ink cartridge 200 in the ink cartridge-mounting portion S and sliding it over the bottom surface while the pull-out-lock protrusion 160 is in a retracted condition. Moreover, the width of the ink cartridge 200 corresponds to the distance between the partition walls 110 of the ink cartridge-mounting portion S, the distance Lac between the guide groove 236 and the side walls 232 nearest in the widthwise direction corresponds to the guide-partition wall intervening distance La in the ink cartridge-mounting portion S, and the distance Lbc between the guide groove 236 and the sensor accommodation groove 240 corresponds to the inter-guide-sensor distance Lb in the ink cartridge-mounting portion S. Accordingly, by sliding the cartridge so that the guide groove 236 is guided by the guide protrusion walls 120 when the ink cartridge 200 is inserted into the ink cartridge-mounting portion S, the residual ink detecting photo sensor 170 is reliably housed in the sensor accommodation groove 240 and the bent end portion 367 in the sensor accommodation groove 240 is inserted between the infrared light emitting portion 172 and the infrared light receiving portion 174.

It should be noted that as indicated in FIGS. 9 and 30, the position of the end portion of the front surface opening portion O side of the guide protrusion walls 120 in the ink cartridge-mounting portion S is positioned at a position nearer the front surface opening portion O than the position of the end portion (sensor guard 176) of the front surface opening portion O side of the residual ink detecting photo sensor 170. The end of the guide groove 236 that is opposite from the front surface wall 234 is positioned farther from the front surface wall 234 than the end of the sensor accommodation groove 240 that is opposite from the front surface wall 234. Accordingly, when the ink cartridge 200 is inserted into the ink cartridge-mounting portion S and slid over the holding portion base wall 32, the sensor accommodation groove 240 reaches the residual ink detecting photo sensor 170 after the guide groove 236 accommodates the guide protrusion walls 120. Because the main case 230 reaches the residual ink detecting photo sensor 170 after being positioned in the widthwise direction of the ink cartridge 200 by engagement between guide protrusion walls 120 and the guide groove 236, the bent end portion 367 in the sensor accommodation groove 240 is inserted between the infrared light emitting portion 172 and the infrared light receiving portion 174.

Because the guide protrusion wall 120 is near the lock releasing operation rib 150 in the widthwise direction of the ink cartridge-mounting portion S and the guide groove 236 is near the lock release portion 238 in the widthwise direction of the ink cartridge 200, the lock release portion 238 reliably abuts against the lock releasing operation rib 150 and retracts it when the ink cartridge 200 is mounted in the ink cartridge-mounting portion S. Moreover, because the spring 114 member presses the ink cartridge 200 downward from above the partition walls 110 in the vicinity of the guide protrusion walls 120, operations for retracting the lock releasing operation rib 150 are more reliable.

As shown in FIGS. 29 and 35, the ink cartridge 200 includes the sensor accommodation groove 240 and the guide groove 236 as openings in the front surface wall 234 and in the underside surface at positions that are disposed on either sides of the ink supply hole 260 as viewed from the front surface wall 234 side. The sensor accommodation groove 240 is for accommodating the residual ink detecting photo sensor 170. The guide groove 236 is for accommodating the guide protrusion walls 120. The sensing arm end portion 367 is inserted between the infrared light emitting portion 172 and the infrared light receiving portion 174 and is movably housed in the protrusion portion 372. Because the protrusion portion 372 protrudes into the sensor accommodation groove 240 and the lock release portion 238 is provided adjacent to the guide groove 236, the ink cartridge 200 can be configured flat and can be smoothly and stably moved across the base wall 32 of the ink cartridge-mounting portion S. The ink cartridge 200 can be easily attached and detached. Moreover, the amount of residual ink can be reliably detected by merely mounting the ink cartridge 200 in the ink cartridge-mounting portion S.

An exemplary ink cartridge 200 mounted in the ink cartridge-mounting portion S is shown in FIGS. 30 to 35.

Figure 31:
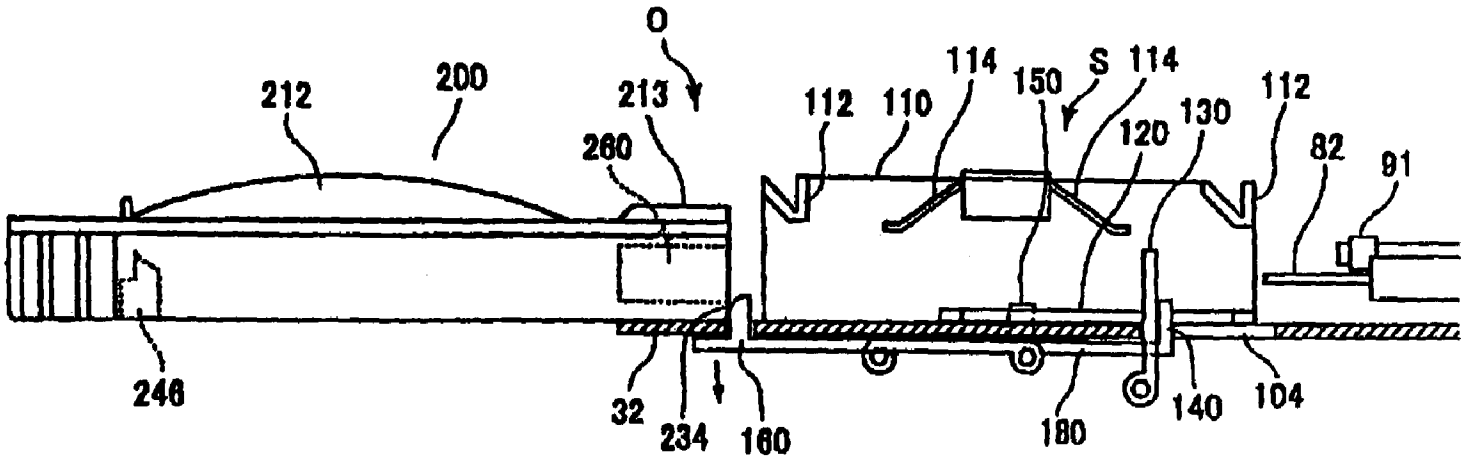
FIG. 31 is a cross-sectional view of the configuration shown in FIG. 30.
Figure 32:
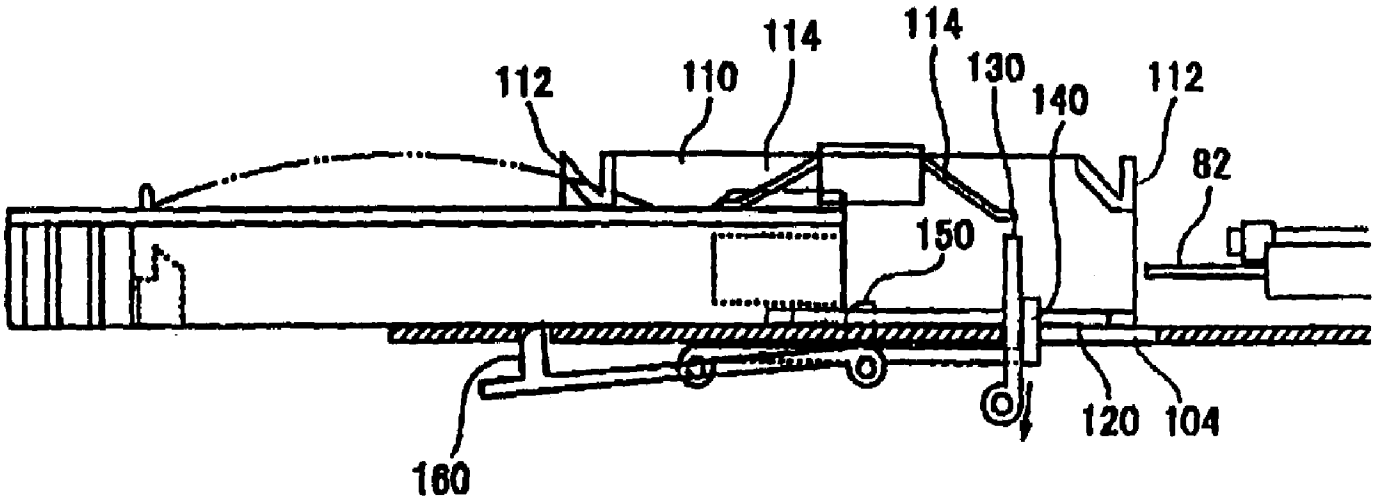
FIG. 32 is a cross-sectional view showing a configuration wherein a needle protection lock member releases a needle protection plate in an exemplary multifunction device when an exemplary ink cartridge is inserted in the multifunction device.
Figure 33:
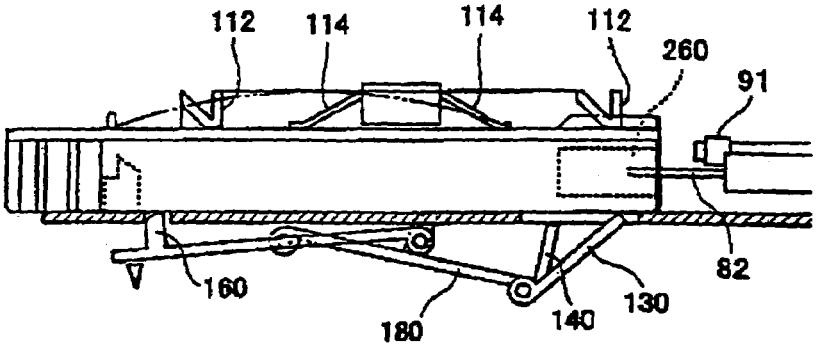
FIG. 33 is a cross-sectional view showing a configuration wherein an ink introduction hollow needle of an exemplary multifunction device is inserted into an ink supply hole of an exemplary ink cartridge when the cartridge is inserted in the device.
Figure 34:
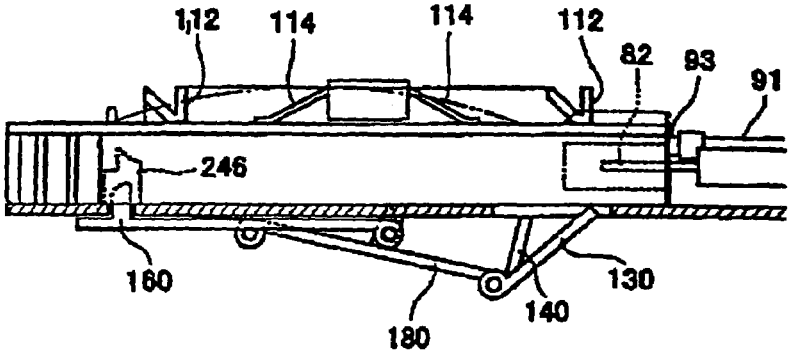
FIG. 34 is a cross-sectional view showing a configuration wherein a front surface of an exemplary ink cartridge abuts a rubber cap of a positive pressure application member of an exemplary multifunction device when the cartridge is inserted in the device.

A user pivots the front surface cover 50 open to expose the ink cartridge holding portion P. Then, the user inserts the ink cartridge 200 into the front surface opening portion O of the ink cartridge-mounting portion S and slides the lower surface of the ink cartridge 200 over the cartridge holding portion base wall 32. As a result, first as shown in FIGS. 30 and 31, the front surface wall 234 retracts the pull-out-lock protrusion 160. Afterward, as shown in FIG. 32, the pull-out-lock protrusion 160 continues to be retracted by the bottom central axis rib 244 while the cartridge slides forward. The guide groove 236 engages with the guide protrusion walls 120 and is slid further. When the lock release portion 238 of the front surface wall 234 hits the lock releasing operation rib 150, the lock member 180 releases the lock of the needle protection plates 130 (lowers the pressing plate 140). Afterward, as shown in FIG. 33, the needle protection plate 130 retracts when the front surface wall 234 of the ink cartridge 200 presses the needle protection plates 130. When the ink cartridge 200 is moved further forward and is completely inserted into the ink cartridge-mounting portion S, the ink introducing hollow needle 82 pierces the ink supply rubber plug 262 (FIG. 39(*a*)) in the ink supply hole 260. Afterward, as shown in FIGS. 34 and 35, the front surface wall 234 abuts the rubber cap 93 of the positive pressure application members 91. The cartridge is pressed in against the force of the spring 94 of the positive pressure application members 91 until it proceeds a bit further. At this time, it is desirable that the front surface of the cartridge abut against a stopper wall (not shown) so that forward progress of the cartridge is blocked. Afterward, although the cartridge moves back a small bit by the force of the spring 94, the pull-out-lock protrusion 160 engages in the leak preventing lock indentation 246 at the under surface of the cartridge. As a result, the cartridge is locked in place and is prevented from pulling out. In this way, the ink cartridge 200 is mounted in the ink cartridge-mounting portion S. Because the front surface wall 234 of the ink cartridge 200 abuts the ring-shaped resilient seal member 93 with a substantially flat portion thereof, the atmosphere connection hole 280 and the positive pressure hole 98 of the ring-shaped resilient seal member 93 are reliably brought into fluid communication without any air leaks.

Because the black ink cartridge has a wider width than the other color ink cartridges, the black ink cartridge cannot be mistakenly inserted into an ink cartridge-mounting portion S for a color ink cartridge. On the other hand, the other color ink cartridges can conceivably be mistakenly inserted into the mounting portion for black ink cartridges. However, the widthwise direction distance Lb1 between the guide groove 236 and the sensor accommodation groove 240 in the color ink cartridges is narrower than the widthwise direction distance Lb2 between the guide protrusion wall 120 and the residual ink detecting photo sensor 170 in the housing portion for the black ink cartridge. Accordingly, the front surface of the cartridge will abut against the sensor guards 176 and not proceed any further forward even if the guide groove 236 engages with the guide protrusion wall 120 and the ink cartridge is slid. Even if the width of the color cartridges were large enough to insert between guide protrusion wall 120 in the housing portion for the black cartridge and the partition wall 110 at the side farther from the guide protrusion wall 120, the lock releasing operation rib 150 cannot be retracted unless the guide groove 236 is engaged with the guide protrusion wall 120. Therefore, the needle protection plate 130 cannot be retracted so the front surface of the cartridge abuts against the needle protection plate 130 and the ink introducing hollow needle 82 cannot be inserted into the ink supply hole 260.

When the ink cartridge 200 is mounted in the ink cartridge-mounting portion S, the ink introducing hollow needle 82 supplies ink from inside the ink accommodation portion 300 to the buffer tank 84. The ink from the buffer tank 84 is supplied to the ink jet head 70 through the ink-supply tube T in association with recording operations.

Although the positive pressure pump 36 is stopped during normal printing operations and during waiting times, the inside of the ink cartridge 200 is applied with atmospheric pressure in the atmosphere chamber 290 inside the ink cartridge 200 through the pump 36, the positive pressure application tubes 92, the positive pressure application members 91, and the atmosphere connection hole 280. For this reason, the flexible film 302 deforms in association with reduction in ink without applying pressure to the ink, and the preformed shape of the flexible film 302 substantially follows the tub portion 320 and comes into intimate contact with the tub portion 320. Therefore, the pressure of the ink supplied to the ink jet head 70 can be maintained fairly fixed and ejection of ink from the ink jet head 70 can be stabilized. The amount of remaining ink can be reduced because the flexible film 302 ends up in intimate contact with the tub portion 320, substantially following the tub portion 320. Furthermore, at least a portion of the tub portion 320 is the curved surface portion 324, whose cross-sectional surface area decreases in association with distance from above (the open side) of the tub portion 320. Therefore, the flexible film 302 can easily follow the tub portion 320 when only a little amount of ink remains. The amount of residual ink can be reduced and pressure of the ink supplied is maintained substantially fixed to the very end.

The ink cartridge-mounting portion S in which the ink cartridge 200 is mounted is positioned lower than the ink jet head 70 in the vertical direction. For this reason, (refer to FIG. 3) the difference in pressure head constantly applies a negative pressure on the ink in the nozzles of the piezoelectric ink jet head 70 in the same manner as a general ink jet recording device. However, under normal conditions the surface tension of the meniscus of the ink in the nozzles maintains the ink in the nozzle against the negative pressure. After the operation of the well-known purge unit 78, that is, after covering the nozzles with a cap and sucking ink from the nozzles using the pump, the ink with bubbles in the cap when suction operations by the pump are stopped enter the nozzles by the difference in pressure head. There is a chance that defective ejection can occur later when printing operations are performed by the ink jet head 70. The exemplary positive pressure pump 36 is operated after purge operations until the cap is opened up. Operation of the positive pressure pump 36 can be started during purge operations as well. As a result, the positive pressure air flow is supplied into the atmosphere chamber 290 in the cartridge. A positive pressure is applied to the ink through the flexible film 302. As a result, a positive pressure can be applied from the cartridge side to ink in the nozzles of the ink jet head 70 and bubbles can be prevented from being drawn into the nozzles. It should be noted that at this time pressure applied by the positive pressure pump 36 can be a pressure sufficient so that bubbles do not enter the nozzles. Although there is no need to apply a pressure large enough to positively press ink out from the nozzles, such a large pressure can be used.

As the ink cartridge 200 is being mounted in the ink cartridge-mounting portion S, the atmosphere connection hole 280 abuts against the positive pressure application members 91 after the ink introducing hollow needle 82 pierces the ink supply rubber plug 262 in the pull-out-lock protrusion 160. (Explained in more detail, as shown in FIG. 35, the distance A in the ink cartridge-mounting portion S between the needle hole in the ink introducing hollow needle 82 and the front surface of the rubber cap 93 of the positive pressure application member 91 is larger than the distance B that the ink supply rubber plug 262 blocks the inside of the ink supply hole 260 from the front surface of the ink cartridge 200.) When the ink cartridge 200 is pulled out from the ink cartridge-mounting portion S, the ink introducing hollow needle 82 pulls out from the rubber plug 262 inside the ink supply hole ink supply hole 260 after the atmosphere connection hole 280 separates from the positive pressure application members 91. Accordingly, even if the ink cartridge 200 pulls out from the ink cartridge-mounting portion S while the positive pressure pump 36 is applying positive pressure to the ink cartridge 200, the atmosphere connection hole 280 would first separate from the positive pressure application members 91 while the ink introducing hollow needle 82 remains in its pierced condition. Therefore, ink can be prevented from leaking out from the ink cartridge 200.

When the ink cartridge 200 is mounted in the ink cartridge-mounting portion S, then as shown in FIG. 35 the infrared light emitting portion 172 and the infrared light receiving portion 174 of the residual ink detecting photo sensor 170 are accommodated in the sensor accommodation groove 240 so as to sandwich the protrusion portion 372, which accommodates the sensing arm end portion 367 (sensing point) of the sensor lever 360. Accordingly, the sensing arm end portion 367 (sensing point) of the sensor lever 360 is positioned between the infrared light emitting portion 172 and the infrared light receiving portion 174. By doing this, the ink sensing mechanism for detecting the condition of when the ink cartridge 200 runs out of ink is completed. That is, the sensor portion 170 (light emitting portion 172+light receiving portion 174) of the exemplary ink sensing mechanism is provided in the ink cartridge-mounting portion S. The lever (the black resin sensor lever 360) that senses whether the sensor portion 170 is ON or OFF is provided in the ink cartridge 200 so that the ink sensing mechanism can be completed by mounting the ink cartridge 200 to the ink cartridge-mounting portion S.

As explained previously, the sensor lever 360 moves the sensing arm end portion 367 (sensing point) vertically in accordance with the amount of residual ink. When a sufficient amount of ink remains, the sensing arm end portion 367 is positioned between the infrared light emitting portion 172 and the infrared light receiving portion 174 and blocks the infrared light. When the ink is almost all gone, the sensing arm end portion 367 pulls out from between the infrared light emitting portion 172 and the infrared light receiving portion 174 so that the infrared light receiving portion 174 receives infrared light. As a result, a person skilled in the art can easily convert presence or absence of ink into an electric signal and control operations of the recording device. The sensor 170 can be used to detect whether the ink cartridge is mounted, and not merely detect presence or absence of ink.

An exemplary ink cartridge 603 and an exemplary multifunction device 601 that uses the ink cartridge 603 will be described with reference to FIGS. 37 to 47.

Figure 37:
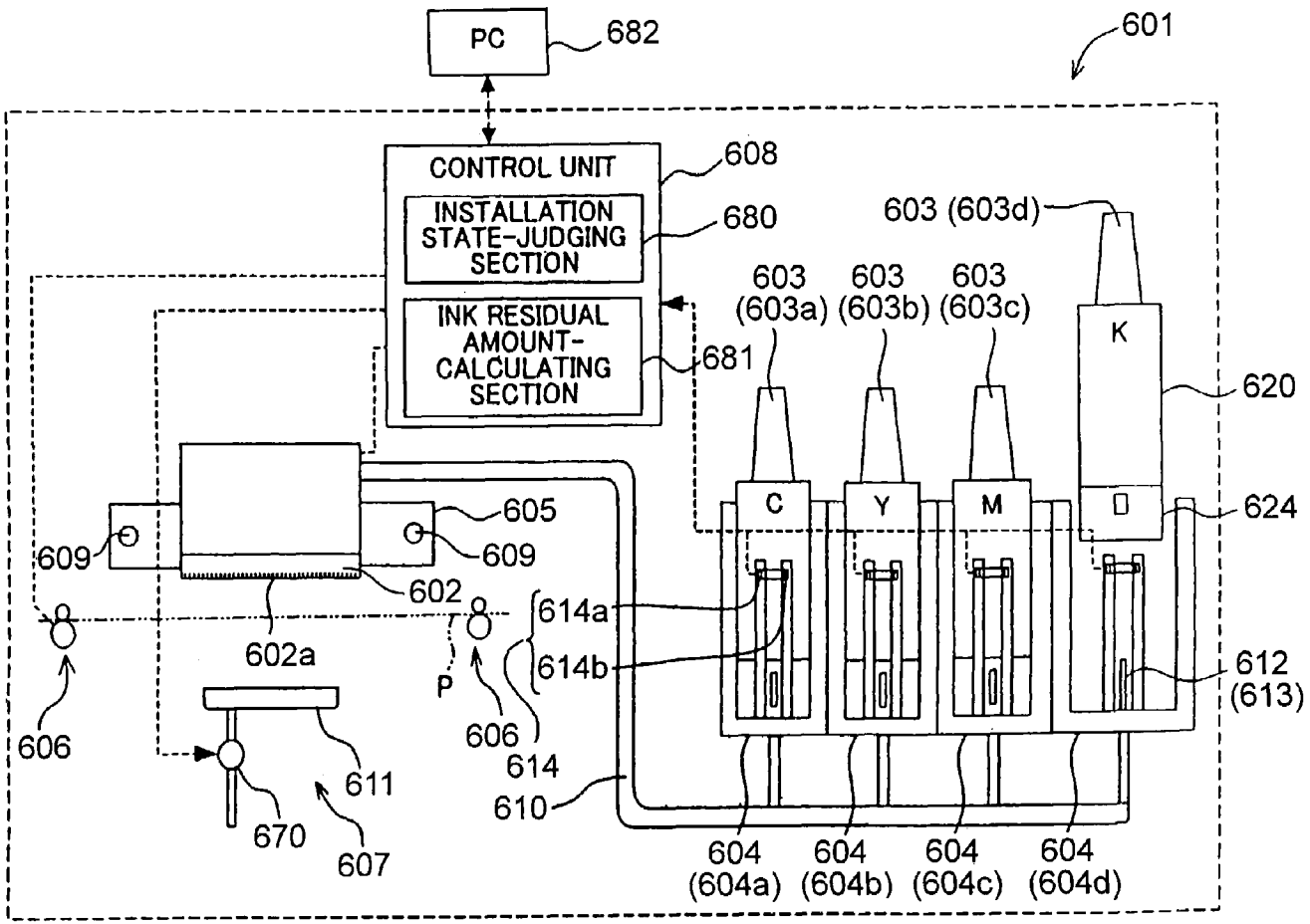
FIG. 37 is a schematic depiction of an exemplary multifunction device.

As shown in FIG. 37, the multifunction device 601 includes, for example, an ink-jet head 602 which is provided with nozzles 602*a* for discharging the four color inks of cyan (C), yellow (Y), magenta (M), and black (K) to the recording paper P, four holders 604 (604*a*, 604*b*, 604*c*, 604*d*) which serve as cartridge-installing sections for installing four ink cartridges 603 (603*a*, 603*b*, 603*c*, 603*d*) for storing the four color inks respectively, a carriage 605 which linearly reciprocates and moves the ink-jet head 602 along a guide 609 in a certain direction (direction perpendicular to the paper surface), a transport mechanism 606 which transports the recording paper P in the direction perpendicular to the direction of movement of the ink-jet head 602 in parallel to the ink discharge surface of the ink-jet head 602, a purge unit 607 which sucks the ink having any high viscosity and the air contained in the ink-jet head 602, and a control unit 608 which manages the control of the entire multifunction device 601.

In the multifunction device 601, the recording paper P is transported by the transport mechanism 606 in the rightward and leftward directions in FIG. 37, while driving and reciprocating the ink-jet head 602 by the carriage 605 in the direction perpendicular to the paper surface in FIG. 37. In cooperation thereto, the ink is supplied to the nozzles 602*a* of the ink-jet head 602 through the supply tube 610 from the holder 604 installed with the ink cartridge 603. Further, the ink is discharged from the nozzles 602*a* to the recording paper P, and the recording paper P is subjected to the printing.

As shown in FIG. 37, the purge unit 607 includes a purge cap 611 which can be installed to the ink-jet head 602 so that the ink discharge surface is covered therewith, and a suction pump 670 which sucks the ink from the nozzles 602*a*. The purge unit 607 is arranged at the position opposed to the ink-jet head 602 with the recording paper P intervening therebetween. The purge unit 607 is movable in the direction to make approach or separation with respect to the ink discharge surface of the ink-jet head 602. When the ink-jet head 602 is out of a printing range in which the recording paper P can be subjected to the printing, the suction pump 670 can be used to suck the air mixed into the ink-jet head 602 and/or the ink having any high viscosity as a result of the evaporation of water from the nozzles 602*a*.

As shown in FIG. 37, the four holders 604*a* to 604*d* are provided in the multifunction device 601 while being aligned in one array in the multifunction device 601. The four ink cartridges 603*a* to 603*d*, which store the inks of cyan, yellow, magenta, and black, are installed to the four holders 604*a* to 604*d* respectively. The black ink of the four color inks is used more frequently than the other three color inks in many cases. In such a case, it is preferable that the volume of the ink cartridge for the black ink is larger than those of the ink cartridges 603*a* to 603*c* for the color inks.

An ink supply pipe (communicating pipe) 612 and an atmospheric air-introducing pipe 613 are provided upstandingly respectively at positions corresponding to an ink supply valve 621 and an atmospheric air-introducing valve 622 of the ink cartridge 603 respectively at the bottom of the holder 604 as described later on. An optical type sensor 614 (light-transmissive type optical sensor) is provided for the holder 604 in order to detect the ink residual amount in the ink cartridge 603. The sensor 614 has a light-emitting section 614*a* and a light-receiving section 614*b* which are arranged at an identical height position and which are opposed to one another so that the ink cartridge 603 is interposed between the both sides. It is detected whether or not the light from the light-emitting section 614*a* is blocked by a shutter mechanism 623 provided in the ink cartridge 603 as described later on. An obtained detection result is outputted to the control unit 608.

Next, the ink cartridge 603 will be explained in detail. Exemplary ink cartridges 603*a* to 603*c*, which store the three types of color inks respectively, have the same structure as that of the ink cartridge 603*d* which stores the black ink. Therefore, one of the ink cartridges 603 will be explained.

Figure 38A:
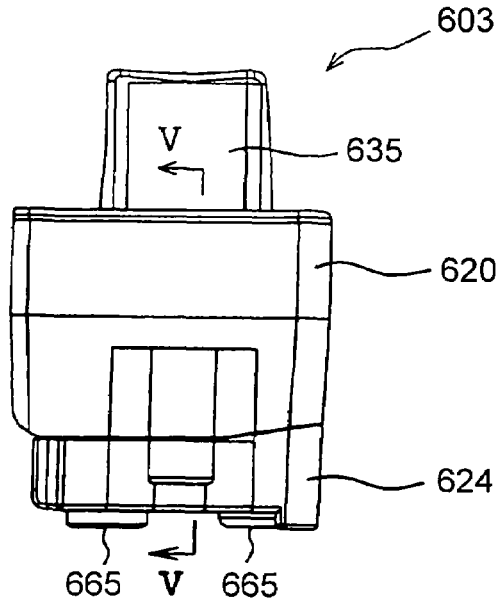
FIG. 38A is a plan view.
Figure 38B:
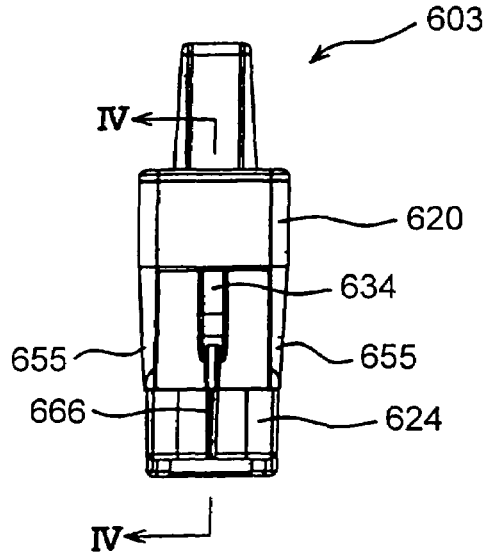
FIG. 38B is a left side view.
Figure 38C:
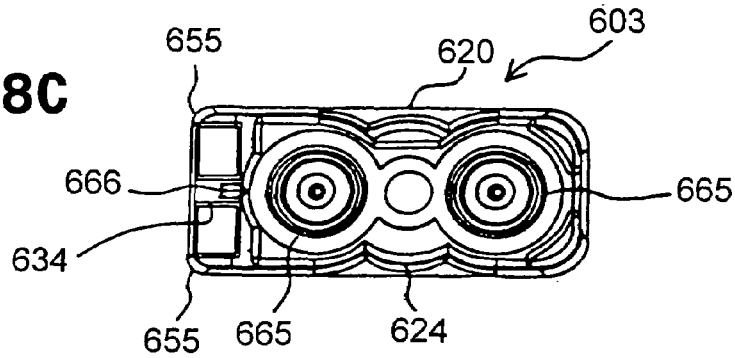
FIG. 38C is a bottom view.
Figure 39:
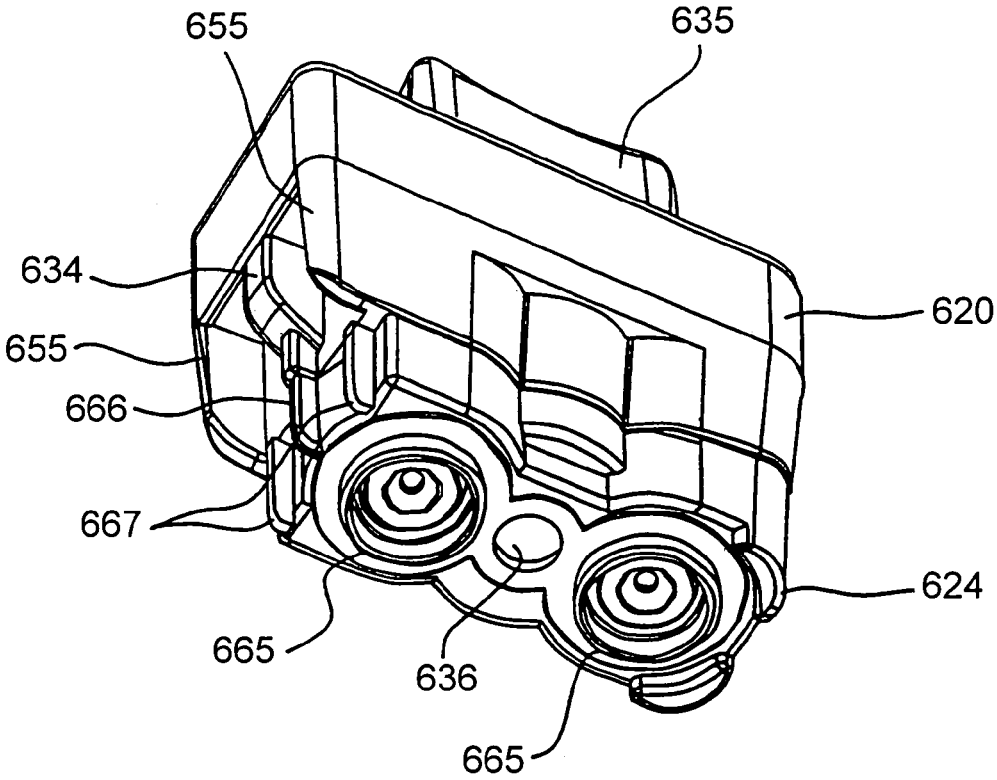
FIG. 39 is a perspective view of the ink cartridge depicted in FIG. 37 viewed from a downward position.
Figure 40:
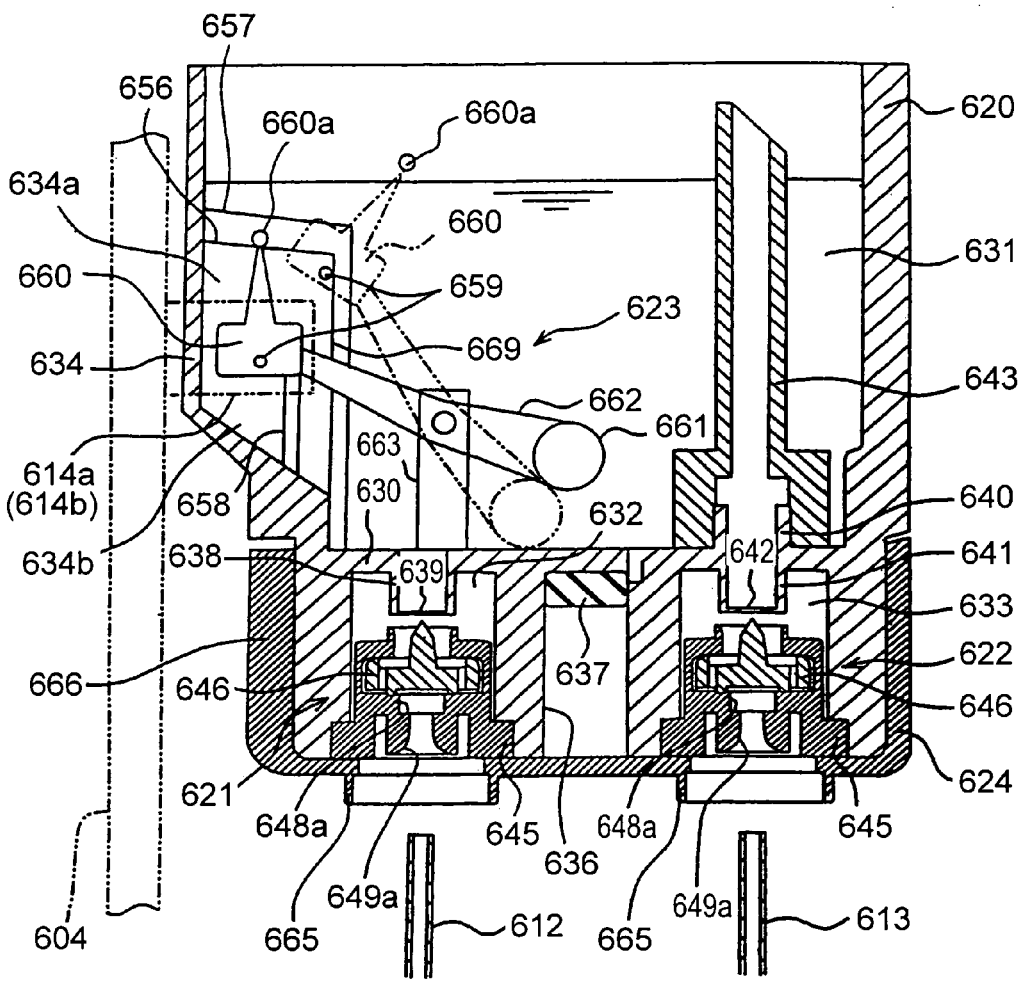
FIG. 40 is a sectional view of the ink cartridge in FIG. 38B taken along a line IV-IV.

As shown in FIGS. 38 to 40, the ink cartridge 603 includes a cartridge main body 620 which stores the ink, an ink supply valve 621 which is capable of opening/closing the ink supply passage to supply the ink contained in the cartridge main body 620 to the ink-jet head 602, an atmospheric air-introducing valve 622 which is capable of opening/closing the atmospheric air-introducing passage to introduce the atmospheric air into the cartridge main body 620 from the outside, a shutter mechanism 623 which blocks the light emitted from the light-emitting section 614*a* of the sensor 614 for detecting the ink residual amount in the ink cartridge 603, and a cap 624 which covers the lower end of the cartridge main body 620.

The cartridge main body 620 is formed of a light-transmissive synthetic resin. As shown in FIG. 40, a comparting wall 630, which extends horizontally, is integrally formed in the cartridge main body 620. The inner space of the cartridge main body 620 is comparted by the comparting wall 630 into an ink chamber (ink tank) 631 which is disposed on the upper side, and two valve-accommodating chambers 632, 633 which disposed on the lower side. The ink chamber 631 is charged with each of the color inks. The ink supply valve 621 and the atmospheric air-introducing valve 622 are accommodated in the two valve-accommodating chambers 632, 633 respectively. In this arrangement, the ink supply passage, which is used to introduce the ink charged in the ink chamber 631 to the outside, is constructed in the valve-accommodating chamber 632. As described later on, the ink flow, which is directed downwardly from the side of the ink chamber 631, is formed in the ink supply passage (see FIG. 45B). As shown in FIGS. 38B and 38C, a projection 634, which slightly protrudes outwardly and which extends in the downward direction, is formed at a substantially central position in the height direction of the side wall of the cartridge main body 620. The light-emitting section 614*a* and the light-receiving section 614*b* of the sensor 614 provided for the holder 604 are positioned at a height approximately equal to that of the projection 634 formed on the side wall of the cartridge main body 620 in a state in which the ink cartridge 603 is installed to the holder 604.

Figure 41:
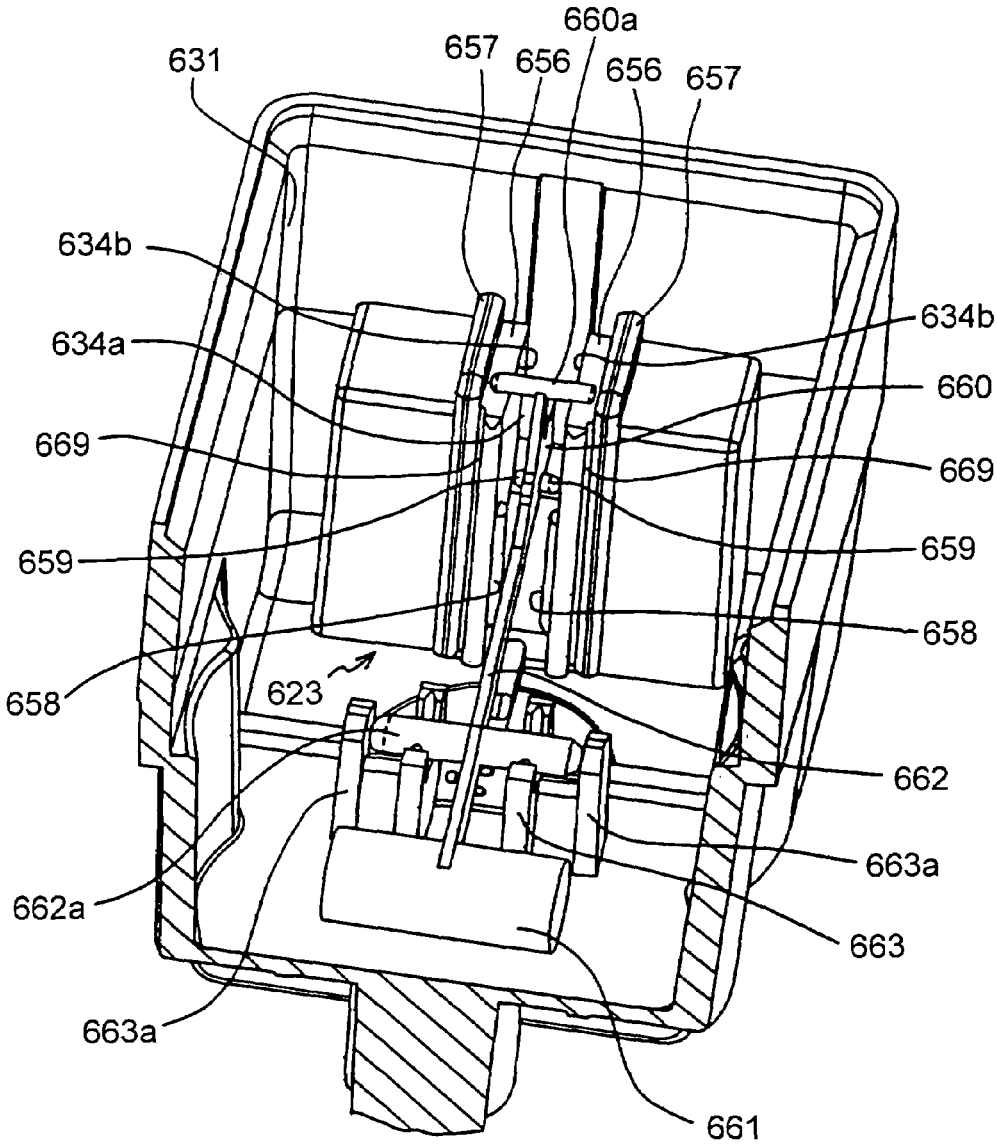
FIG. 41 is a perspective view of the ink cartridge in FIG. 38A at a cross section taken along a line V-V.
Figure 42:
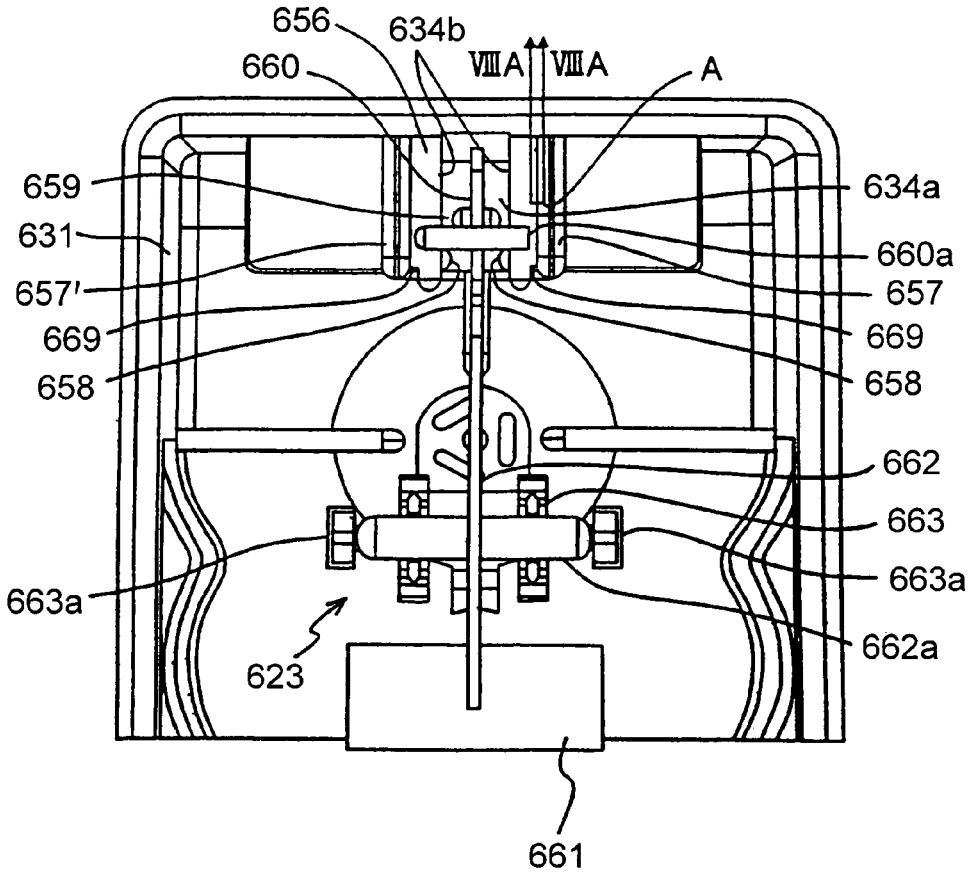
FIG. 42 is a top view of the ink cartridge in FIG. 38A at a cross section taken along the line V-V.
Figure 43:
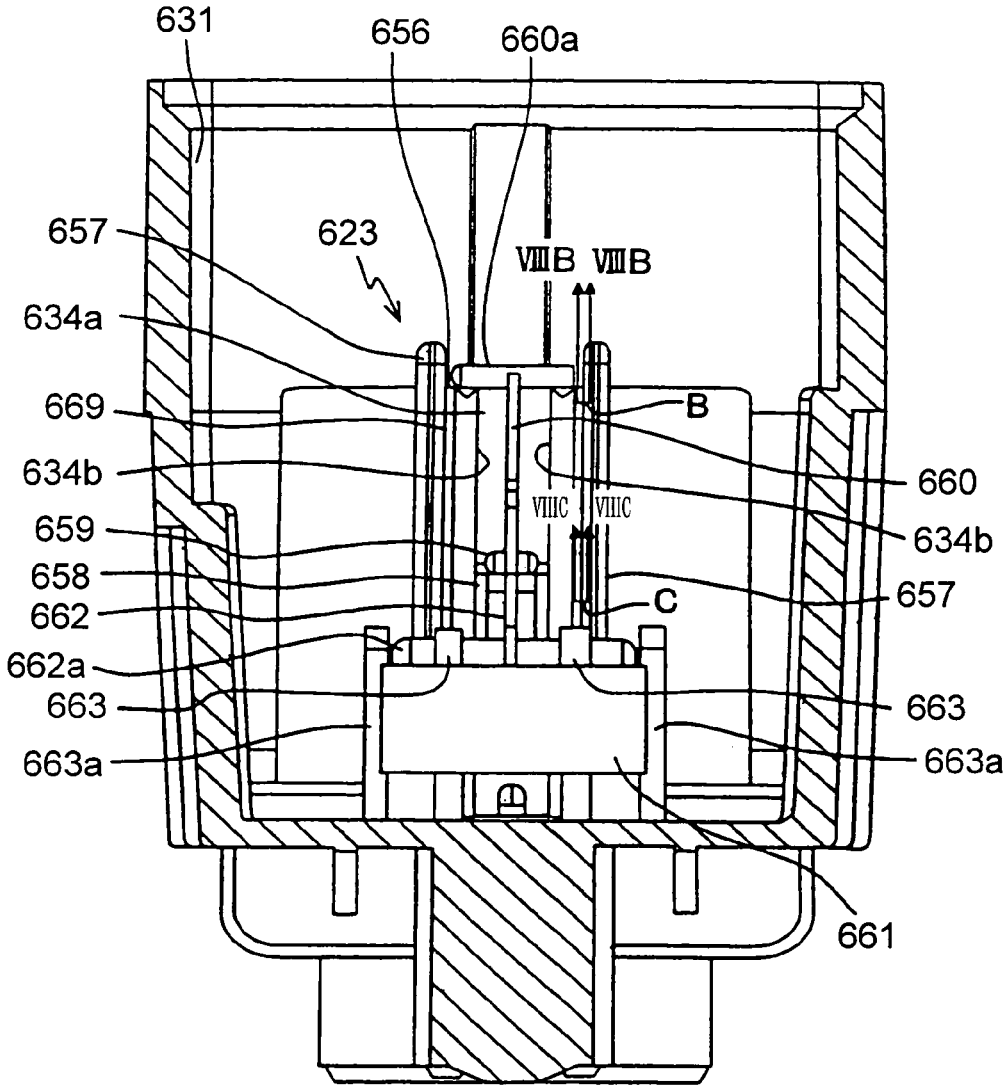
FIG. 43 is a front view of the ink cartridge in FIG. 38A at a cross section taken along the line V-V.
Figure 44A:
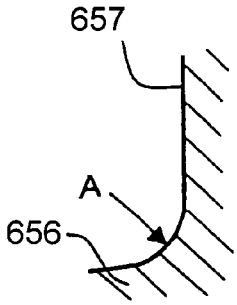
FIG. 44A is a sectional view of the ink cartridge in FIG. 42 taken along a line VIIIA-VIIIA.
Figure 44B:
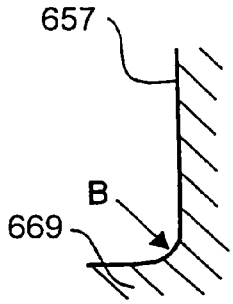
FIG. 44B is a sectional view of the ink cartridge in FIG. 42 taken along a line VIIIB-VIIIB.
Figure 44C:
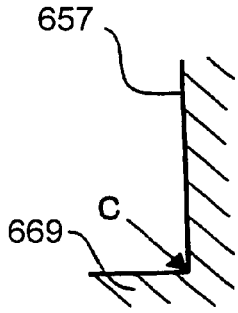
FIG. 44C is a sectional view of the ink cartridge in FIG. 43 taken along a line VIIIC-VIIIC.

As shown in FIGS. 41 to 43, a recess 634*a* is formed at the inside of the projection 634 in the ink chamber 631. As shown in FIGS. 41 to 43, the recess 634*a* extends in the direction (direction inclined downwardly) perpendicular to the ink surface, and the recess 634*a* has two inner wall surfaces (downwardly inclined inner surfaces) 634*b* which are opposed to one another. As shown in FIGS. 41 to 43, a shield plate (detection objective section) 660 of the shutter mechanism 623 described later on is arranged in the recess 634*a* so that the shield plate 660 is interposed between the two inner wall surfaces 634*b* of the recess 634*a*. As shown in FIGS. 41 to 43, a rib 658, which protrudes toward the shield plate 660 arranged in the recess 634*a* and which extends in the perpendicular direction, is formed on each of the inner wall surfaces 634*b*. As shown in FIGS. 41 to 43, two abutment objective surfaces (regulating surfaces) 656, which extend in directions to make separation from each other in an identical plane from the upper ends of the respective inner wall surfaces 634*b*, are formed in the ink chamber 631. The abutment objective surfaces 656 are surfaces to make abutment against abutment sections 660*a* formed at the upper end of the shield plate 660 as described later on. The abutment objective surfaces 656 are inclined surfaces each of which is inclined by a predetermined angle toward the bottom surface of the ink chamber 631 (to make intersection with the ink surface) (see FIG. 40). As shown in FIGS. 41 to 43, perpendicular wall surfaces 669, each of which is connected to the end of the inner wall surface 634*b* disposed on the side opposite to the side of connection to the inner wall of the ink chamber 631 and the end of the abutment objective surface 656 disposed on the side opposite to the side of connection to the inner wall of the ink chamber 631, are formed in the ink chamber 631. As shown in FIGS. 41 to 43, ribs 657 are formed so that each of them extends over the abutment objective surface 656 and the perpendicular wall surface 669 and each of them is disposed perpendicularly to the extending direction of the abutment section 660*a* which makes abutment against the abutment objective surface 656. In a state in which the abutment section 660*a* abuts against the abutment objective surfaces 656, as shown in FIG. 41, the tips of the abutment section 660*a* are disposed adjacently and opposingly to the side surfaces of the ribs 657. As shown in FIGS. 41 to 43, the rib 657 is formed continuously over the range from the end of the abutment objective surface 656 on the side of the inner wall of the ink chamber 631 to the end opposed thereto and over the range from the end of the perpendicular wall surface 669 on the side of the abutment objective surface 656 to the end opposed thereto. FIG. 44 shows cross sections of the boundaries between the rib 657 and the abutment objective surface 656 and the perpendicular wall surface 669. In the case of an exemplary as shown in FIG. 44, the radius of curvature of the boundary differs depending on the position of connection between the rib 657 and the abutment objective surface 656 and the perpendicular wall surface 669. FIG. 44A shows the cross section illustrating the boundary between the rib 657 and the abutment objective surface 656. FIG. 44B shows the cross section illustrating the boundary between the rib 657 and the upper end area of the perpendicular wall surface 669. FIG. 44C shows the cross section illustrating the boundary between the rib 657 and the lower end area of the perpendicular wall surface 669. As shown in FIGS. 44A to 44C, the curvature of the curved section (A in FIG. 44A) formed at the boundary between the rib 657 and the abutment objective surface 656 is smaller than the curvatures of the curved sections (B and C in FIGS. 44B and 44C) formed at the boundaries between the rib 657 and the perpendicular wall surface 669. The curvature of the curved section (B in FIG. 44B) formed at the boundary between the rib 657 and the upper end area of the perpendicular wall surface 669 is smaller than the curvature of the curved section (C in FIG. 44C) formed at the boundary between the rib 657 and the lower end area of the perpendicular wall surface 669.

As shown in FIGS. 40 to 43, the shutter mechanism 623 which is provided in the lower space of the ink chamber 631 includes a shield plate 660 (detection objective section) which is nontransparent with respect to the light, a hollow float 661 (balance member), a connecting member 662 which connects the shield plate 660 and the float 661, and a support stand 663 which is provided on the upper side of the comparting wall 630 and which rotatably supports the connecting member 662. The displacement member (swinging member) is constructed by the shield plate 660, the float 661, and the connecting member 662. The float 661 is a cylindrical member having a tightly closed space filled with the air therein. The specific gravity of the entire float 661 is smaller than the specific gravity of the ink to be changed in the ink chamber 631. The shield plate 660 and the float 661 are provided at both ends of the connecting member 662 respectively. A columnar rotational shaft 662*a*, which protrudes in directions perpendicular to the both side surfaces of the connecting member 662, is formed in the vicinity of the center in the extending direction of the connecting member 662. The connecting member 662 is supported on the support stand 663 rotatably in the vertical plane (in the plane parallel to the sheet surface of the drawing) about the center of the rotational shaft 662*a*.

As shown in FIGS. 40 to 43, the rotational shaft 662*a*, which is formed on the connecting member 662, protrudes from the flat surfaces on both sides of the connecting member 662 in the direction perpendicular to the direction of displacement of the ink surface. In order to smoothen the rotation of the connecting member 662, the rotational shaft 662*a* is supported on the support stand 663 such that the rotational shaft 662*a* is also rotatable to some extent in the plane parallel to the sheet surface of FIG. 42. That is, the support stand 663 supports, at the lower position, the swinging member so that the motion other than the rotation of the connecting member 662 about the center of the rotational shaft 662*a* is also allowable. The tips of the rotational shaft 662*a* in the protruding directions, which protrude from the both side surfaces of the connecting member 662, abut against side wall surfaces on the mutually opposing sides of a pair of support plates 663*a* provided upstandingly from the bottom surface (comparting wall 630 as described later on) of the ink chamber 631. Accordingly, the displacement of the entire swinging member is regulated in the rightward and leftward directions on the sheet surface of FIG. 42.

The shield plate 660 is a thin plate-shaped member which is parallel to the vertical plane (plane parallel to the sheet surface of FIG. 40) and which has a predetermined area. As shown in FIG. 40, the shield plate 660 has a rectangular area, and a triangular protruding area which is formed to further extend upwardly from the upper end of the rectangular area. The abutment section 660*a*, which has a columnar shape extending from the shield plate 660 toward the two ribs 657 (in the direction along the ink surface), is formed at the upper end of the protruding area. The abutment section 660*a* makes abutment against the abutment objective surface 656 in the ink chamber 631. Accordingly, the rotation of the connecting member 662 in the certain direction (first direction) is regulated to arrange the shield plate 660 at a predetermined position. Specifically, as shown in FIG. 40, when the abutment section 660*a* abuts against the abutment objective surface 656, the shield plate 660 is arranged at the detecting position between the light-emitting section 614*a* and the light-receiving section 614*b* of the recess 634*a*. In this situation, the light, which has transmitted from the light-emitting section 614*a* of the sensor 614 through the wall of the light-transmissive cartridge main body 620 and the ink in the ink chamber 631, is blocked by the shield plate 660. On the other hand, when the abutment section 660*a* is separated from the abutment objective surface 656 (when the swinging member is in a state indicated by two-dot chain lines in FIG. 40), the shield plate 660 is arranged at any position other than the detecting position. In this situation, the light transmitted from the light-emitting section 614*a* arrives at the light-receiving section 614*b* without being blocked.

Therefore, in a state in which the ink residual amount in the ink chamber 631 is large, and the entire float 661, which is provided at one end of the connecting member 662, is positioned in the ink (in a situation in which the swinging member is in a state illustrated by solid lines in FIG. 40), the float 661 floats in accordance with the buoyancy acting on the float 661, and the connecting member 662 is rotated. However, the abutment section 660*a* of the shield plate 660 abuts against the abutment objective surface 656, and the rotation of the connecting member 662 is regulated. Therefore, the shield plate 660, which is provided at the other end of the connecting member 662, is arranged at the detecting position, i.e., at the position at which the light emitted from the light-emitting section 614*a* in the projection is blocked. However, when the ink residual amount in the ink chamber 631 is decreased, and a part of the float 661 protrudes from the ink liquid surface, then the buoyancy acting on the float 661 is decreased, and the float 661 is moved downwardly in accordance with the gravity (in a state in which the swinging member is indicated by two-dot chain lines in FIG. 40). Accordingly, the shield plate 660 is moved to the position (non-detecting position) which is disposed upwardly as compared with the interior of the projection 634 so that the direct light emitted from the light-emitting section 614*a* is not blocked by the shield plate 660. Therefore, the direct light emitted from the light-emitting section 614*a* is transmitted through the light-transmissive projection 634 along the linear optical path, and the light is directly received by the light-receiving section 614*b*. Accordingly, the state, in which the ink residual amount in the ink chamber 631 is decreased, is detected by the sensor 614.

As shown in FIGS. 40 to 43, columnar pins (projections) 659, which protrude from the shield plate 660 toward the inner wall surfaces 634*b* of the recess 634*a*, are formed on the both side surfaces of the rectangular area of the shield plate 660 (in the vicinity of the end of the swinging member) respectively. The tip of the pin 659 is constructed to form a curved surface. As shown in FIG. 40, the tips of the pins 659 are always in a state of being opposed to the inner wall surfaces 634*b* of the recess 634*a* within a range of movement of the abutment section 660*a* between the position at which the abutment section 660*a* abuts against the abutment objective surfaces 656 and the position at which the abutment section 660*a* is separated from the abutment objective surfaces 656. The pin 659 has an amount of projection to form a gap of such an extent that no capillary phenomenon is caused by at least the surface tension of the ink between the shield plate 660 and the inner wall surface 634*b* even when the tip of the pin 659 abuts against the inner wall surface 634*b* of the recess 634*a*, and the shield plate 660 makes approach most closely to the inner wall surface 634b.

In this structure, in a state in which the ink cartridge 603 is installed to the holder 604, the projection 634 of the ink cartridge main body 620 is interposed between the light-emitting section 614*a* and the light-receiving section 614*b* of the sensor 614. In this situation, the width of the projection 634 is narrower than the distance between the light-emitting section 614*a* and the light-receiving section 614*b*. Therefore, a predetermined spacing distance is maintained between the light-emitting section 614*a* and the light-receiving section 614*b* and the projection 634. As shown in FIGS. 38 and 39, a pair of ribs 655, which extend in the same direction as the extending direction of the projection 634 so that the projection 634 is interposed therebetween, are provided for the cartridge main body 620 at the both ends in the horizontal direction (leftward/rightward direction of the sheet surface in FIG. 38B) on the outer wall surface on which the projection 634 is formed. A lid member 635, including a holding part, is welded to the upper end of the cartridge main body 620. The ink chamber 631 in the cartridge main body 620 is closed by the lid member 635.

As shown in FIG. 40, an injecting hole 636 is formed between the two valve-accommodating chambers 632, 633 in order to inject the ink into the ink chamber 631 of the empty ink cartridge 603. A plug member 637 made of synthetic rubber is forcibly inserted into the injecting hole 636. As shown in FIG. 40, an opening, which makes communication with the ink chamber 631 in the cartridge main body 620, is formed through a part of the injecting hole 636 in the vicinity of the upper end of the side wall. When the ink is charged, the plug member 637 in the injecting hole 636 is pierced by an injection needle (not shown), and the injection needle is penetrated through the opening which is formed through the part of the injecting hole 636 in the vicinity of the upper end of the side wall so that the ink is charged into the ink chamber 631 via the injection needle.

As shown in FIG. 40, a cylindrical section 638, which protrudes downwardly, is integrally formed at a portion of the comparting wall 630 which constitutes the ceiling of the valve-accommodating chamber 632 for accommodating the ink supply valve 621 therein. A thin film section 639, which closes the communication passage formed in the cylindrical section 638, is provided at the lower end of the cylindrical section 638. On the other hand, two cylindrical sections 640, 641, which protrude upwardly and downwardly respectively, are integrally formed at a portion of the comparting wall 630 which constitutes the ceiling of the valve-accommodating chamber 633 for accommodating the atmospheric air-introducing valve 622 therein. A thin film section 642, which closes the communication passage formed in the cylindrical sections 640, 641, is provided at the lower end of the cylindrical section 641 disposed on the lower side. Further, as shown in FIG. 40, a cylindrical member 643, which extends up to the upper end of the ink chamber 631, is provided on the upper side of the cylindrical section 640.

Figure 45A:
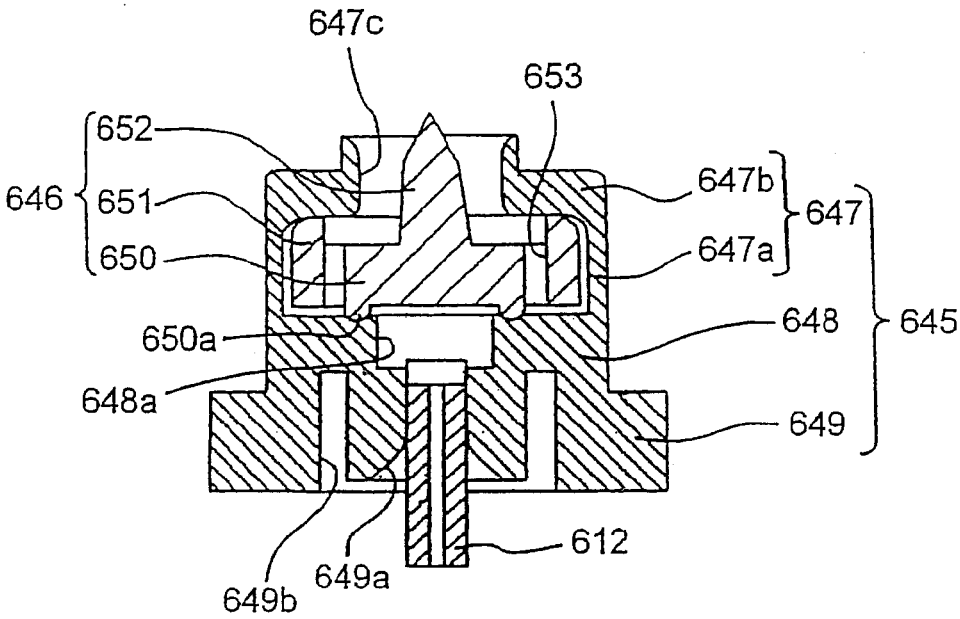
Figure 45B:
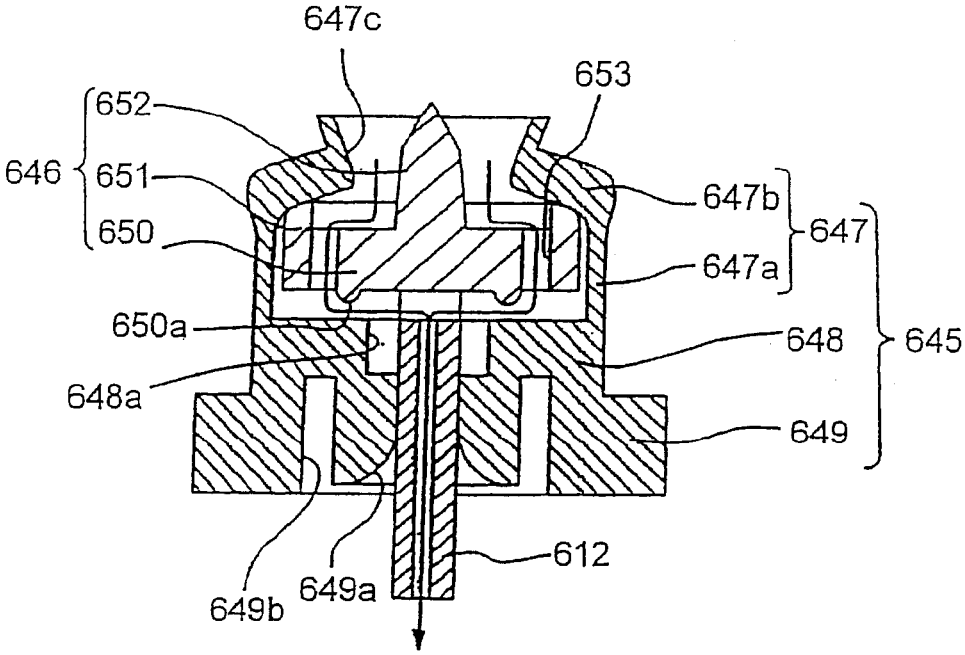

As shown in FIG. 40, the ink supply valve 621 includes a valve main body 645 which is formed to have a substantially cylindrical shape with synthetic rubber or the like and which has elasticity, and a valve plug 646 which is accommodated in the valve main body 645 and which is made of synthetic resin. As shown in FIGS. 45A and 45B, the valve main body 645 includes an urging section 647, a valve seat section 648, and a fitting section 649 which are integrally formed and which are aligned in this order from the upper side (side of the ink chamber 631).

In this structure, the lower surface of the valve plug 646 abuts against the upper surface of the valve seat section 648 (end surface on the side facing the ink chamber 631). A through-hole 648*a*, which extends in the vertical direction, is formed through a portion of the axial center of the valve seat section 648. A guide hole 649*a*, which is communicated with the through-hole 648a of the valve seat section 648 and which extends downwardly, is formed for the fitting section 649. The guide hole 649*a* is formed to have a shape widening toward the end in which the diameter is increased at lower positions. An annular groove 649*b* is formed around the guide hole 649*a*. In this structure, the wall for forming the guide hole 649*a* is elastically deformable with ease in the direction in which the diameter of the guide hole 649*a* is expanded. Therefore, when the ink supply pipe 612 is inserted into the guide hole 649*a*, it is possible to avoid the leakage of the ink as far as possible by improving the tight contact performance between the guide hole 649*a* and the ink supply pipe 612. Even when the ink supply pipe 612 is inserted into the guide hole 649*a* in a state in which the ink supply pipe 612 is inclined with respect to the guide hole 649*a* or in a state in which the central axis of the guide hole 649*a* is deviated from the central axis of the ink supply pipe 612, the ink supply pipe 612 is reliably inserted into the guide hole 649*a*, because the wall section is elastically deformed in the direction in which the diameter of the guide hole 649*a* is expanded.

As shown in FIGS. 45A and 45B, the urging section 647 includes a cylindrical side wall section 647*a* which extends from the outer circumferential side portion of the valve seat section 648 toward the side of the ink chamber 631, and a projecting section 647 which integrally protrudes inwardly in the radial direction of the side wall section 647*a* from the upper end of the side wall section 647*a*. The lower surface of the projecting section 647*b* abuts against the valve plug 646. The valve plug 646 is urged downwardly by the elastic forces of the side wall section 647*a* and the projecting section 647*b*. An opening 647*c* is formed at the inside of the projecting section 647*b*. In this construction, the side wall section 647*a* and the projecting section 647*b*, which are formed in an integrated manner, are elastically deformable with ease.

Figure 46:
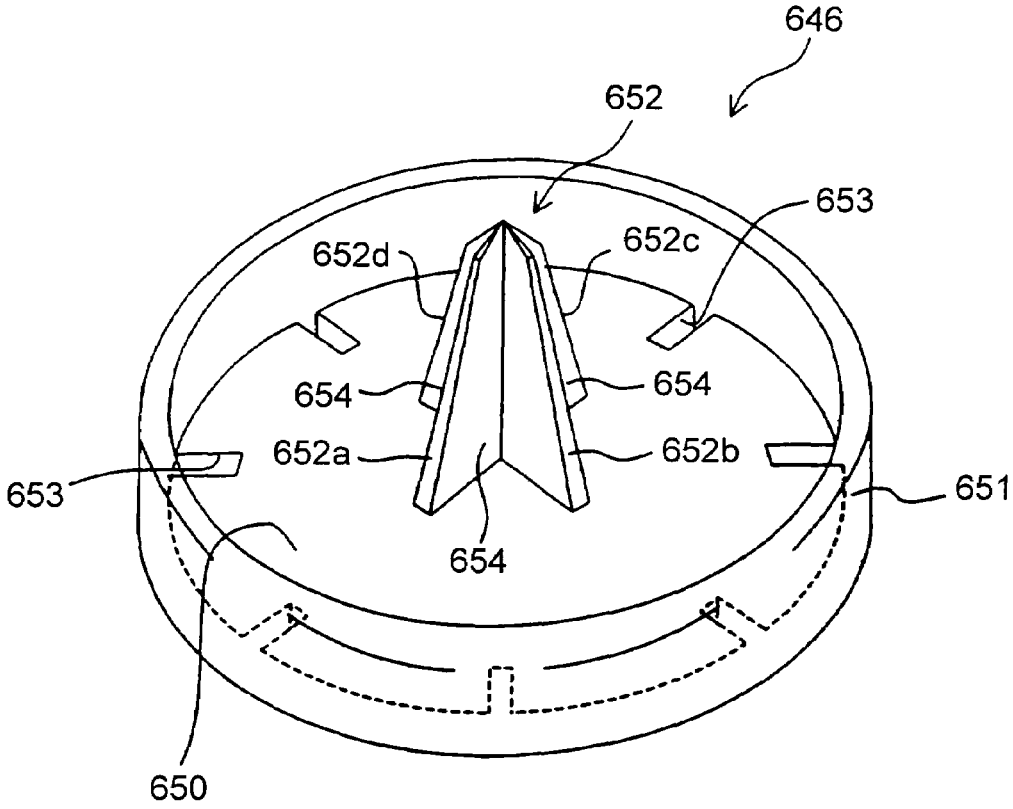
FIG. 46 is a perspective view of the valve plug in FIG. 41.

As shown in FIGS. 45A, 45B, and 46, the valve plug 646 includes a bottom section 650 which makes abutment against the valve seat section 648 of the valve main body 645, a cylindrical valve side wall section 651 which extends from the outer circumferential side portion of the bottom section 650 toward the ink chamber 631, and a breaking section 652 which protrudes from the center of the bottom section 650 excessively toward the ink chamber 631 as compared with the valve side wall section 651.

An annular projection 650*a*, which protrudes toward the valve seat section 648, is formed on the lower surface of the bottom section 650 of the valve plug 646 (end surface opposed to the valve seat section 648). The valve plug 646 is urged toward the valve seat section 648 by the urging section 647 of the valve main body 645. In a state (state shown in FIG. 45A) in which the annular projection 650*a* makes tight contact with the upper surface of the valve seat section 648, the through-hole 648*a* of the valve seat section 648 is closed by the valve plug 646, and the ink supply passage is closed. Further, a plurality of (for example, eight)

communication passages 653, which make communication between the upper space and the lower space of the valve plug 646, are formed at equally divided positions in the circumferential direction of the portion of the bottom section 650 of the valve plug 646, the portion being disposed on the outer circumferential side as compared with the annular projection 650*a* and on the inner circumferential side as compared with the valve side wall section 651.

As shown in FIGS. 45A, 45B, and 46, the breaking section 652 of the valve plug 646 is constructed by four plate members 652*a*, 652*b*, 652*c*, 652*d* combined in a cross form as viewed in a plan view. The breaking section 652 is provided upstandingly at a substantially central portion of the bottom section 650. As shown in FIG. 46, grooves 654, which extend in the vertical direction, are formed respectively between the plate members (for example, between the plate members 652*a*, 652*b*) which are combined perpendicularly to one another. The breaking section 652 passes through the opening 647*c* at the inside of the projecting section 647*b* of the valve main body 645 so that the breaking section 652 protrudes upwardly. As shown in FIG. 40, the tip of the breaking section 652 is arranged at the position slightly lower than the thin film section 639 of the cylindrical section 638 before the ink cartridge 603 is installed to the holder 604.

When the ink cartridge 603 is installed to the holder 604, the ink supply pipe 612, which is provided for the holder 604, is inserted into the guide hole 649*a* of the valve main body 645. Accordingly, the valve plug 646 is pushed upwardly by the tip of the ink supply pipe 612 against the urging force of the urging section 647 of the valve main body 645. The valve plug 646 is moved upwardly while deforming the urging section 647. The annular projection 650*a*, which is provided on the bottom surface of the valve plug 646, is separated from the valve seat section 648 (see FIG. 45B). In this situation, the thin film section 639 of the cylindrical section 638 is broken by the tip of the breaking section 652 of the valve plug 646 having been moved upwardly. Accordingly, as shown in FIGS. 40 and 45B, the ink contained in the ink chamber 631 flows into the valve-accommodating chamber 632 through the communication passage in the cylindrical section 638. Further, the ink is supplied through the communication passages 653 of the valve plug 646 from the ink supply pipe 612 to the ink-jet head 602. In this situation, the valve-accommodating chamber 632 functions as the ink supply passage. The flow of the ink (arrow in FIG. 45B) is formed, which is directed downwardly from the side of the ink chamber 631.

As shown in FIG. 40, the atmospheric air-introducing valve 622 is provided with the valve main body 645 and the valve plug 646 which is accommodated in the valve main body 645. The atmospheric air-introducing valve 622 is constructed in the same manner as the ink supply valve 621. That is, the atmospheric air-introducing valve 622 is constructed such that the valve plug 646, which is urged downwardly by the urging section 647, makes tight contact with the valve seat section 648 of the valve main body 645 so that the valve plug 646 closes the through-hole 648*a*. When the ink cartridge 603 is installed to the holder 604, the atmospheric air-introducing pipe 613 is inserted into the guide hole 649*a* formed in the valve main body 645. Similarly to the ink supply valve 621, the valve plug 646 is moved upwardly, and the thin film section 642 of the cylindrical section 641 is broken by the breaking section 652 of the valve plug 646. Accordingly, the outside atmospheric air flows from the atmospheric air-introducing pipe 613 via the communication passages 653 of the valve plug 646 into the valve-accommodating chamber 633. Further, the atmospheric air is introduced into the upper portion of the ink chamber 631 via the inner passage of the cylindrical member 643 and the cylindrical sections 640, 641.

The cap 624 is formed of the nontransparent material through which no light is transmitted unlike the cartridge main body 620. As shown in FIGS. 38 to 40, the cap 624 is secured to the cartridge main body 620, for example, by the ultrasonic welding in a state in which the lower end of the cartridge main body 620 is covered therewith. Two annular projections 665, which protrude downwardly, are formed respectively at the positions of the bottom of the cap 624 corresponding to the ink supply valve 621 and the atmospheric air-introducing valve 622 respectively. In this structure, for example, when the ink cartridge 603 is placed on a desk, the ink, which is adhered to those in the vicinity of the inlets of the ink supply valve 621 and the atmospheric air-introducing valve 622, is hardly adhered, for example, to the desk surface.

As shown in FIGS. 38 to 40, a rib 666, which extends in the vertical direction, is formed on the side wall portion of the cap 624 on the same side as that of the projection 634 formed on the outer wall of the cartridge main body 620. The rib 666 is formed under the projection 634. As shown in FIGS. 38B and 40, the rib 666 and the shield plate 660 in the projection 634 of the cartridge main body 620 are arranged at the positions separated from each other by a predetermined distance in the vertical direction. The rib 666 is positioned at the position lower than the shield plate 660. Therefore, the rib 666 is positioned at the position lower than the light-emitting section 614*a* and the light-receiving section 614*b* of the sensor 614 in a state in which the ink cartridge 603 is installed to the holder 604. Further, the rib 666 is located at the position interposed between the light-emitting section 614*a* and the light-receiving section 614*b* of the sensor 614 as viewed in a plan view in which the ink cartridge 603 is viewed in the direction of installation. The width of the rib 666 is narrower than the width of the projection 634, and the protruding distance of the rib 666 is shorter than the protruding distance of the projection 634.

The rib 666 is detected such that the rib 666 passes between the light-emitting section 614*a* and the light-receiving section 614*b* of the sensor 614 to instantaneously shut off the light from the light-emitting section 614*a* of the sensor 614 only when the ink cartridge 603 is installed to the holder 604 or when the ink cartridge 603 is detached from the holder 604. On the other hand, the rib 666 exists at the position lower than the sensor 614 in the state of installation of the ink cartridge 603. Therefore, the rib 666 is not detected by the sensor 614. Only the shield plate 660, which is arranged in the ink chamber 631, can be detected by the sensor 614. That is, the rib 666 can be detected by the sensor 614 only when the ink cartridge 603 is attached/detached. Therefore, it is possible to recognize whether or not the ink cartridge 603 is installed, by using the control unit 608 as described later on, on the basis of the result of detection of the rib 666. A structure is provided such that the rib 666 is detected by the sensor 614 only by attaching/detaching the ink cartridge 603 in a certain direction. Therefore, it is unnecessary to perform any complicated operation, which would be otherwise performed in order to detect the rib 666 with the sensor 614. Further, it is possible to extremely avoid the breakage of the rib 666, which would be otherwise caused, for example, by any contact with the holder 604, the rib 666 being exposed to the outside and being weak in view of the strength.

Next, the control unit 608 will be explained. The control unit 608 manages the control of various operations to be performed by the multifunction device 601 including, for example, the discharge of the ink from the nozzles 602*a* of the ink-jet head 602, the supply of the paper to the ink-jet head 602, and the discharge of the printing paper having been subjected to the printing by the ink-jet head 602. The control unit 608 includes, for example, CPU (Central Processing Unit) which serves as a computing processing unit, ROM (Read-Only Memory) in which programs to be executed by CPU and data to be used for the programs are stored, RAM (Random Access Memory) which temporarily stores data during the execution of the program, a nonvolatile memory such as rewritable EEPROM (Electrically Erasable Programmable Read-Only Memory), an input/output interface, and a bus. As shown in FIG. 37, the control unit 608 controls a variety of devices for constructing the multifunction device 601 including, for example, the ink-jet head 602, the motor of the transport mechanism 106 for driving the carriage 605, and the suction pump 670 of the purge unit 607, on the basis of various signals inputted from an external personal computer (PC) 682.

As shown in FIG. 37, the control unit 608 further includes an installation state-judging section 680 which judges the installation state of the ink cartridge 603 in the holder 604 on the basis of the output signal from the sensor 614, and an ink residual amount-calculating section 681 which calculates the residual amount of the ink contained in the ink chamber 631.

Figure 47:
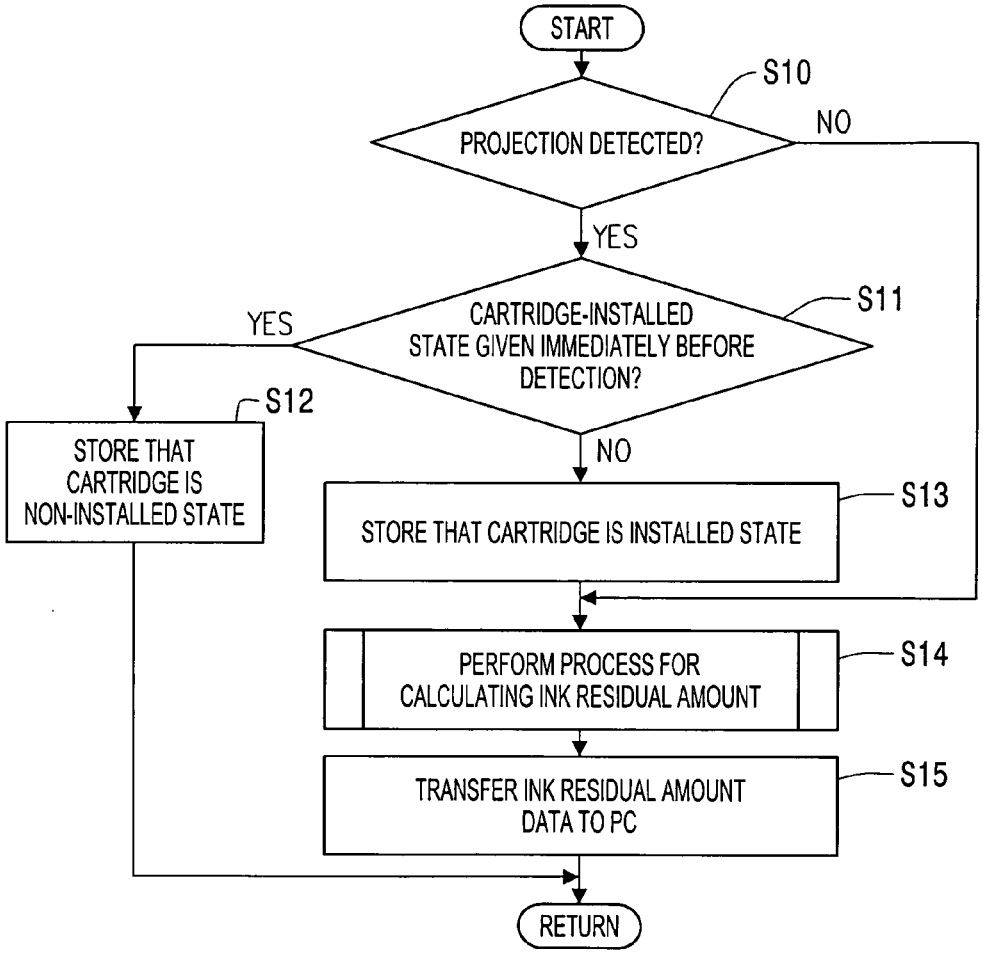
FIG. 47 is a flow chart illustrating an installation state-judging process upon attachment/detachment of the ink cartridge in FIG. 37.

An explanation will be made below about the processing steps of the installation state-judging section 680 and the ink residual amount-calculating section 681 with reference to a flow chart for the installation state-judging process shown in FIG. 47. In FIG. 47, Si (i=10, 11, 12, . . . ) indicates each of the steps of the processing operation. This flow chart illustrates, by way of example, the processing steps to be applied when the ink cartridge 603*d* for storing the black ink is installed to the holder 604*d*.

At first, if it is judged that the rib 666 provided for the cap 624 is not detected by the sensor 614 in the judging process of S10 (in the case of "No" of the judgment result of S10) in a state in which the power source is applied to the multifunction device 601, the routine proceeds to the ink residual amount-calculating process of S14. On the other hand, if it is judged that the rib 666 is detected by the sensor 614 in the judging process of S10 (in the case of "Yes" of the judgment result of S10), the routine proceeds to the judging process of S11. In the judging process of S11, it is judged whether or not the cartridge has been installed immediately before the detection of the rib 666. If the ink cartridge 603*d* has been installed to the holder 604*d* immediately before the detection of the rib 666 (in the case of "Yes" of the judgment result of S11), then it is judged that the ink cartridge 603*d* has been detached from the holder 604*d*, and the information, which corresponds to the fact that the ink cartridge 603*d* is in the non-installed state, is stored (S12). In this case, it is unnecessary to calculate the ink residual amount. Therefore, the routine is subjected to the return as it is.

If the ink cartridge 603*d* has not been installed immediately before the detection of the rib 666 in the judging process of S11 (in the case of "No" of the judgment result of S11), the rib 666 of the ink cartridge 603*d* shown in FIG. 39 is consequently detected by installing the ink cartridge 603*d* to the holder 604*d*. Therefore, the information, which corresponds to the fact that the ink cartridge 603*d* is in the installed state, is stored (S13). After that, the routine proceeds to the ink residual amount-calculating process of S14.

In the ink residual amount-calculating process of S14, if the shield plate 660 of the shutter mechanism 623 is detected (if the ink residual amount is sufficient), the ink residual amount is approximately calculated from the maximum capacity of the ink cartridge 603*d* and the accumulated value of the number of liquid droplets of the ink having been discharged after the point of time of installation of the ink cartridge 603*d*. On the other hand, if the shield plate 660 of the shutter mechanism 623 is not detected (if the ink residual amount is decreased), the ink residual amount is calculated more correctly from the ink residual amount obtained in a state in which the shield plate 660 is not detected and the accumulated value of the number of liquid droplets of the ink having been discharged after the arrival at the state described above. The ink residual amount, which is calculated in S14, is transferred to PC 682 (S15), and the routine is subjected to the return.

The information, which includes, for example, the installation state of the ink cartridge 603 and the accumulated value of the discharged ink, is stored in the nonvolatile memory such as EEPROM in order that the information is retained even in a state in which the power source of the multifunction device 601 is turned OFF.

The distance between the shield plate 660 and the inner wall surface 634*b* of the recess 634*a* formed in the exemplary ink chamber 631 is maintained by the pins 659 which are formed on the side surfaces of the shield plate 660 of the swinging member. In this situation, the distance, which is in such an extent that no capillary phenomenon is caused by the surface tension of the ink, is secured between the shield plate 660 and the inner wall surface 634*b*. It is possible to avoid the adhesion between the shield plate 660 and the inner wall surface 634*b* by the surface tension of the ink and the deterioration of the smooth motion of the displacement of the shield plate 660. That is, the ink surface, which intervenes between the shield plate 660 and the inner wall surface 634*b*, can be similarly lowered as well, as the ink surface is lowered in accordance with the consumption of the ink. No ink, which prohibits the displacement of the shield plate 660 by the surface tension of the ink, remains between the shield plate 660 and the inner wall surface 634*b*. Therefore, the exemplary shield plate 660 can be smoothly operated in accordance with the change of the ink residual amount. Therefore, it is possible to detect, with any small error, the fact that the ink residual amount in the ink chamber 631 arrives at the predetermined amount.

The swinging member (displaceable member) is supported so that the rotation can be made to some extent in the plane parallel to the sheet surface of FIG. 42. Therefore, it is feared that the shield plate 660, which is provided at the position separated from the point of support by the support stand 663, may approach the inner wall surface 634*b* too closely depending on the spacing distance between the shield plate 660 and the inner wall surface 634*b*. In order to solve this problem, the operation of the shield plate 660 can be smoothened without being affected by the surface tension of the ink by widening the spacing distance between the shield plate 660 and the inner wall surface 634*b*. However, in this case, it is necessary that the spacing distance between the light-emitting section 614*a* and the light-receiving section 614*b* of the sensor 614 is widened as well, which is any unsatisfactory countermeasure in view of the sensitivity of the sensor 614. It is necessary to use an expensive sensor having higher sensitivity depending on the spacing distance between the light-emitting section 614*a* and the light-receiving section 614*b*. However, the spacing distance between the shield plate 660 and the inner wall surface 634*b* is regulated to such an extent that the smooth motion of the shield plate 660 is not deteriorated by the surface tension of the ink, by the aid of the pins 659 which are formed on the side surfaces of the shield plate 660 of the swinging member. Therefore, it is possible to further shorten the distance between the shield plate 660 and the inner wall surface 634*b*. Simultaneously, it is also possible to narrow the width of the projection 634. Further, it is possible to further narrow the width of the projection 634, because the shield plate 660 is the thin plate-shaped member. Accordingly, the cheap light-transmissive type optical sensor having low sensitivity can be utilized as the sensor 614.

Additionally, the ribs 658, which extend in the vertical direction of the inner wall surfaces 634*b*, are formed on the inner wall surfaces 634*b* of the recess 634*a* in the exemplary ink chamber 631. Therefore, the ink, which is pooled between the shield plate 660 and the inner wall surface 634*b*, is successfully allowed to fall downwardly along the ribs 658. Accordingly, it is possible to further avoid the adhesion between the shield plate 660 and the inner wall surfaces 634*b* by the surface tension of the ink.

Further, the tips of the pins 659 formed on the side surfaces of the shield plate 660 of the exemplary swinging member are constructed by the curved surfaces. Therefore, the pins 659 make the point-to-point contact with the inner wall surfaces 634*b* of the recess 634*a* in the ink chamber 631. Therefore, even when any ink remains between the pins 659 and the inner wall surfaces 634*b*, it is possible to suppress the remaining amount minimally. That is, the pins 659 and the inner wall surfaces 634*b* are hardly adhered by the surface tension of the ink. As a result, it is possible to smoothly operate the shield plate 660 as the ink residual amount is changed. It is possible to detect, with any small error, the fact that the ink residual amount in the ink chamber 631 arrives at the predetermined amount.

The abutment section 660*a*, which is formed at the upper portion of the exemplary shield plate 660, is the columnar member. Therefore, the abutment section 660*a* and the abutment objective surfaces 656 in the ink chamber 631 make the line-to-line contact. Accordingly, the contact area between the abutment section 660*a* and the abutment objective surfaces 656 is decreased. Therefore, the abutment section 660*a* and the abutment objective surfaces 656 are hardly adhered by the surface tension of the ink. Therefore, it is possible to smoothly operate the shield plate 660 in accordance with the change of the ink residual amount. It is possible to detect, with any small error, the fact that the ink residual amount in the ink chamber 631 arrives at the predetermined amount.

The ink, which is pooled on the abutment objective surfaces 656 formed in the ink chamber 631, is sucked by the capillary force of the curved section formed at the boundary between the abutment objective surface 656 and the rib 657 formed over the abutment objective surface 656 and the perpendicular wall surface 669, and the ink falls downwardly along the rib 657. Therefore, the abutment section 660*a* and the abutment objective surface 656 are hardly adhered by the surface tension of the ink. Simultaneously, in a state in which the abutment section 660*a* abuts against the abutment objective surface 656, the tip of the abutment section 660*a* makes contact with the side surface of the rib 657. Therefore, the ink, which is retained between the abutment section 660*a* and the abutment objective surface 656, is also sucked by the capillary force of the curved section formed at the boundary between the abutment objective surface 656 and the rib 657. Therefore, the abutment section 660*a* can be easily separated from the abutment objective surface 656 at an appropriate timing depending on the lowering of the ink surface.

As shown in FIG. 44, an exemplary structure is provided, in which the curvatures are decreased in the order of the curvature of the curved section (C in FIG. 44C) formed at the boundary between the rib 657 and the lower end area of the perpendicular wall surface 669, the curvature of the curved section (B in FIG. 44B) formed at the boundary between the rib 657 and the upper end area of the perpendicular wall surface 669, and the curvature of the curved section (A in FIG. 44A) formed at the boundary between the rib 657 and the abutment objective surface 656. Accordingly, the capillary forces of the curved sections formed at the boundaries between the rib 657 and the abutment objective surface 656 and the perpendicular wall surface 669 are increased at the lower portions of the rib 657 positioned downwardly. The action is effected to move the ink more downwardly as a whole. That is, the ink, which is pooled in the vicinity of the boundary between the abutment objective surface 656 and the rib 657, tends to fall downwardly along the rib 657 with ease.

Additionally, the abutment objective surface 656 formed in the exemplary ink chamber 631 is the inclined surface. The ink, which is pooled on the abutment objective surface 656, falls and flows downwardly along the inclined surface. Therefore, the ink is more hardly pooled on the abutment objective surface 656.

Further, the connecting member 662 having the shield plate 660 is rotated, and thus the shield plate 660 is displaced. Therefore, the shield plate 660 can be displaced stably along the predetermined orbit. Therefore, the shield plate 660 is hardly adhered to the inner wall surface 634*b* which is disposed outside the predetermined orbit.

FIGS. 48-52 depict an exemplary multifunction device 701 and an exemplary ink cartridge 703 used therewith.

Figure 48:
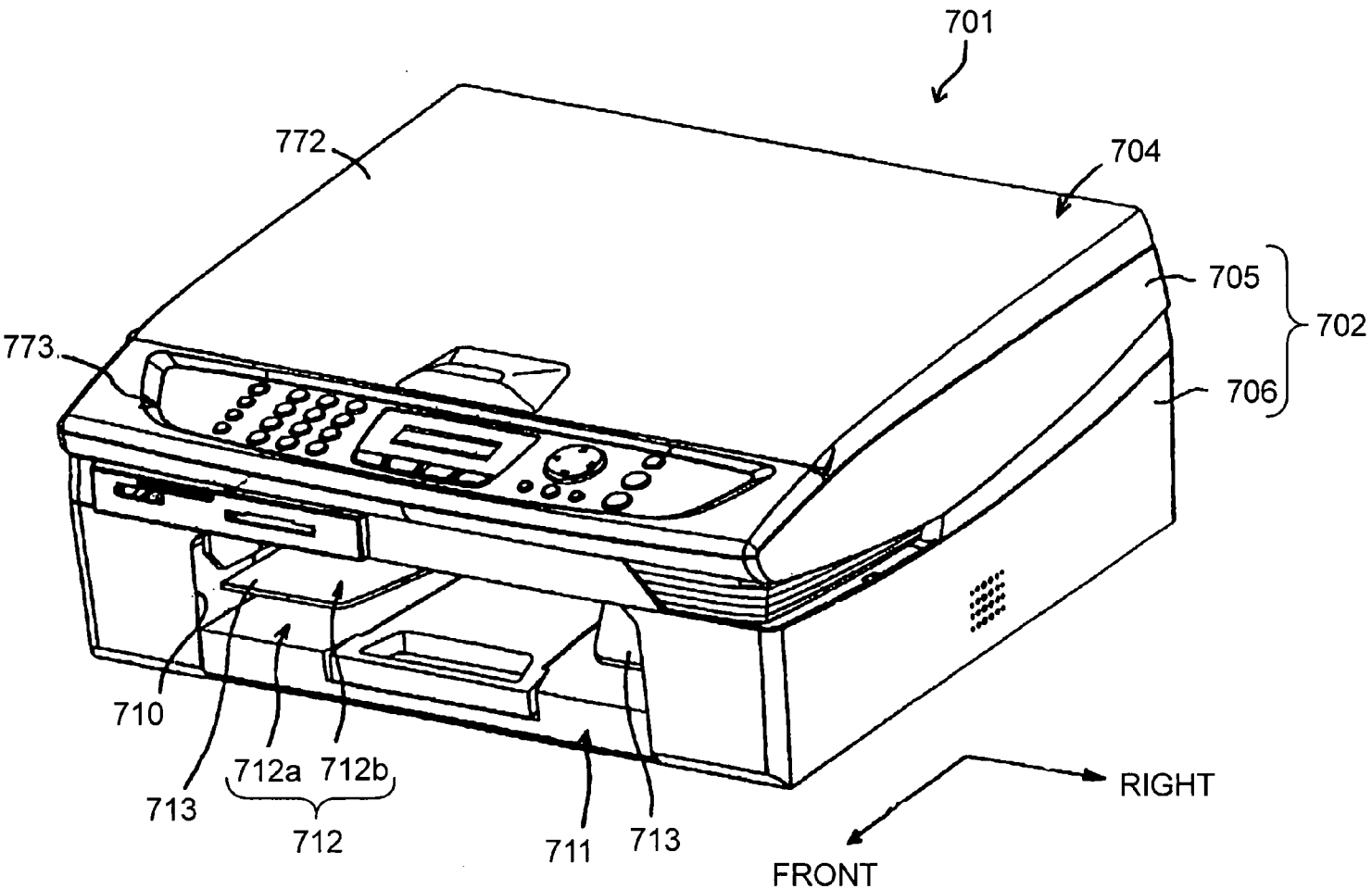
FIG. 48 is a perspective view of an exemplary multifunction device capable of being mounted with an exemplary ink cartridge.
Figure 49:
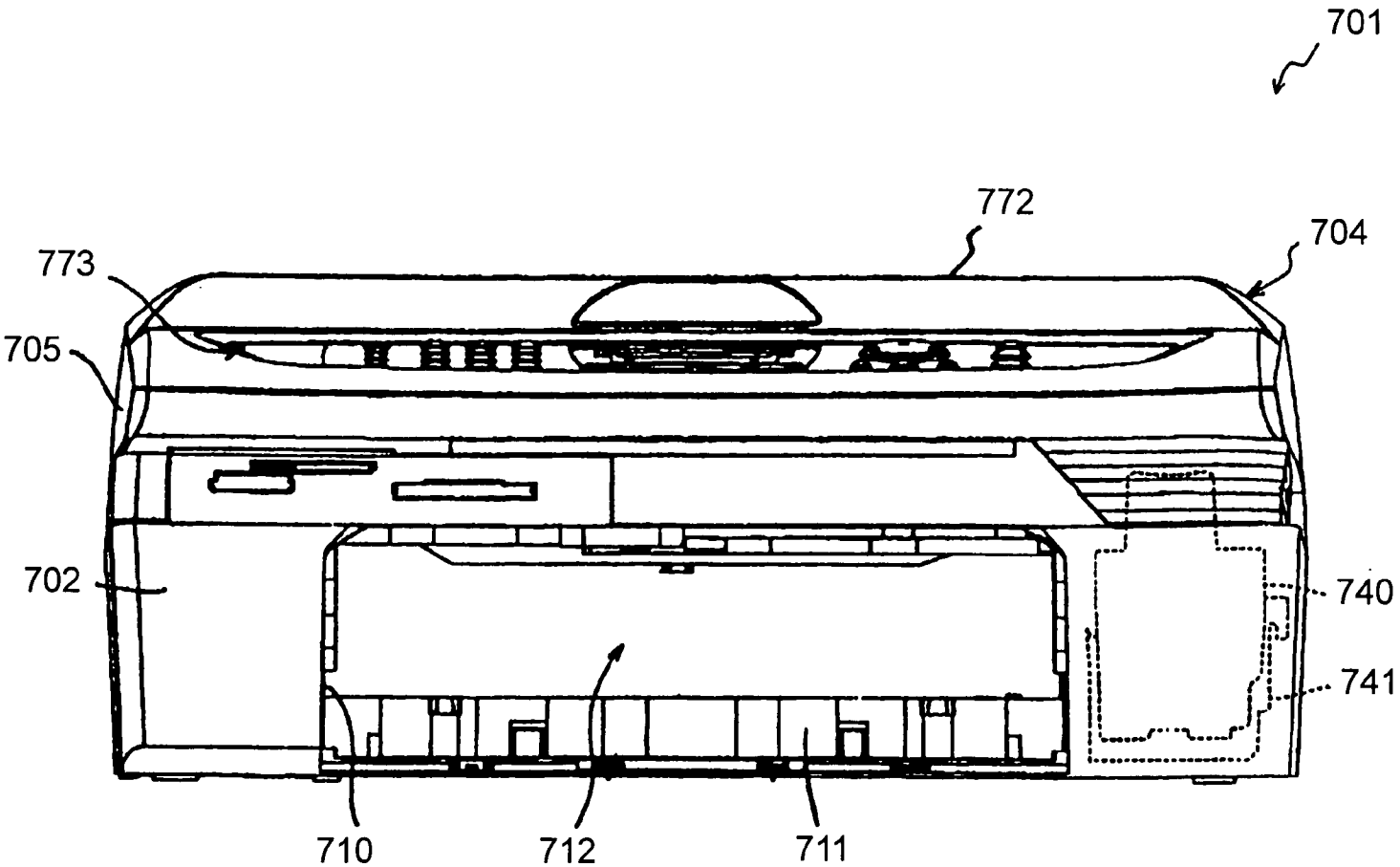
FIG. 49 is a front view of an exemplary multifunction device capable of being mounted with an exemplary ink cartridge.

As shown in FIGS. 48 and 49, the multifunction device 701 includes a main casing 702 having an upper frame 705, including a cover 772, and a lower frame 706. The lower frame 706 is formed in a substantially square shape in a plan view. A sheet accommodating section 710 is formed as a recess in the front bottom portion of the lower frame 706 and centered left-to-right, providing an arc-like front appearance to the lower frame 706. A conveying space 712 is defined inside the sheet accommodating section 710 for conveying a recording sheet P (e.g., paper) in the front-to-rear direction.

A sheet supply tray 711 for holding recording sheets P is detachably inserted into the sheet accommodating section 710 and is capable of moving in the front-to-rear direction within the conveying space 712. When accommodated in the sheet accommodating section 710, the sheet supply tray 711 blocks the bottom of the sheet accommodating section 710. In other words, by eliminating a bottom surface of the sheet accommodating section 710 and by configuring the sheet supply tray to serve as the bottom surface, it is possible to reduce the height of the lower frame 706. This construction also facilitates maintenance work for paper jams and the like since the bottom of the lower frame 706 can be opened simply by removing the sheet supply tray from the sheet accommodating section 710.

Guide pieces 713 formed in arch shapes are disposed near the front part of the sheet supply tray 711 to extend from the left and right edges of the sheet accommodating section 710 to cover the top of the recording sheet P loaded in the sheet supply tray 711. The guide pieces 713 determine the left-to-right position of the recording sheet P on the sheet supply tray 711. The guide pieces 713 also function as a discharge tray. After an image is formed on the recording sheet P in a recording unit 21, the recording sheet P is discharged forward onto the top surfaces of the guide pieces 713. Hence, the guide pieces 713 divide the conveying space 712 into a lower supply space 712*a* for supplying the recording sheet P and an upper discharge space 712*b* for discharging the recording sheet P. Note that the guide pieces have been omitted from FIGS. 49-51.

Figure 50:
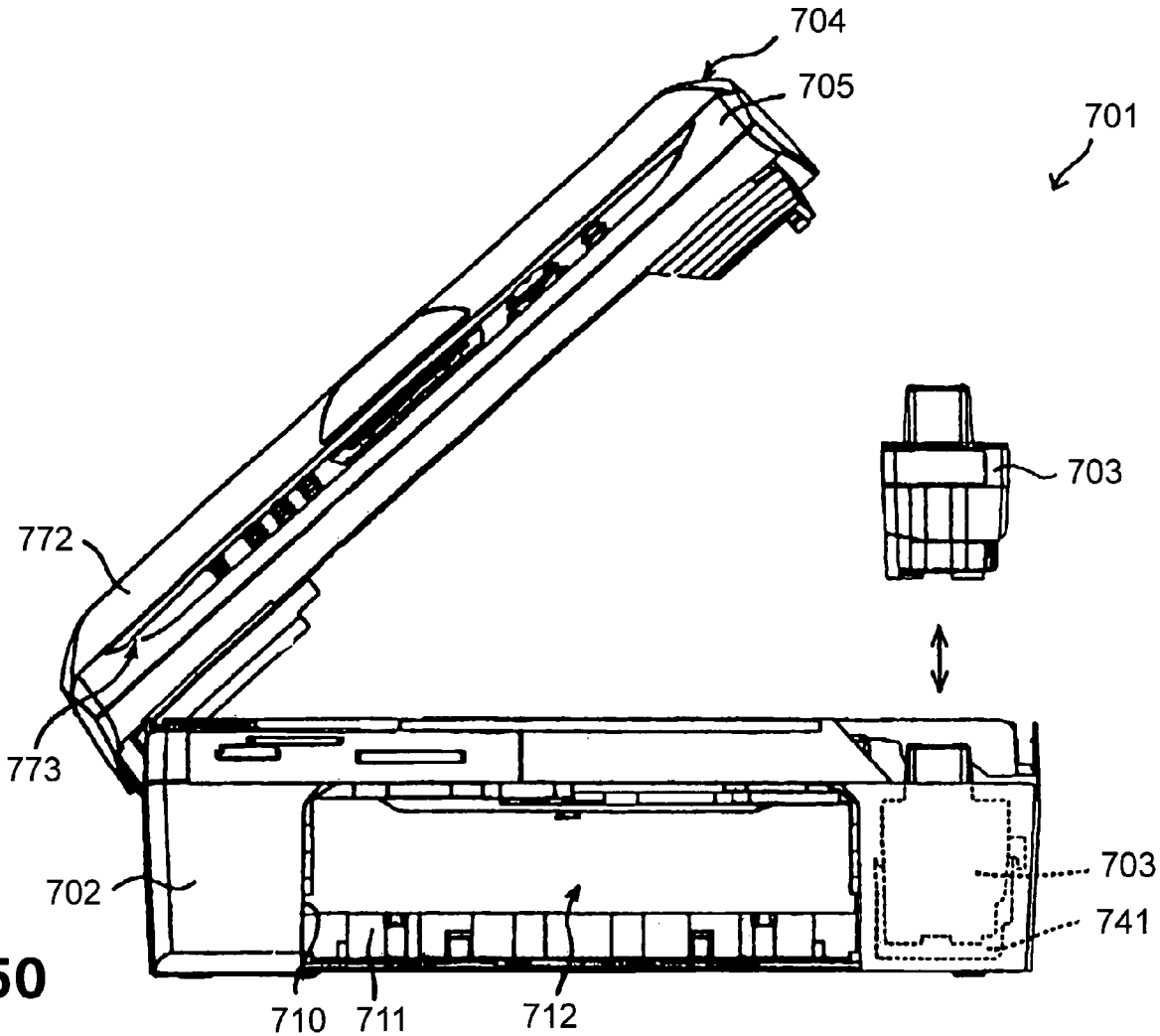
FIG. 50 is a front view of an exemplary multifunction device with cover open and an exemplary ink cartridge.
Figure 51:
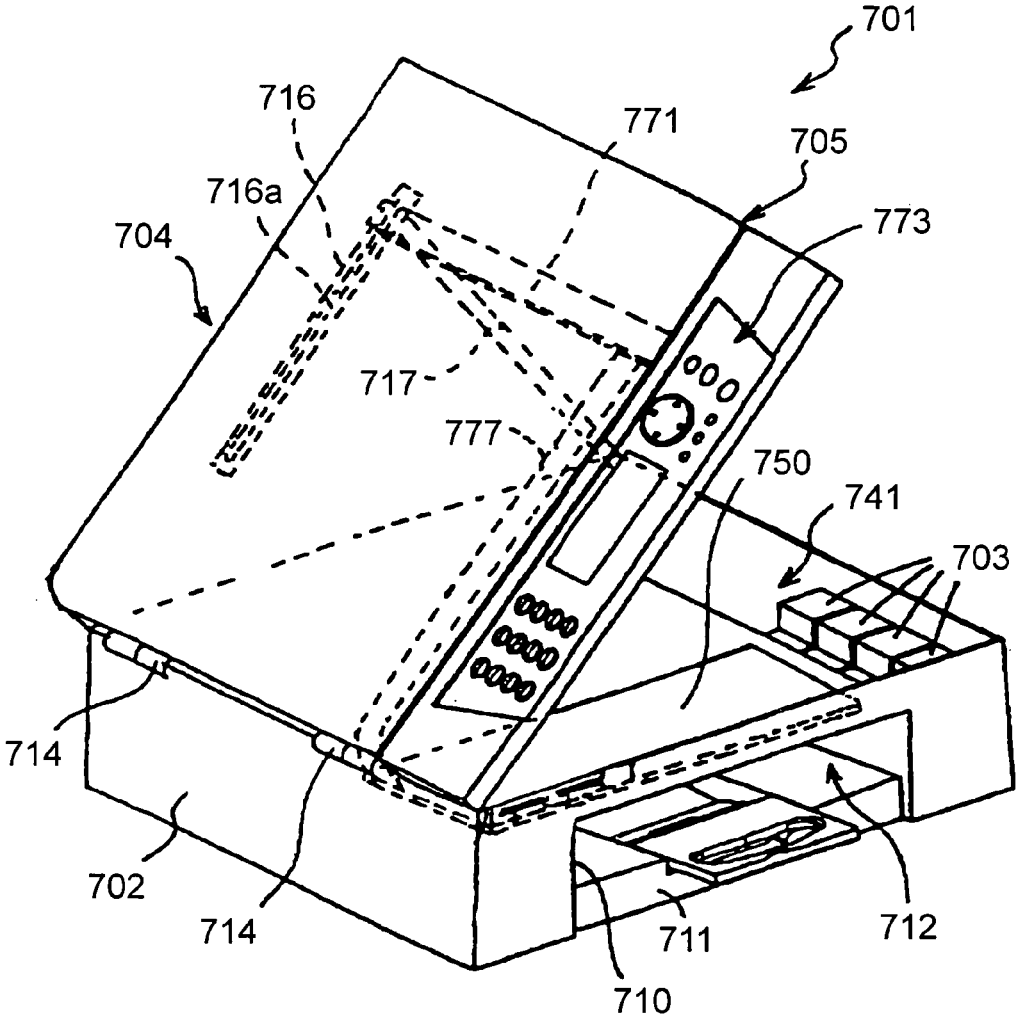
FIG. 51 is a perspective view of an exemplary multifunction device with cover open mounted with exemplary ink cartridges.

As illustrated in FIGS. 50 and 51, four ink cartridges 703, each accommodating one of four colors (e.g., yellow, magenta, cyan and black), are inserted into a cartridge holder 741 in the multifunction device 701 from above and are aligned in the multifunction device 701 in a front-to-rear direction. The ink cartridges 703 are connected to and supply ink to an inkjet head (not shown), e.g., via flexible tubes. While the ink cartridges 703 in this embodiment accommodate the four colors black, cyan, magenta and yellow, the ink cartridges 703, of course, may accommodate ink for more or different colors.

As shown in FIG. 51, the upper frame 705 is pivotably supported on the left edge of the lower frame 706 via shafts 714, such as hinges. In other words, when viewed from the front of the multifunction device 701, the upper frame 705 can pivot open sideways about the side edge opposite the position of the cartridge holder 741. Pivoting the upper frame 705 in this way reliably reveals the top of the cartridge holder 741, enabling ink cartridges 703 to be easily mounted into the cartridge holder 741 from above.

A guide rail 716 extending in the left-to-right direction is fixed to the bottom surface of the upper frame 705 in the rear portion of the upper frame 705. The guide rail 716 is formed with a guide groove 716*a* extending left-to-right. A support rod 717 is pivotably attached to the lower frame 706 so as to be able to pivot about its lower right end. A guide pin 717*a* is provided on the free end of the support rod 717. The guide pin 717*a* is slidably engaged with the guide groove 716*a*. By sliding the guide pin 717*a* in the guide groove 716*a* until the guide pin 717*a* is fitted into an engaging part (not shown) formed in the right end of the guide groove 716*a* (the end opposite the pivotal axis of the upper frame 705, which extends in the front-to-rear direction), the support rod 717 supports the upper frame 705 in an open state. With this construction, the upper frame 705 can be maintained in an open state with respect to the lower frame 706.

The means for holding the upper frame 705 open with respect to the lower frame 706 may include arcuate guard rails disposed near the shafts 714 and guide pins that are guided by these rails. In addition to this, urging means may be provided for urging the upper frame 705 upward in order to maintain the upper frame 705 in the open state.

With this construction, the top surface of the lower frame 706 can be opened wide, improving visibility and facilitating such operations as maintenance of an inkjet head and the like, clearing of paper jams along the conveying path, and replacing the ink cartridges 703.

As shown in FIG. 51, a control panel 773 is disposed in the front area on top of the upper frame 705, and a scanner 704 is disposed in the area behind the control panel 773. The control panel 773 includes various buttons, such as the numerical buttons 0-9, a start button, and function buttons that can be pressed to perform various operations. The control panel 773 may also be provided with a display portion, such as a liquid crystal display, for displaying settings for the multifunctional device 701, messages, or the like according to need. A scanner 704 functions to scan images from a facsimile original to be transmitted to another facsimile device when using the facsimile function, or images of an original to be copied when using the copier function.

As shown in FIG. 51, a flexible wiring member 777, such as a flexible flat cable, connects the scanning unit 771 to the main control board 750. Here, the main control board 750 extends to a point near the pivotal axis of the upper frame 705 (the left edge of the lower frame 706), while the wiring member 777 extends from a portion of the main control board 750 near the pivotal axis of the upper frame to the scanning unit 771.

FIG. 52 shows the ink cartridge 703 and the cartridge holder 741 prior to installation of the ink cartridge 703 into the cartridge holder 741 of the multifunction device 701. Various exemplary structural features of the ink cartridge 703 and cartridge holder 741 are shown, though it should be appreciated that a functional combination of ink cartridge 703 and cartridge holder 741 can be achieved with fewer than all of the features depicted in FIG. 52.

The ink cartridge 703 generally includes an ink chamber 731 for storing ink, an ink supply valve assembly 740 through which ink is provided to an inkjet head of the multifunction device 701, and an air intake valve assembly 751 through which atmospheric air is provided to the ink chamber 731. The ink supply valve assembly 740 includes a supply valve seat 742, a supply valve member 745 and a check valve 733. The supply valve seat 742 includes a receiving portion 742A. The air intake valve assembly 751 includes an intake valve seat 752 and an intake valve member 755. The intake valve member 755 includes an intake valve 757, a cylindrical part 756 and an operating member 756A. The intake valve seat 752 further includes a sealing lip 753.

The ink chamber 731 includes an air intake pipe 738 and a shutter mechanism 732. The air intake pipe 738 includes a tapered portion 739, where the air intake valve assembly 751 interfaces with the air intake pipe 738. The shutter mechanism 732 includes a shield plate 732A. Operation of an exemplary shutter mechanism is described above, with reference to FIGS. 40-43. When the ink chamber 731 is at least partially full of ink, the shield plate 732A of the shutter mechanism 732 is positioned in a recess of the ink chamber 731 defined by a protruding portion 769 of the body of the ink cartridge 703. Though partially unviewable in the cross section view of FIGS. 52 and 53, the protruding portion includes opposing protrusion walls 769A and 769B in front and behind the shield plate 732A, as shown in FIGS. 52 and 53.

The cartridge holder 741 includes a bottom wall 775 having a lower portion 776 and an upper portion 777. The lower portion 776 is provided with an ink extraction tube 781. The upper portion 777 is provided with receiving surface 785 and an air aperture 786. The upper portion 777 is situated above an atmospheric air chamber 795. The cartridge holder 741 is further provided with a recess 767, shown in dotted lines in FIGS. 52 and 53 as the defining surfaces of the recess 767 are provided slightly in front and slightly behind the cross section shown in FIGS. 52 and 53. The recess 767 includes a light-emitting section 767A opposed to a light receiving section 767B constituting a sensor. Operation of an exemplary sensor is described above, for example with reference to FIG. 40.

Figure 53:
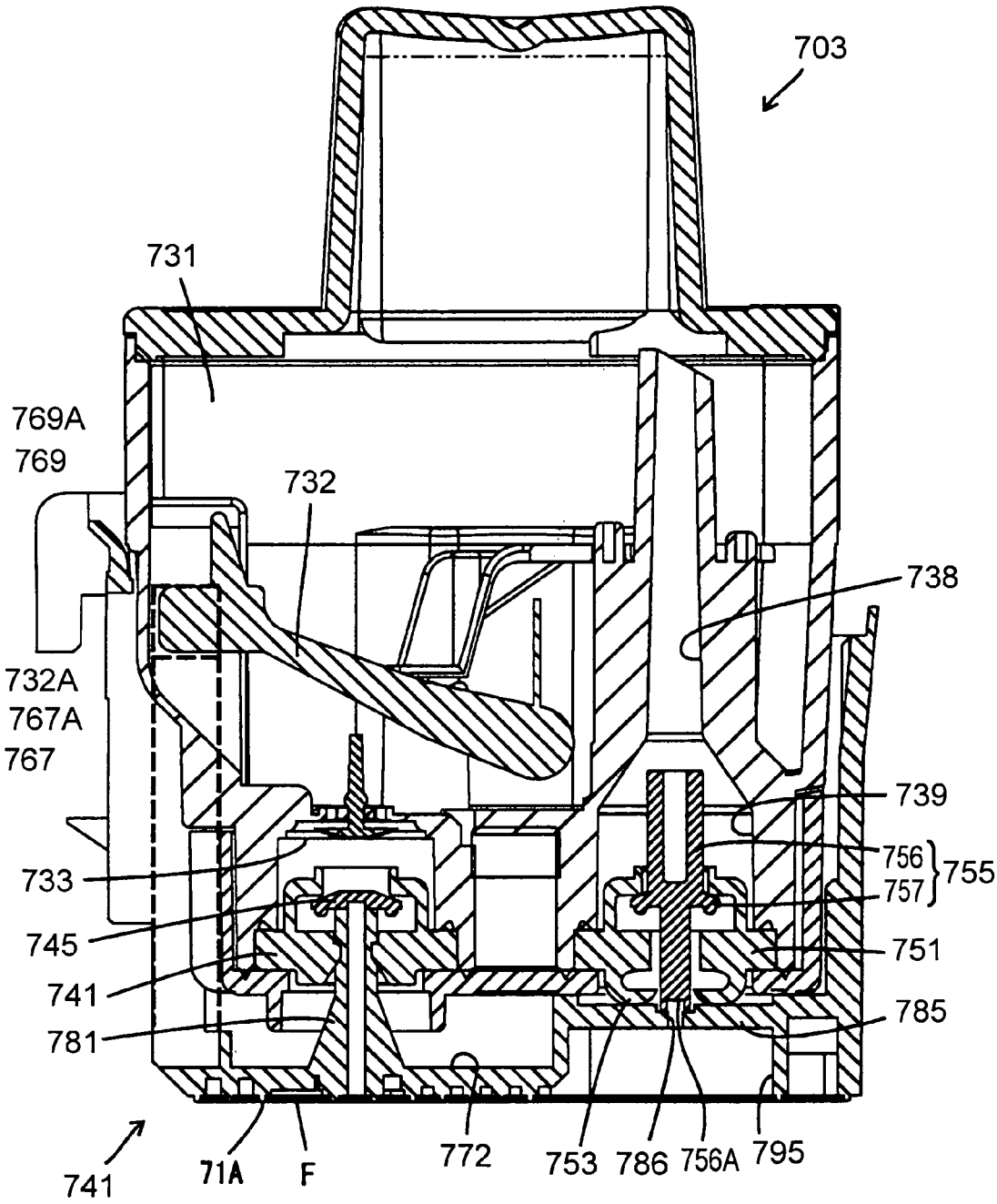
FIG. 53 is a cross-sectional view of an exemplary ink cartridge mounted in a cartridge mounting portion of an exemplary multifunction device.

Engagement of the ink cartridge 703 and cartridge holder 741 is shown in FIG. 53. When the ink cartridge 703 is inserted into the cartridge holder 741, several respective portions of the ink cartridge 703 and the cartridge holder 741 are engaged. As the ink cartridge 703 is pressed into the cartridge holder 741, the ink extraction tube 781 contacts the receiving portion 742A of the supply valve seat 742. This contact causes the supply valve member 745 to open, allowing ink to flow from the ink chamber 731 into the extraction tube 781 and toward an inkjet head. The operating member 756A contacts the air aperture 786, causing the intake valve member 755 to open, allowing atmospheric air to flow from the atmospheric air chamber 795 to the ink chamber 731. Simultaneously, the sealing lip 753 contacts the receiving surface 785, forming a seal around the engaged operating member 756A and air aperture 786. Upon insertion of the ink cartridge 703 into the cartridge holder 741, the protruding portion 769 of the ink cartridge 703 is positioned in the recess 767, such that the light-emitting section 767A and the light receiving section 767B can operate to detect the presence or absence of the shield plate 732A in the protruding portion 769.

It should be appreciated that the ink cartridge 703 can include any type of opening (e.g., in an elastic member) that can sealingly grip the ink extraction tube 781, instead of the more complex ink supply valve member 740, described herein. Moreover, the air intake valve assembly 731 can be replaced by a mere opening in the ink cartridge 703 (e.g., at the top) that permits entry of atmospheric air when ink is discharged. The cartridge holder 741 can further include means for holding the ink cartridge 703 in place. For example, the cartridge holder 741 can include an arm that grips a portion (e.g., an indentation) in a surface, such as the top surface, of the ink cartridge 703.

The presence and position of the protruding portion 769 on the ink cartridge 703 provide several advantages. As the opening (including the ink supply valve assembly 740), through which ink is provided from the cartridge 703 to the multifunction device 701, is situated at one side of the bottom surface of the ink cartridge 703, and the ink extraction tube 781, through which ink is provided to an inkjet head, is provided at one side of the bottom wall 775 the cartridge holder 741, it is essential to operation of the multifunction device 701 that the ink cartridge 701 be installed so that the ink supply valve assembly 740 opposes the ink extraction tube 781. The engagement of the protruding portion 769 with the recess 767 prevents improper installation because the protruding portion 769 cannot be inserted into the cartridge holder 741 unless the protruding portion 769 is in a position corresponding to the recess 767. A similar benefit is achieved with respect to the correspondence between the protrusion portion 372 and the infrared light emitting portion 172 in the embodiment shown, for example, in FIG. 35.

Further, because upon engagement of the ink cartridge 703 and cartridge holder 741, the protruding portion 769 of the ink cartridge 703 is positioned in the recess 767, such that the light-emitting section 767A and the light receiving section 767B operate to detect the presence or absence of the shield plate 732A in the protruding portion 769, it is possible to manufacture a multifunction device 701 of slimmer profile. That is, if the light-emitting section 767A and the light receiving section 767B could not be positioned in opposition on opposite sides of the protruding portion 769, those parts would have to be positioned on opposite sides of the ink cartridge 703. Such positioning would require greater space for each ink cartridge 703 in the multifunction device 701, and further would prevent the positioning of multiple ink cartridges 703 in close proximity. Each of these considerations would prohibit design of a compact multifunction device 701.

It is preferable that the ink cartridge 703 include a shutter mechanism 732 having a shield plate 732A that is positioned in a recess of the ink chamber 731 defined by protruding portion 769 of the ink cartridge 703 when the ink chamber 731 is at least partially full of ink. Such an arrangement allows operation of the sensor (the light-emitting section 767A and the light receiving section 767B) to ensure that ink is present in the ink cartridge 703 for printing. However, for certain reasons (e.g., cost, ease of manufacture, etc.) it may be desirable to manufacture an ink cartridge that does not include a shutter mechanism.

The shutter mechanism 732 in the cartridge 703 shown, for example, in FIGS. 52 and 53, is effective because the shield plate 732A, when positioned in the protruding portion 769, prevents light emitted by the light-emitting section 767A from being detected by the light receiving section 767B. It is possible, however, to alter the ink cartridge 703 so that the cartridge does not include a shutter mechanism 732, but light emitted by the light emitting section 767A is prevented from being detected by the light receiving section 767B.

Figure 54C:
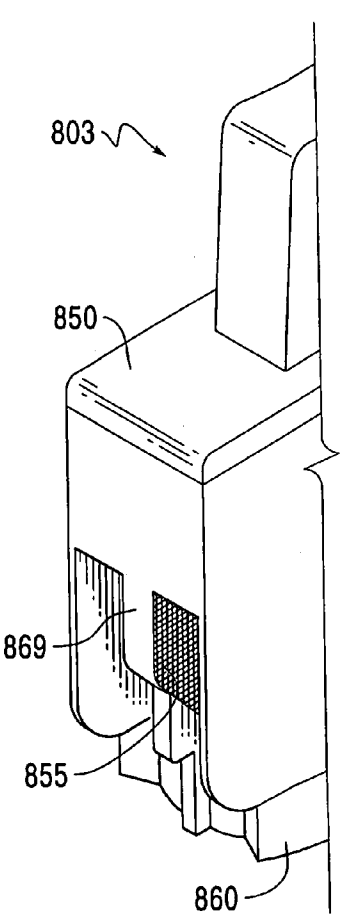
FIGS. 54A-54E are perspective views of exemplary cartridges.
Figure 54B:
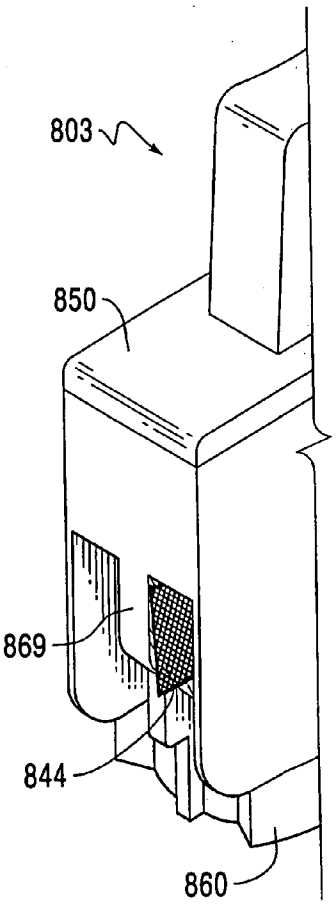
Figure 54A:
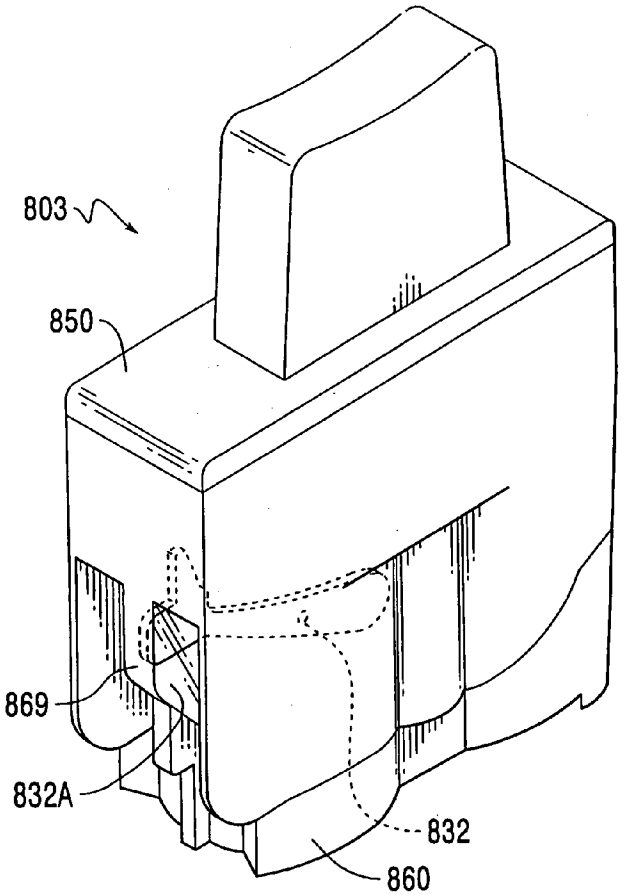

FIGS. 54A-54E show several cartridge designs that prevent light emitted by a light-emitting section from being detected by a light receiving section. In FIG. 54A, an ink cartridge 803 having a top cover 850 and a bottom cover 860 is provided with a shutter mechanism 832 having a shield plate 832A. The cartridge further includes a protruding portion 869 formed of a material that is transmissive of light. The shield plate 832A is not transmissive of light, and is positioned inside of the protruding portion 869. Accordingly, if light emitted by a light-emitting section positioned on one side of the protruding portion 869 is directed toward a light receiving section on an opposite side of the protruding portion 869, the light will be blocked by the shield plate 832A, and thus not received by the light receiving section. The configuration shown in FIG. 54A is preferred, and corresponds to the configuration shown, for example, in FIGS. 52 and 53.

In FIG. 54B, the protruding portion 869 is provided with a light-blocking member 844 on an exterior surface. The light-blocking member 844 is positioned on the protruding portion 869 so that light emitted by a light-emitting section positioned on one side of the protruding portion 869 directed toward a light receiving section on an opposite side of the protruding portion 869 is blocked by the light-blocking member 844. The form of the light-blocking member 844 is not particularly limited. For example, the light blocking member 844 can be a sticker formed of a light-blocking material that is adhered to the protruding portion 869. Such a sticker could be affixed to one or more sides of the protruding portion 869, so long as it is positioned in a manner that will prevent light emitted by the light-emitting section from reaching the light receiving section. The light-blocking member 869 should be of a profile, however, that allows the ink cartridge 869 to be inserted into a cartridge holder of a multifunction device.

In FIG. 54C, the protruding portion 869, itself, includes a light-blocking portion 855. The light-blocking portion 855 is a contiguous part of the cartridge 869 that has light-blocking properties. For example, at least a portion of the protruding portion 869 can be formed of a light-blocking resin, that part being the light-blocking portion 855. The material forming the light-blocking portion 855 is not particularly limited. The light-blocking portion 855 should be positioned, however, in a manner that will prevent light emitted by the light-emitting section from reaching the light receiving section. In alternative embodiments, the entire protruding portion 869 or the entire cartridge 803 can constitute the light-blocking portion 855—that is, some or all of the cartridge 803 can be formed of a material that prevents transmission of light. Also, the protruding portion 869 need not be shaped or configured as shown in FIGS. 54A-54C, so long as at least some light-blocking portion 855 extends from the cartridge into a position that will prevent light emitted by the light-emitting section from reaching the light receiving section.

Figure 54E:
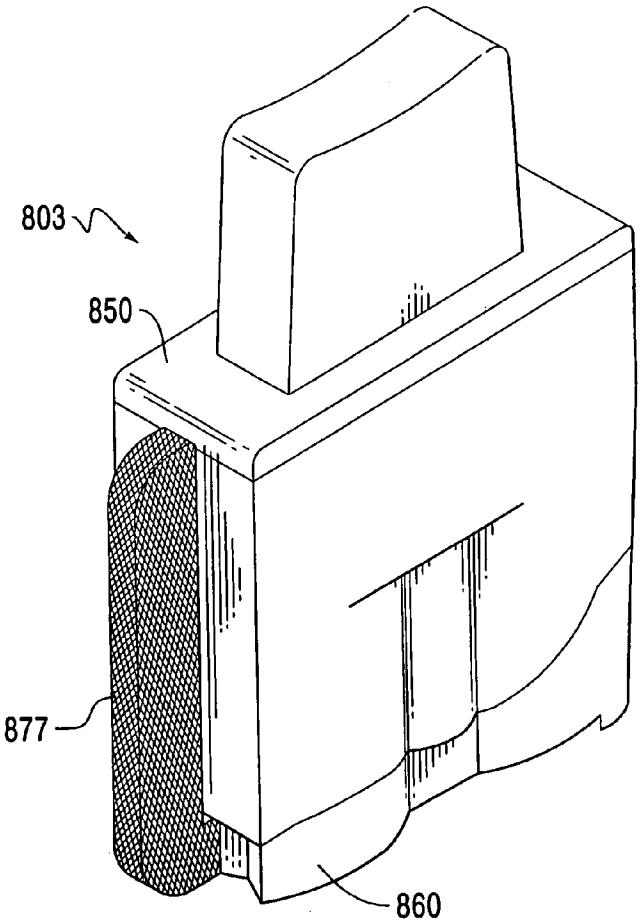
Figure 54D:
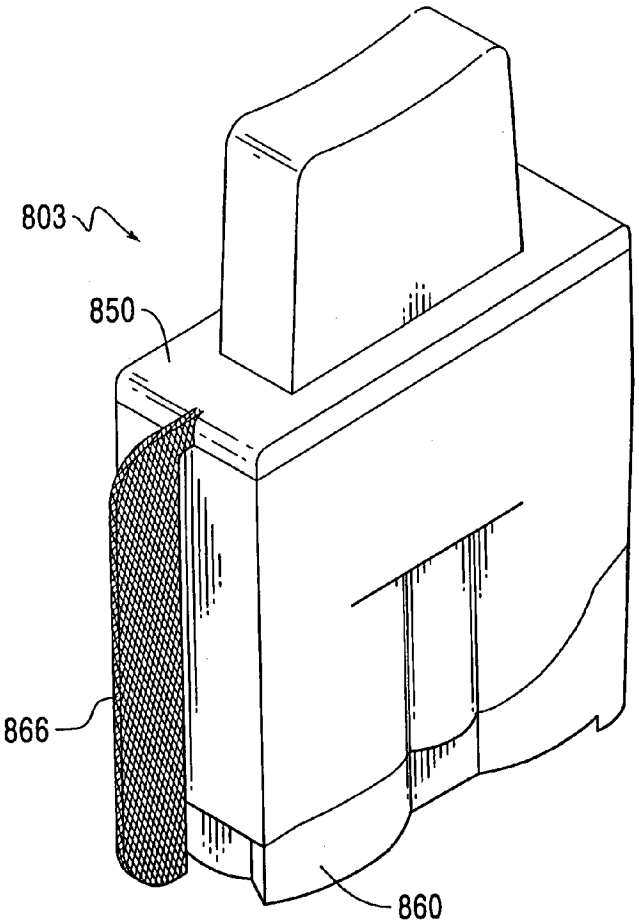

In FIGS. 54D and 54E, the ink cartridge 803 does not include a protruding portion 869, as in FIGS. 54A-54C. In FIG. 54D, the ink cartridge 803 is provided with a light-blocking member 866 that extends from the top cover 850. The light-blocking member 866 extends from the top cover 850 in a configuration that places at least part of the light-blocking member 866 between a light-emitting section and a light receiving section of an image forming device. As a result, light emitted by the light-emitting section is prevented from reaching the light receiving section by the light-blocking member 866. In FIG. 54E, the ink cartridge 803 is provided with a light-blocking member 877 that extends from the bottom cover 860. As with the light-blocking member 866 in FIG. 54D, the light-blocking member 877 of FIG. 54D extends from the bottom cover 860 in a configuration that places at least part of the light-blocking member 877 between a light-emitting section and a light receiving section of an image forming device. As a result, light emitted by the light-emitting section is prevented from reaching the light receiving section by the light-blocking member 877.

The light-blocking member 866 in FIG. 54D is substantially planar—that is, it has a slim profile. By contrast, the light-blocking member 877 in FIG. 54E has a thicker profile, similar in width to the protruding portions 869 shown in FIGS. 54A-54C. It should be appreciated that the light-blocking members 866 and 877 can have any suitable size or configuration, so long as at least a part of the light-blocking members 866 and 877 is positioned between a light-emitting section and a light receiving section of an image forming device. Moreover, in the embodiments shown in FIGS. 54A-54E, the light blocking means are provided as a contiguous part of an ink cartridge. It should be appreciated that an ink cartridge can be provided with a separate piece or pieces that function as light blocking means. The light blocking means shown in FIGS. 54A-54E appear as solid, apparently rigid members. It is also possible that light blocking means could be provided that are flexible and/or an assembly of a plurality of elements.

It should be appreciated that the configurations shown in FIGS. 54B-54E are equally applicable to cartridges of different design. These configurations can be applied, for example, to cartridges, such as shown in FIGS. 12, 13, etc. Also, while this invention contemplates the use of configurations as shown in FIGS. 54B-54E, these configurations undermine the various purposes of the ink detection systems described herein, so manual monitoring of ink levels is necessary when using such configurations. If an empty cartridge (a cartridge with little or no ink) including the light-blocking means shown in FIGS. 54B-54E is used in a printer or multifunction device, operation could result in introduction of air into a printhead, temporarily or permanently stopping function of the printer or multifunction device.

Figure 55:
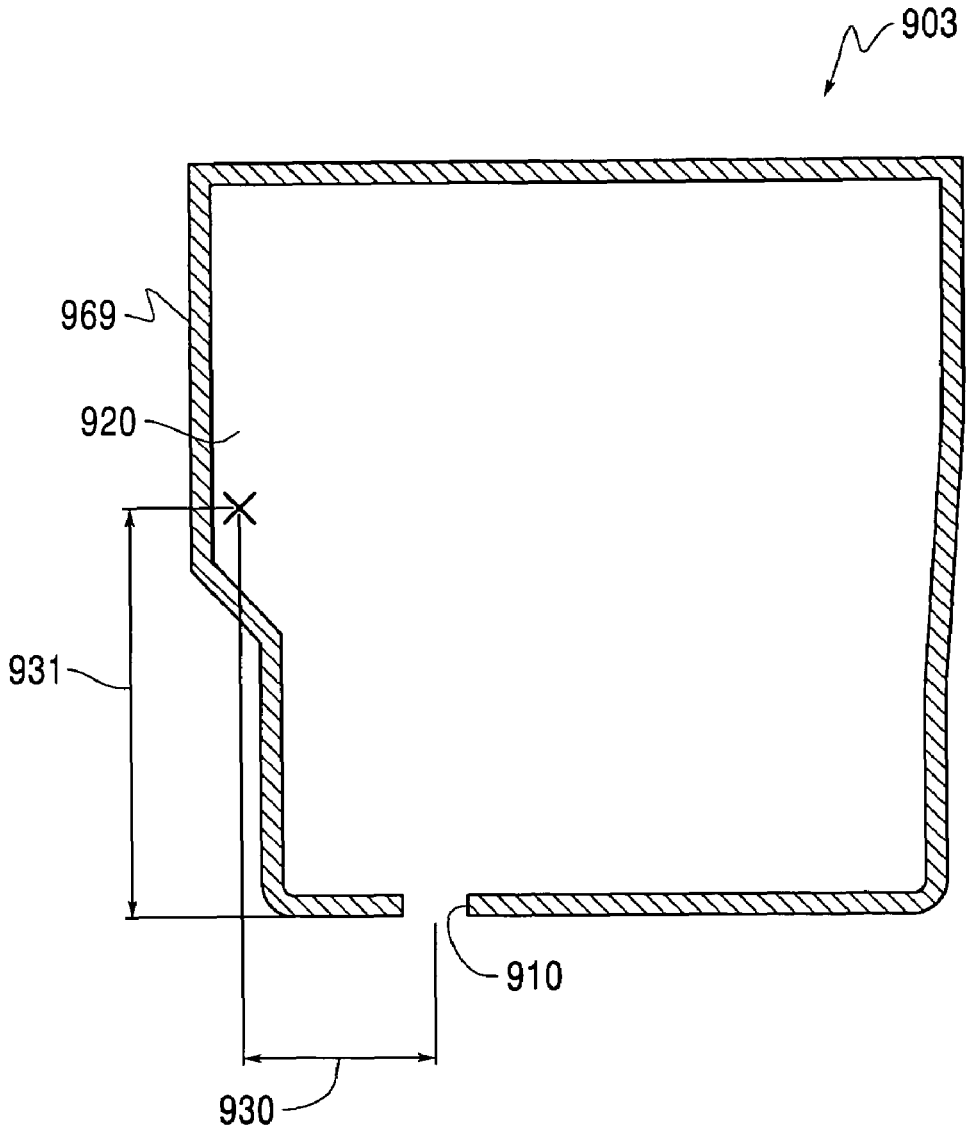

As discussed above, the location of light-blocking means, such as shown in FIGS. 54A-54E, must positioned so that the light-blocking means prevent light emitted by a light-emitting section from reaching a light receiving section. FIG. 55 illustrates this position with reference to the position at which ink is dispensed from a cartridge. FIG. 55 shows an ink cartridge 903 including an ink supply opening 910 and a protruding portion 969. A light-blocking mechanism 920 is provided on or in the protruding portion 969 in a position that prevents light emitted by a light-emitting section from reaching a light receiving section. The light-blocking mechanism 920 can be any suitable mechanism such as, for example the shield plate 832A of FIG. 54A, the light-blocking member 844 of FIG. 54B, the light-blocking portion 855 of FIG. 54C, the light-blocking member 866 of FIG. 54D, or the light-blocking member 877 of FIG. 54E. A lateral distance 930 between the ink supply opening 910 and the light-blocking mechanism 920 is fixed, because the locations of sensors and ink interfaces in multifunction devices are fixed. The lateral distance 930 can be from about 10.2 mm to about 13.2 mm, from about 11.2 to about 12.2 mm, about 11.7 mm, or 11.7 mm. The ranges and specific values provided for the lateral distance 930 are particularly desirable because they allow for compact design of both the ink cartridge 903 and the printer or multifunction device in which the cartridge 903 is employed. The vertical distance 931 can be from about 23.7 mm to about 26.7 mm, from about 24.7 mm to about 25.7 mm, about 25.2 mm or 25.2 mm.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An ink cartridge, comprising:

a first side wall;

a second side wall opposite from the first side wall;

a front wall;

a back wall opposite from the front wall;

a bottom wall;

a top wall opposite from the bottom wall; and an ink chamber formed in a space enclosed by the first side wall, the second side wall, the front wall, the back wall, the bottom wall and the top wall;

wherein:

the bottom wall includes an ink supply opening through which ink may be supplied to a print head;

a protruding region of the ink cartridge protrudes outwardly from the first side wall; and at least one portion of the protruding region is capable of preventing light from passing through the at least one portion in a direction from a front wall side of the protruding region to a back wall side of the protruding region, at least when the ink cartridge contains a predetermined amount of ink.

2. The ink cartridge of claim 1, wherein the top wall is a cover.

3. The ink cartridge of claim 2, wherein the cover includes a holding portion.

4. The ink cartridge of claim 3, wherein the holding portion protrudes upwardly from the cover.

5. The ink cartridge of claim 1, wherein the ink supply opening communicates with a valve assembly.

6. The ink cartridge of claim 5, wherein the valve assembly is configured so as to permit ink to be supplied from an interior of the ink chamber to an exterior of the ink chamber when the valve is in communication with an extraction element in an image forming device.

7. The ink cartridge of claim 1, wherein the ink chamber is provided with an air flow opening, through which air may be supplied from an exterior of the ink chamber to an interior of the ink chamber.

8. The ink cartridge of claim 7, wherein the air flow opening is provided in the bottom wall.

9. The ink cartridge of claim 8, wherein the ink supply opening is positioned between the first side wall and the air flow opening.

10. The ink cartridge of claim 7, wherein the air flow opening is provided in the top wall.

11. The ink cartridge of claim 1, wherein the protruding region forms a channel that communicates with an interior of the ink chamber.

12. The ink cartridge of claim 11, wherein the at least one portion is positioned in the channel.

13. The ink cartridge of claim 12, wherein the at least one portion is moveable between a position in the channel and a position outside of the channel.

14. The ink cartridge of claim 1, wherein the at least one portion is provided on an outer surface of the protruding region.

15. The ink cartridge of claim 1, wherein the ink supply opening is defined by an elastic member, the elastic member being capable of sealingly gripping an extraction element in an image forming device.

16. The ink cartridge of claim 1, wherein the top surface includes an indented portion.

17. The ink cartridge of claim 16, wherein the indented portion is capable of engaging an engaging arm that secures the ink cartridge in communication with an image forming device.

18. The ink cartridge of claim 1, wherein the protruding region is formed of a material that does not transmit light.

19. The ink cartridge of claim 1, wherein the ink cartridge is formed of a material that does not transmit light.

20. The ink cartridge of claim 1, wherein at least a part of the at least one portion is located between about 10.2 and about 13.2 mm from a center of the ink supply opening in a direction from a first side wall side of the ink cartridge to a second side wall side of the cartridge.

21. The ink cartridge of claim 1, wherein at least a part of the at least one portion is located between about 11.2 and about 12.2 mm from a center of the ink supply opening in a direction from a first side wall side of the ink cartridge to a second side wall side of the cartridge.

22. The ink cartridge of claim 1, wherein at least a part of the at least one portion is located about 11.7 mm from a center of the ink supply opening in a direction from a first side wall side of the ink cartridge to a second side wall side of the cartridge.

23. The ink cartridge of claim 1, wherein at least a part of the at least one portion is located 11.7 mm from a center of the ink supply opening in a direction from a first side wall side of the ink cartridge to a second side wall side of the cartridge.

24. The ink cartridge of claim 1, wherein the ink supply opening is located on the bottom wall at a position closer to the first side wall than to the second side wall.

25. The ink cartridge of claim 1, wherein a first lateral distance between the ink supply opening and a lower edge of the first side wall adjacent to the bottom wall is less than a second lateral distance between the ink supply opening and an outermost edge of the protruding region, lateral being defined as a direction extending from the first side wall to the second side wall.

26. An ink cartridge, comprising:

a first side wall;

a second side wall opposite from the first side wall;

a front wall;

a back wall opposite from the front wall;

a bottom wall;

a top wall opposite from the bottom wall; and an ink chamber formed in a space enclosed by the first side wall, the second side wall, the front wall, the back wall, the bottom wall and the top wall;

wherein:

the bottom wall includes an ink supply opening through which ink may be provided to a print head;

a protruding region of the ink cartridge protrudes outwardly from the first side wall;

the protruding region includes a portion formed of a material through which an ink detecting light may pass; and a light-blocking member is positioned so as to prevent light from passing through the protruding region via the portion in a direction from a front wall side of the protruding region to a back wall side of the protruding region, at least when the ink cartridge contains a predetermined amount of ink.

27. An ink cartridge, comprising:

a first side wall;

a second side wall opposite from the first side wall;

a front wall;

a back wall opposite from the front wall;

a bottom wall;

a top wall opposite from the bottom wall; and an ink chamber formed in a space enclosed by the first side wall, the second side wall, the front wall, the back wall, the bottom wall and the top wall;

wherein:

the bottom wall includes an ink supply opening through which ink may be provided to a print head;

a protruding region of the ink cartridge protrudes outwardly from the first side wall; and the protruding region is configured so as to be positioned between two guiding protrusions of an image forming device when the cartridge is installed in the image forming device.

28. An ink cartridge, comprising:

an ink chamber;

a first side wall;

a bottom wall that includes an opening through which ink may be supplied to an outside of the ink cartridge, the bottom wall being substantially perpendicular to the first side wall; and a light-blocking member being formed of a material that prevents light from passing therethrough;

wherein:

the first side wall and the bottom wall bound the ink chamber from the outside of the ink cartridge;

the opening intersects a plane defined by the light-blocking member; and the first side wall is located between the opening and the light-blocking member.

29. The ink cartridge of claim 28, wherein the light-blocking member extends from the first side wall.

30. The ink cartridge of claim 29, further comprising a second side wall opposite from the first side wall, a front wall, and a back wall opposite from the front wall, wherein the light-blocking member is capable of preventing light from passing through the light-blocking member in a direction perpendicular to the front wall and the back wall.

31. The ink cartridge of claim 28, further comprising a top wall opposite from the bottom wall, wherein the light-blocking member extends from the top wall.

32. The ink cartridge of claim 28, further comprising a bottom cover that includes the bottom wall, wherein the light-blocking member extends from the bottom cover.

33. The ink cartridge of claim 28, wherein at least a part of the light-blocking member is located between about 10.2 mm and about 13.2 mm from the opening in a direction that the bottom wall extends.

34. The ink cartridge of claim 28, wherein at least a part of the light-blocking member is located between about 23.7 mm and about 26.7 mm from a plane defined by the bottom wall.

35. An ink cartridge, comprising:

an ink chamber;

first side wall;

a bottom wall that includes an opening through which ink may be supplied to an outside of the ink cartridge, the bottom wall being substantially perpendicular to the first side wall; and a light-blocking member being formed of a material that prevents light from passing therethrough;

wherein:

the first side wall and the bottom wall bound the ink chamber from the outside of the ink cartridge;

the first side wall defines a first plane, the bottom wall defines a second plane and the light-blocking member lies substantially in a plane perpendicular to the first and second planes; and the first side wall is located between the opening and the light blocking member.

36. The ink cartridge of claim 35, wherein the light-blocking member extends from the first side wall.

37. The ink cartridge of claim 36, further comprising a second side wall opposite from the first side wall, a front wall and a back wall opposite from the front wall, wherein the light-blocking member in is capable of preventing light from passing through the light-blocking member in a direction perpendicular to the front wall and the back wall.

38. The ink cartridge of claim 35, further comprising a top wall opposite from the bottom wall, wherein the light-blocking member extends from the top wall.

39. The ink cartridge of claim 35, further comprising a bottom cover that includes the bottom wall, wherein the light-blocking member extends from the bottom cover.

40. The ink cartridge of claim 35, wherein at least a part of the light-blocking member is located between about 10.2 mm and about 13.2 mm from the opening in a direction that the bottom wall extends.

41. The ink cartridge of claim 35, wherein at least a part of the light-blocking member is located between about 23.7 mm and about 26.7 mm from a plane defined by the bottom wall.

* * * * *